US006157797A

United States Patent [19]

Saito et al.

[11] Patent Number: 6,157,797

[45] Date of Patent: Dec. 5, 2000

[54] IMAGE FORMING APPARATUS WITH INTEGRATED ROTATABLE IMAGE CARRIER AND WRITING DEVICE AND METHOD OF ASSEMBLING THE SAME

[75] Inventors: Masanori Saito, Tokyo; Nobuyuki Yanagawa, Kanagawa; Yoshinobu Takeyama, Kanagawa; Hideaki Kibune, Kanagawa, all of Japan

[73] Assignee: Ricoh Company, Ltd., Tokyo, Japan

[21] Appl. No.: 09/205,366

[22] Filed: Dec. 4, 1998

[30] Foreign Application Priority Data

Dec. 4, 1997 [JP] Japan ..... 9-334014

[51] Int. Cl.[7] ..... G03G 15/00

[52] U.S. Cl. ..... 399/107; 347/138; 347/152; 399/110; 399/126

[58] Field of Search ..... 399/107, 110, 399/117, 118, 119, 126, 299, 301; 347/138, 152, 170, 245, 263; 29/428, 469

[56] References Cited

U.S. PATENT DOCUMENTS

| | | | |
|---|---|---|---|
| 4,403,851 | 9/1983 | Yanagawa . | |
| 4,542,976 | 9/1985 | Kasamura | 399/111 |
| 4,821,051 | 4/1989 | Hediger | 347/130 |
| 4,875,153 | 10/1989 | Hous | 347/137 |
| 4,921,236 | 5/1990 | Saeki et al. . | |
| 5,155,506 | 10/1992 | Yamaguchi | 347/138 |

FOREIGN PATENT DOCUMENTS

| | | |
|---|---|---|
| 3-215875 | 9/1991 | Japan . |
| 4-168066 | 6/1992 | Japan . |
| 4-204871 | 7/1992 | Japan . |
| 4-221974 | 8/1992 | Japan . |
| 4-284468 | 10/1992 | Japan . |
| 7-52452 | 2/1995 | Japan . |
| 8-305120 | 11/1996 | Japan . |
| 9-95013 | 4/1997 | Japan . |
| 10-031342 | 2/1998 | Japan . |

OTHER PUBLICATIONS

English translation of Japanese Patent Laid–Open Publication No. 4–204871 (11 pages).

English translation of Japanese Patent Laid–Open Publication No. 4–221974 (12 pages).

*Primary Examiner*—Joan Pendegrass

*Attorney, Agent, or Firm*—Oblon, Spivak, McClelland, Maier & Neustadt, P.C.

[57] ABSTRACT

An image forming apparatus includes a common mount member formed with a shaft support portion for supporting a shaft supporting an image carrier and a writing device support portion for supporting the writing device. The common mount portion is affixed to a stationary member. The image carrier and writing device are held in a preselected positional relation via the common mount member. Also, a positional relation between the image carrier and a developing device is set via the common mount member. The image carrier and members surrounding it can be accurately assembled and adjusted in position with ease.

46 Claims, 45 Drawing Sheets

REAR
FRONT
RIGHT-AND-LEFT
1100A
1110A
1120A
1110A1
400
402
900A
910A
920A
910A1
300
302
6-3A
136'
72
103
304a
21a
16
17
140A'
304a
304
65A2
136
6-1A
208
200

IMAGE FORMING APPARATUS WITH INTEGRATED ROTATABLE IMAGE CARRIER AND WRITING DEVICE AND METHOD OF ASSEMBLING THE SAME

BACKGROUND OF THE INVENTION

1. Field of the Invention

The present invention relates to an image forming apparatus and a method of assembling the same.

2. Discussion of the Background

An image forming apparatus of the type forming a latent image on a rotatable image carrier with a writing device, developing the latent image to produce a corresponding toner image and transferring the toner image to a paper or similar recording medium is conventional. The problem with this type of image forming apparatus is that when any one of the writing devices and other process members arranged around the image carrier is not accurately located at a preselected position, it lowers the quality of images. Particularly, in a color image forming apparatus transferring toner images of different colors one above the other, the displacement of any process member brings the colors out of register.

Japanese Patent Laid-Open Publication No. 8-62916, for example, discloses a method for accurately positioning the above process members. The method uses mount portions included in side walls forming a part of the apparatus body. Support portions supporting opposite ends of a photoconductive element, an optical unit and other structural elements are mounted on the mount portions, so that the photoconductive element and optical unit are accurately positioned relative to each other.

The above mount portion scheme will be successful so long as the side walls of the apparatus body are light weight and small size. The side walls, however, usually have a substantial size and a substantial weight because they are major constituents for mounting major structural elements. Mounting the photoconductive element, optical unit and others on such heavy and bulky side walls would, if not impossible, complicate assembly, considering the cost on a quantity production basis.

SUMMARY OF THE INVENTION

It is therefore an object of the present invention to provide an image forming apparatus allowing an image carrier and members surrounding it to be accurately mounted and adjusted in position with ease, and a method of assembling the same.

In accordance with the present invention, an image forming apparatus for writing a latent image on a rotatable image carrier with a writing device, developing the latent image to thereby produce a toner image, and transferring the toner image to a recording medium includes a shaft support portion for supporting a shaft included in the image carrier, and a writing device support portion for supporting the writing device. A positional relation between the image carrier and the writing device is set by use of a common mount member affixed to a stationary member.

Also, in accordance with the present invention, a method of assembling an image forming apparatus for writing a latent image on a rotatable image carrier with a writing device, developing the latent image to thereby produce a toner image, and transferring the toner image to a recording medium begins with the step of mounting to the side wall of a body of the image forming apparatus a common mount member including a support portion for supporting a receiving portion receiving the image carrier and a support portion for supporting the writing device. The support portions are held in a preselected positional relation. The writing device is mounted to the common mount member. Subsequently, the image carrier is mounted to a developing unit including a developing device for developing the latent image to thereby form a composite unit, or the composite unit is constructed beforehand. Finally, the composite unit is mounted to the common mount member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The present invention will be described in detail with reference to the accompanying drawings.

[1] Image Forming Apparatus

[1]-a Outline

A specific image forming apparatus to which the present invention is applied will be described together with an image forming process particular thereto. The apparatus includes two image stations arranged at a preselected distance from each other along the same run of an intermediate transfer belt. Each image station includes a photoconductive drum image carrier. A charger, writing device, developing device, cleaning device and so forth are arranged around the drum. Each image station operates in accordance with the conventional electrostatic recording system. Specifically, the charger uniformly charges the surface of the drum in the dark. The writing device electrostatically forms a latent image of a particular color on the charged surface of the drum. The developing device develops the latent image with toner. The resulting toner image is transferred from the drum to the intermediate transfer belt.

The developing device of each of the two image stations is assumed to be capable of developing a latent image with toner of two colors. Then, three primary colors and black are available and can be allotted to the two developing devices in order to form a full-color image.

While the same image forming area of the intermediate transfer belt sequentially passes the two image stations, the image stations transfer the perspective toner images of one color one above the other. Then, while the image forming area of the belt carrying the resulting bicolor image thereon passes the two image stations again, the image stations transfer the respective toner images of the other colors one above the other. As a result, when the above image forming area passes the two image stations twice, a full-color toner image is formed on the image forming area. The full-color toner image is transferred from belt to a paper or similar recording medium. The toner image is fixed on the paper by a fixing device.

The apparatus to be described uses the above image forming process and can output printings at a high speed in synchronism with the rotation of the intermediate transfer belt. The image carrier is implemented by a photoconductive drum while the writing means is implemented by LEDs (Light Emitting Diodes) and a converging light transmitting body. Alternatively, the image carrier and writing device may be implemented by an endless belt and a laser, respectively. Further, for the image carrier, use may be made of a medium capable of forming a latent image without using light, in which case the writing device may use an electric or magnetic scheme.

[1]-b Outline of Image Forming Process

Figure 18:
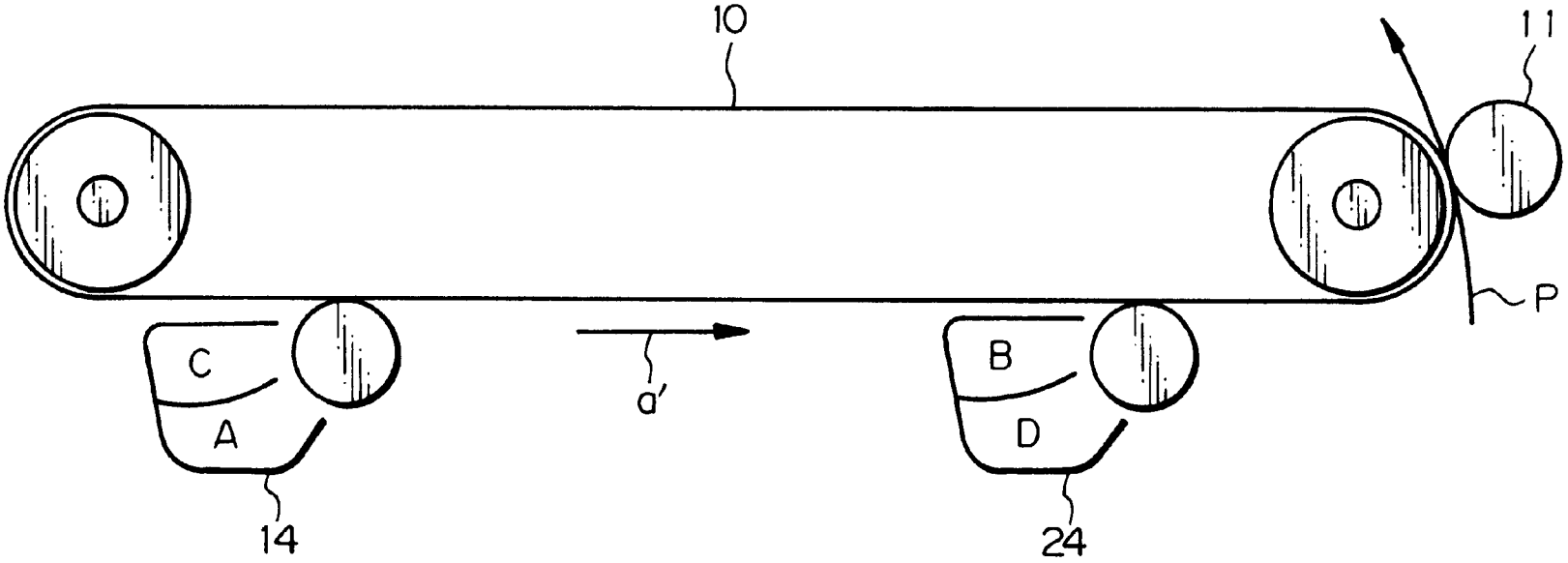
FIG. 18 shows an image forming process.

A toner image formed on a photoconductive drum, photoconductive belt or similar image carrier in at least three primary colors A, B and C is transferred from the image carrier to an intermediate transfer belt or body. Then, the color image is transferred from the belt to a paper. Specifically, as shown in FIG. 18, an intermediate transfer belt 10 moves in the direction indicated by an arrow a'. A first image station 14 and a second image station 24 are arranged at a preselected distance along the same run of the belt 10. The image stations 14 and 24 each includes a photoconductive drum, charging device and developing device. The image stations 14 and 24 transfer the respective toner images to the belt 10 in the order shown in FIGS. 19 or 20. The resulting color image formed on the belt 10 is transferred to a paper P by the transferring mechanism 11.

[1]-c First Example of Image Forming Process

Figure 19:
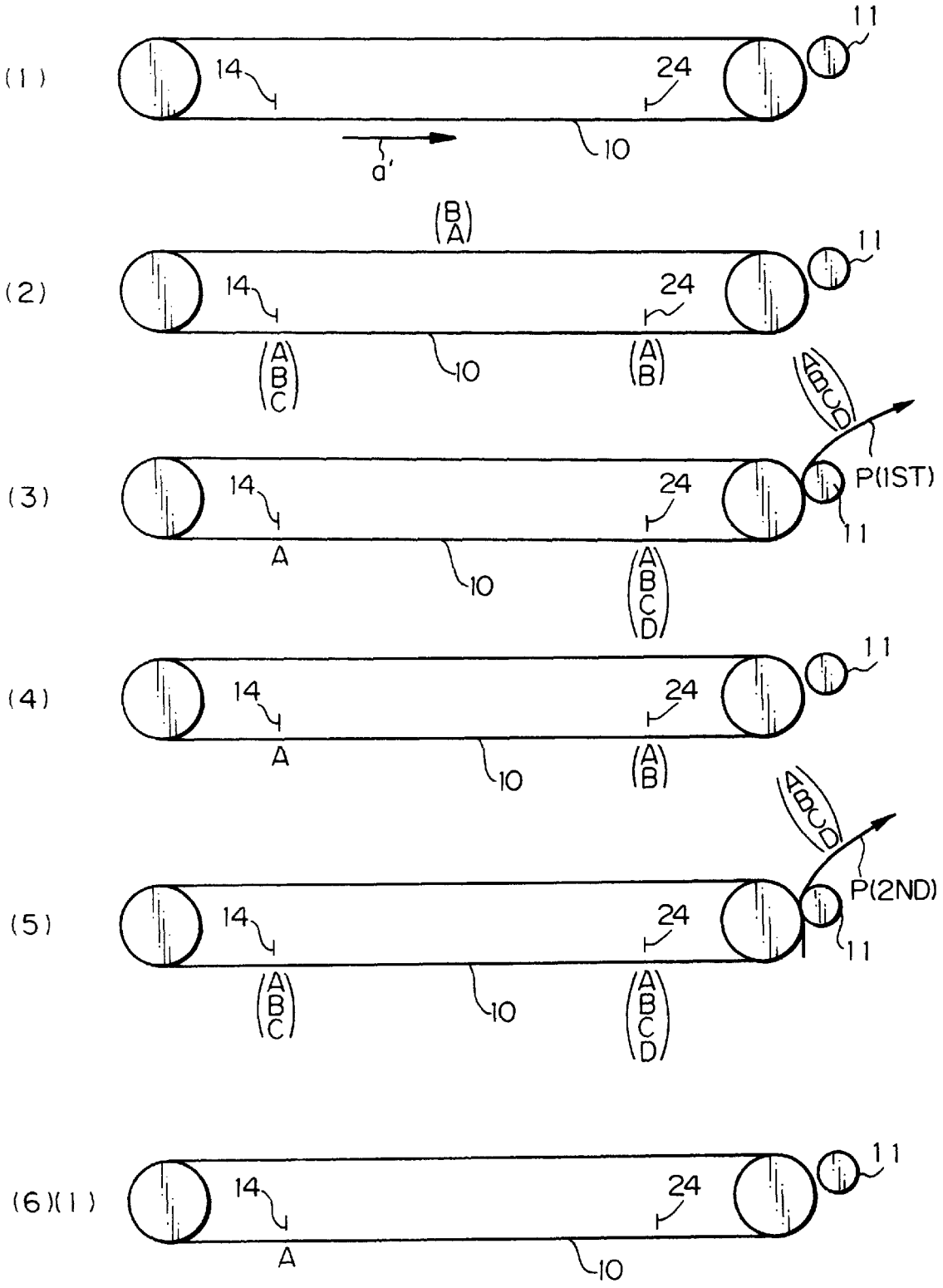
FIG. 19 shows a first example of a color image forming process.

Assume that the belt 10 has an overall length L and a length m corresponding to the length of the paper P in the direction of movement during image transfer. Then, FIG. 19 shows a color image forming procedure in which L is equal to m+$\alpha$ where $\alpha$ denotes the length of the non-image area of the belt 10 in the direction of movement of the belt 10. FIG.

Figure 20:
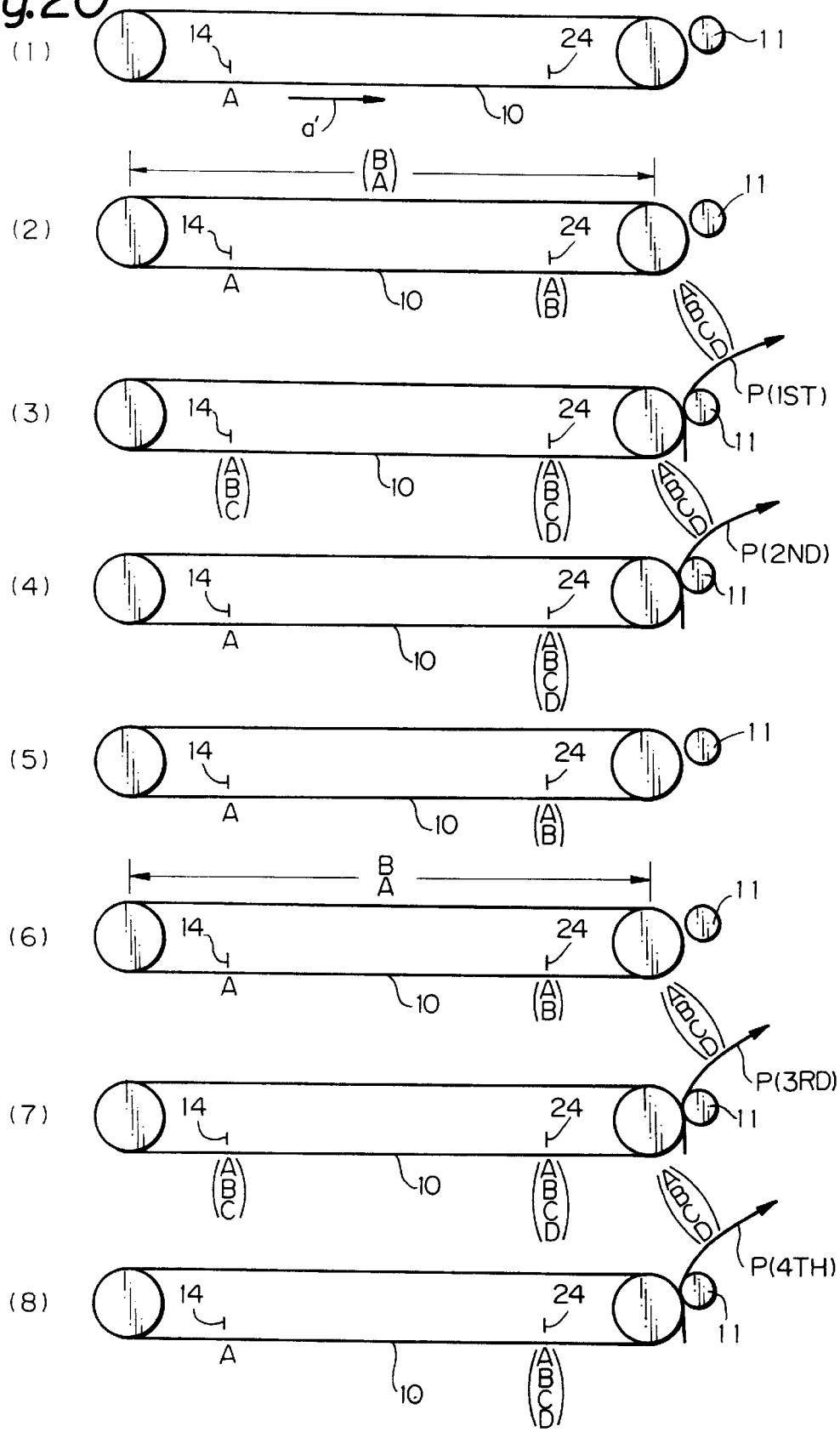
FIG. 20 shows a second example of the color image forming process.

20 shows a color image forming procedure in which L in equal to 2(m+α). In FIGS. 19 and 20, α is assumed to be smaller than m. It is to be noted that the length α depends on the length of the image area of the belt 10 or the length of the paper P used. Therefore, α may be greater than m, depending on the length of the paper P.

Steps (1)–(6) shown in FIG. 19 are as follows. In the step (1), the first image station 14 transfers a toner image of color A to the belt 10 with its developing device assigned to the color A. In the step (2), the second image station 24 transfers a toner image of color B to the belt 10 over the toner image of color A, thereby forming an AB toner image. Then, the first image station 14 transfers a toner image of color C over the AB toner image to thereby form an ABC toner image. At this time, the belt 10 completes substantially one full rotation.

In the step (3), the second image station 24 transfers a toner image of color D (black) over the ABC toner image. The resulting ABCD or full-color image is transferred from the belt 10 to the paper P (first paper) by a transfer roller or transferring mechanism. The transfer of the full-color image to the first paper P is executed during the second rotation of the belt 10.

The stops (4)–(6) are executed when a plurality of color printings are desired. In the step (4), the first image station 14 transfers a toner image of color A at the same time as the second image station 24 transfers a toner image of color D in the step (3). Then, the second image station 24 transfers a toner image of color B to thereby form an AB toner. In the step (5), the first image station 14 transfers a toner image of color C over the AB toner image, and then the second image station 24 transfers a toner image of color D. The resulting full-color image is transferred to the second paper P. This occurs while the belt 10 is in its fourth rotation. In the step (B), the step (3) and successive steps are repeated to produce the third and successive printings. The third printing is output during the sixth rotation of the belt 10.

[1]-d Second Example of Image Forming Process

As shown in FIG. 20 (L/2=m+α) in the step (1), the first image station 14 transfers a toner image of color A to the belt 10 with its developing device assigned to the color A. In the step (2), while the first image station 14 transfers another toner image of color A to the belt 10, the second image station 24 transfers a toner image of color B over the first A toner image to thereby form an AB toner image. At this time, the belt 10 completes substantially one full rotation.

In the step (3), the first image station 14 transfers a toner image of color C over the AB toner image formed in the step (2), thereby forming an ABC toner image. The second image station 24 transfers a toner image of color D to the resulting ABC toner image. The resulting full-color image is transferred to the first paper P by the transfer roller 11. The transfer to the first paper P begins when the belt 10 completes substantially one and half rotations.

The steps (4)–(8) are executed when a plurality of printings are desired. In the step (4), the first image station 14 formed the ABC toner image in the step (3) transfers another toner image of color A. At the same time, the second image station 24 transfers a toner image of color D over the ABC toner image. The resulting full-color image is transferred to the second paper P. This begins when the belt 10 completes substantially two and half rotations.

In the step (5) the second image station 24 transfers a toner image of color B over the A toner image transferred by the first image station 14 in the step (4). In the step (6), while the first image station 14 transfers another toner image of color A to the belt 10, the second image station 24 transfers a toner image of color B over the A toner formed in the step (4), thereby forming an AB toner image. In the step (7), the first image station 14 transfers a toner image of color C over the AB toner image formed in the step (6) to thereby form an ABC toner. The second image station 24 transfers a toner image of color D over the ABC toner. The resulting color image is transferred to the third paper P; the transfer begins when the belt 10 completes substantially three and half rotations. In the step (8), while the first image station 14 transfers a toner image of color A, the second image station 24 transfers a toner image of color D over the ABC toner image formed in the step (7). The resulting color image is transferred to the fourth paper P; the transfer begins when the belt 10 completes substantially four and half rotations.

As stated above, when the belt 10 is twice or more as long as the paper P, the first printing is output by two rotations of the belt 10 while the second printing is output by three rotations of the same. Likewise, the third and fourth printings are respectively output by four rotations and five rotations of the belt 10. That is, each printing begins to be produced when the belt 10 starts a rotation the order of which is the order of the printing plus about 0.5, and is fully produced when the belt 10 completes a rotation the order of which is the order of the printing plus 1.

[1]-e General Construction of Apparatus

Figure 21:
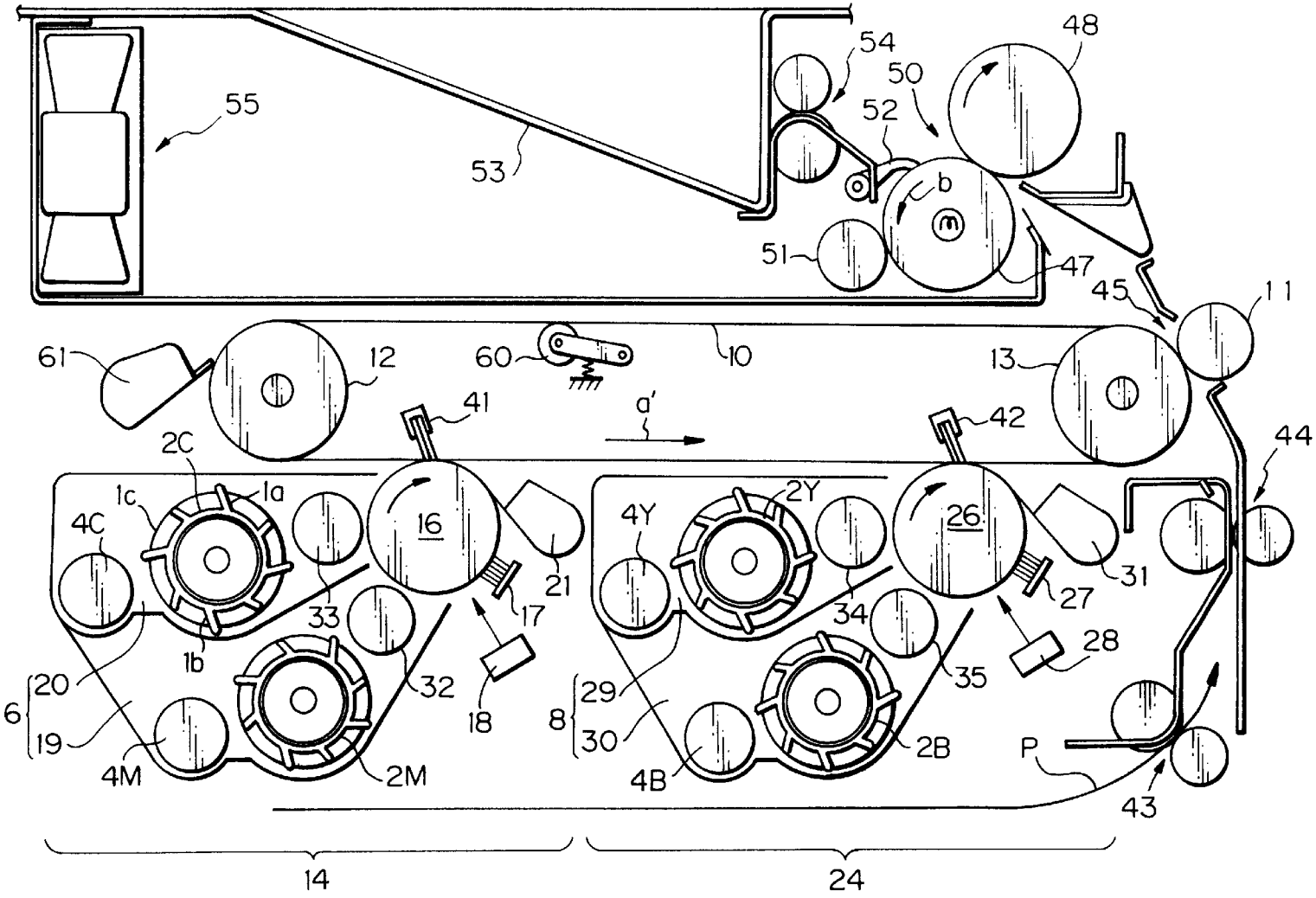
FIG. 21 shows the general construction of an image forming apparatus.

Referring to FIG. 21, the belt 10 is passed over a drive roller 13 and a driven roller 12 and driven by the drive roller 13 in a direction indicated by an arrow a'. A tension roller 60 applies an optimal degree of tension to the belt 10. The first and second image stations 14 and 24 are arranged at a preselected distance along the lower run of the belt 10. The belt 10 is longer than papers of maximum size applicable to the apparatus by the length of its non-image area.

The first image station 14 includes a brush-like charger 17 for uniformly charging the surface of a photoconductive drum or image carrier 16. Writing device 18 electrostatically forms a latent image on the charged surface of the drum 18 with a beam modulated by an image signal representative of a document image. Developing sections 19 and 20 respectively assigned to the colors A and C and cleaning device 21 are arranged, as illustrated. Let the developing sections 19 and 20 be referred to as A and C developing sections, respectively. The A and C developing sections 19 and 20 constitute a first developing device 6.

The second image station 24 is identical in construction with the first image station 14 and includes a photoconductive drum 26, a charger 27, writing device 28, developing sections 29 and 30 respectively assigned to the colors B and D and cleaning device 31. Let the developing sections 29 and 30 be referred to as B and D developing sections, respectively. The B and D developing sections 29 and 30 constitute a second developing device 8. The second image station 24 is mounted on the apparatus body in the same orientation as the first image station 14.

The two image stations 14 and 24 are removably mounted to the apparatus body. The drums 16 and 26 rotate in synchronism with the rotation of the belt 10, and each has a peripheral speed precisely identical with the running speed of the belt 10. The chargers 17 and 27 may be replaced with corona chargers or roller type charging devices, if desired.

The A, C, B and D developing sections 19–30 each stores a two-ingredient type developer. Specifically, the A developing section 19 stores magenta toner and carrier while the C developing section 20 stores cyan toner and carrier. The B developing section 29 stores yellow toner and carrier while the D developing section 30 stores black toner and carrier. The developing sections 19–30 respectively develop latent images formed on the drums 16 and 26 by the charger 17 and writing device 18 with their developing rollers 32, 33, 34 and 35. The developing rollers or developing devices 32–35 are made up of a stationary magnet and a nonmagnetic sleeve rotatable about the magnet (magnet brush development system).

The developing sections 19–30 each includes a paddle or agitator and a screw or toner replenishing member. Any one of conventional color developing sections including one taught in Japanese Patent Laid-Open Publication No. 8-160697 is applicable.

Specifically, screws 4M (magenta), 4C (cyan), 4Y (yellow) and 4B (black) each has a spiral blade. Paddles 2M, 2C, 2Y and 2B each has a spiral blade 1*c* and eight radial plates in order to convey the developer while agitating it. The paddles 2M and 4M convey the developer in the axially opposite directions in order to evenly distribute the developer in the axial direction of the developing roller 32. A bias voltage for image transfer is applied to each of a first and a second transfer brush 41 and 42. The transfer brushes 41 and 42 are movable into and out of contact with the drums 16 and 26, respectively, via the belt 10. The transfer roller 11 applied with a bias voltage for image transfer is movable into and out of contact with the drive roller 13 via the belt 10. The transfer brushes 41 and 42 may be replaced with transfer rollers or corona dischargers, if desired.

The drums 16 and 26 are usually slightly spaced below the belt 10. The transfer brushes 41 and 42 are slightly spaced above the belt 10. During image transfer from the drums 16 and 26 to the belt 10, the transfer brush 41 and/or the transfer brush 42 causes the belt 10 to contact the drum 16 and/or the drum 25.

The drive roller 13 and transfer roller 111 constitute a transfer section 45 for transferring a color image. If desired, the transfer roller 11 may be replaced with a corona discharger or a transfer brush. A cleaning device 61 is movable into and out of contact with the driven roller 12 via the belt 10 in order to remove toner left on the belt 10. A drive mechanism 104, which will be described later, is assigned to the cleaning device 61.

A paper feeder, not shown, is positioned below the image stations 14 and 24 for feeding papers P stacked thereon one by one to the right, as viewed in FIGS. 18 and 21. The paper P fed from the paper feeder is conveyed to the transfer section 45 by a pair of feed rollers 43 and a pair of registration rollers 44. A fixing unit 50 is made up of a heat roller 47 and a press roller 47 and located obliquely above the transfer section 45. The heat roller 47 is caused to rotate in the direction indicated by an arrow b while the press roller 48 is rotated by the heat roller 47. A roller 51 for applying an anti-offset liquid to the surface of the heat roller 47 is movable into and out of correct with the heat roller 47. A peeler 52 for peeling the paper P is held in contact with the heat roller 47.

A pair of outlet rollers 54 are positioned downstream of the fixing device 50 in order to drive the paper P coming out of the device 50 to a tray 53. An exhaust fan 55 is positioned in the top left portion of FIG. 21. The exhaust fan 55 protects electronic parts positioned below the tray 53 from the influence of heat output from the fixing device 50.

Figure 12:
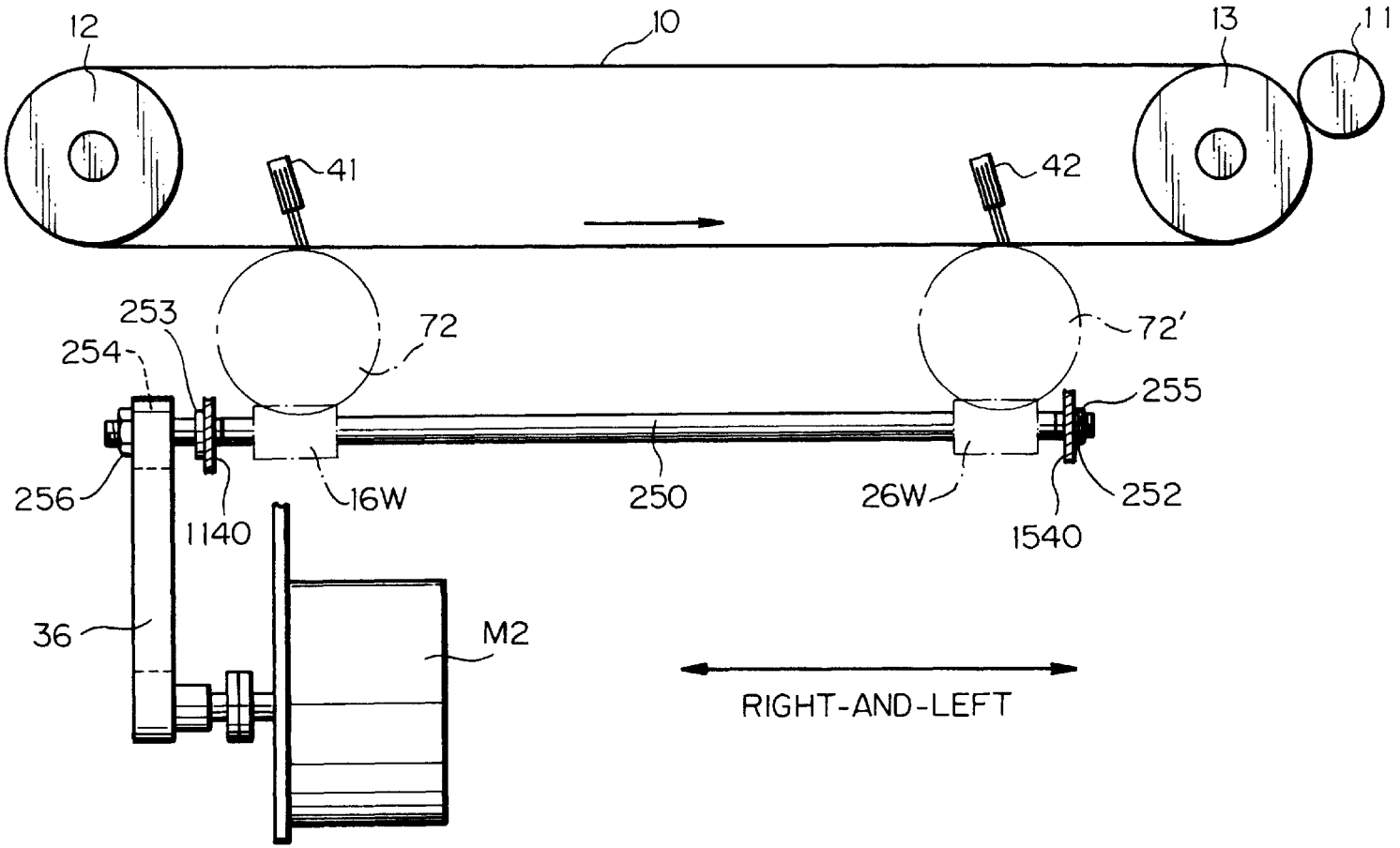
FIG. 12 shows a driveline for driving a photoconductive drum or image carrier.

The drum 16 and 26 are identical in shape, size and material. FIG. 12 shows an arrangement for driving the drums 16 and 26 at the same speed. As shown, a gear 72 in the form of a worm gear is formed coaxially and integrally with the drum 16. A gear 72' also implemented as a worm gear is formed coaxially and integrally with the drum 26. A worm 16W is held in mesh with the gear 72. A worm 26W is mounted on the same worm shaft 250 as the worm 16W and held in mesh with the gear 72'. The worm shaft 250 is driven by a motor M2 via a belt 38. In this configuration, the rotation speed of the motor M is controlled to cause the drums 16 and 26 to rotate at the same linear velocity as the belt 10.

Figure 22:
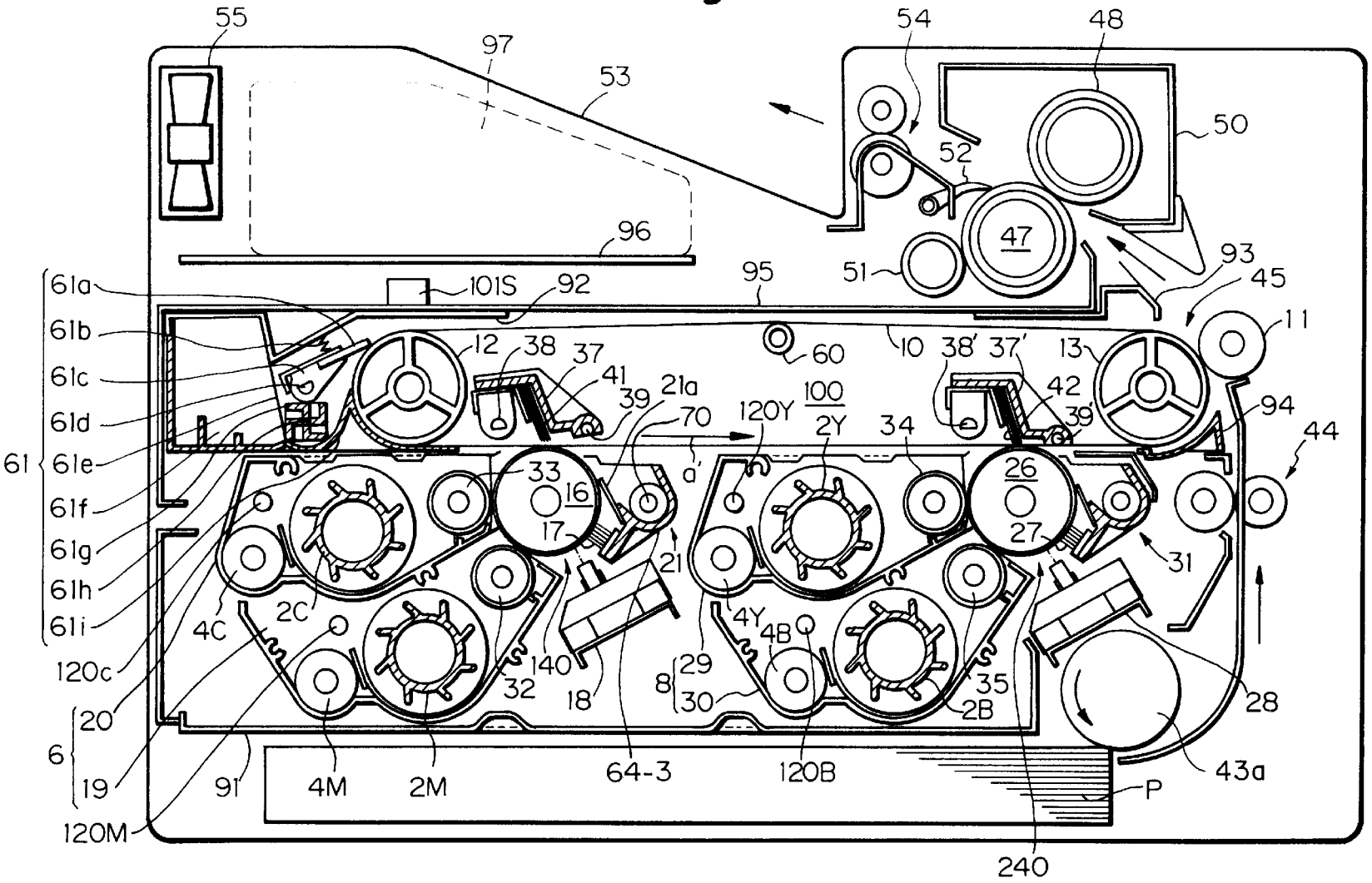
FIG. 22 shows the image forming apparatus of FIG. 21 more specifically.

FIG. 22 shows an image forming apparatus which is a more specific form of the apparatus described with reference to FIG. 21. The apparatus of FIG. 22 will be described in relation to the apparatus of FIG. 21. First, FIG. 22 shows the arrangements around the transfer brushes more specifically. As shown, the first transfer brush 41 is affixed to a rotatable member 37 which is rotatable about a shaft 38 supported by a stationary member. The transfer brush 41 is positioned at the free end of the rotatable member 37. A transfer roller 39 is also mounted on the free end of the rotatable member 37. The transfer brush 41 may be constantly held in contact with the belt 10. In the illustrative embodiment, the movable angle of the member 37 is controlled such that the transfer brush 41 contacts the belt 10 only during the image transfer from the drum 16 to the belt 10.

The arrangement around the second transfer brush 42 is identical with the arrangement around the first transfer brush 41 and includes a rotatable member 37', a shaft 38', and a transfer roller 39'. The transfer brushes 41 and 42 each is moved into and out of contact with the belt 10 at a particular timing. In the specific condition shown in FIG. 22, the transfer brush 41 and transfer roller 39 are spaced from the belt 10 while the transfer brush 42 and transfer roller 39' are held in contact with the belt 10. In this manner, the transfer brush 42 and transfer roller 39' contact the drum 26 via the belt 10 while being spaced from each other, so that the belt 10 can contact the drum 26 over a preselected nip width. This successfully enhances, the image transfer ability. This is also true with the transfer brush 41 and transfer roller 39. Of course, the transfer rollers 39 and 39', transfer brushes 41 and 42 and members associated therewith extend in the direction perpendicular to the sheet surface of FIG. 22 over the width of the belt 10.

Second, FIG. 22 shows the arrangement around the cleaning device 61 more specifically. As shown, the cleaning device 61 includes a blade 61*a* movable into and out of contact with the belt 10, a rotatable member 61*c* supporting the plate 61*a*, a shaft 61*d* supporting the rotatable member 61*c*, a spring or biasing mechanism 61*b* constantly biasing the member 61*c* such that the blade 61*a* tends to contact the belt 10, a guide 61*i* for guiding toner and paper dust scraped off by the blade 61*a* downward, a swastika-shaped rotary member 61*g* positioned below the guide 61*i*, a leaf spring 61*e* contacting the rotary body 61*g* at its free end, and a box 61*f* positioned at the opposite side to the rotary body 61*g* with respect to the leaf spring 61*e*.

The rotary body 61*g* is rotatable about a center shaft 61*h*. The base end of the leaf spring 61*e* is supported by a frame 92. The shaft 61*d* is connected to a drive mechanism. This drive mechanism is controlled such that the rotatable member 61*c* rotates against the action of the spring 61*b* for causing the blade 61*a* to move away from the belt 10 or, as shown in FIG. 22, the rotation of the member 61*c* is canceled in order to cause the blade 61*a* to remain in contact with the belt 10 under the action of the spring 61*b*.

The blade 61*a* is usually spaced from the belt 10 so as not to disturb a toner image. Only when the toner and paper dust deposited on the belt 10 should be removed after the image transfer is the blade 61 is brought into contact with the belt 10. The toner and paper dust removed by the blade 61*a* are brought to the rotary body 61*g* along the guide 61*i* due to their own weight. The rotary body 61*g* causes the leaf spring 61*e* to deform while in rotation and thereby delivers the toner and paper dust to the box 61*f*. Of course, the blade 61*a*, guide 61*i*, rotary body 61*g*, box 61*f* and members associated therewith extend in the direction perpendicular to the sheet surface of FIG. 22 over the width of the belt 10.

Third, in FIG. 22, the feed roller pair 43 shown in FIG. 21 is absent while a pick-up roller 43*a* is shown on the top of the paper stack P. The pick-up roller 43*a* is journalled to a stationary member and connected to a driveline to be rotated at the time of paper feed. The papers P are stacked on a bottom plate, not shown, and positioned by a guide, not shown. While the papers P are sequentially fed by the pick-up roller 43*a*, the top paper P being first, the bottom plate is raised by conventional techniques such that the top paper P is constantly pressed against the pick-up roller 43*a* by an adequate pressure. The feed roller pair 43 may be additionally provided, if desired.

Fourth, FIG. 22 shows the configuration of the cleaning devices 21 and 31 specifically. The cleaning devices 21 and 31 will be described in detail later with reference to FIGS. 1, 2, 3 and 15. Briefly, the cleaning device 21, for example, includes a blade 21*a* extending over the width of the drum 16. Toner removed from the drum 16 by the blade 21 a is collected in a shaft support portion 64-1 having a generally U-shaped cross-section and having substantially the same length as the cleaning blade 21*a*. An auger 70 is rotated to deliver the collected toner to a box-like outlet portion 74 (see FIG. 1) positioned at one widthwise end of a drum unit 140. The cleaning device 31 is identical in construction with the cleaning device 21.

Fifth, in FIG. 22, the structural elements are constructed into groups or units. For example, the portion loaded with the paper stack P is positioned at the bottom of the apparatus and isolated from the overlying arrangements by a partition 91. Positioned above the partition 91 are the first developing device 6, second developing device 8, and so forth. The partition 91 covering the paper stack P prevents the toner from dropping from the developing devices onto the paper stack P.

Figure 1:
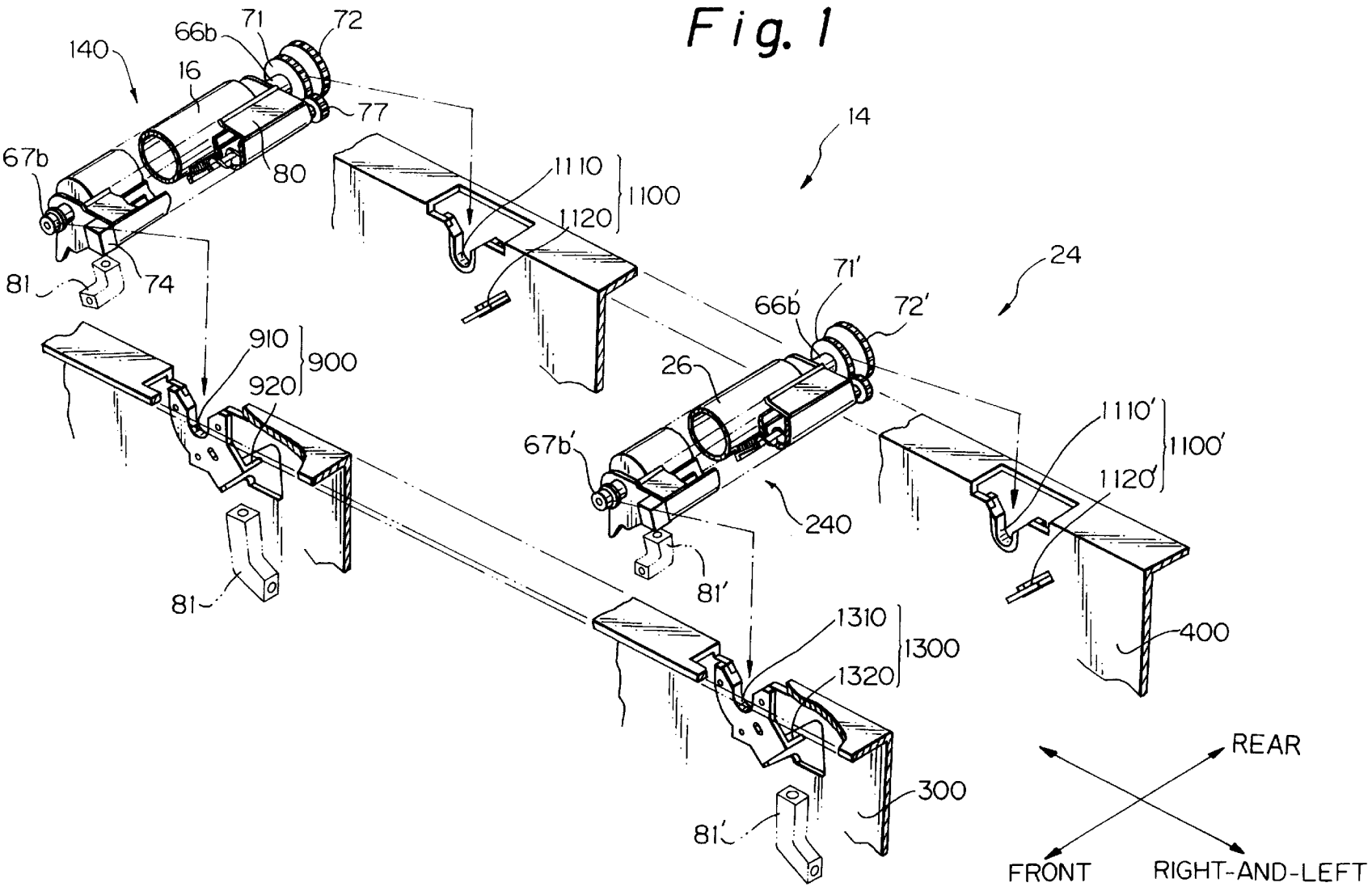
FIG. 1 is an exploded perspective view showing an image carrier unit is mounted to side walls.

The writing devices 18 and 28, developing devices 6 and 8, drum unit 140 and drum unit 140 are arranged in the space between the partition 91 and the belt 10. As shown in FIG. 1, the writing device 18 and drum unit 140 are removably mounted to opposite side walls 300 and 400 of the apparatus body via common mount members 900 and 1100. The first and second developing devices 6 and 8 are also constructed into units and removably mounted to the side walls 300 and 400 via the mount members 900 and 1100, as will be described in detail later. The A developing section 19, C developing section 20, B developing section 29, and D developing section 30 respectively include openings 120M, 120C, 120Y and 120B to be replenished with the respective toner.

Figure 24:
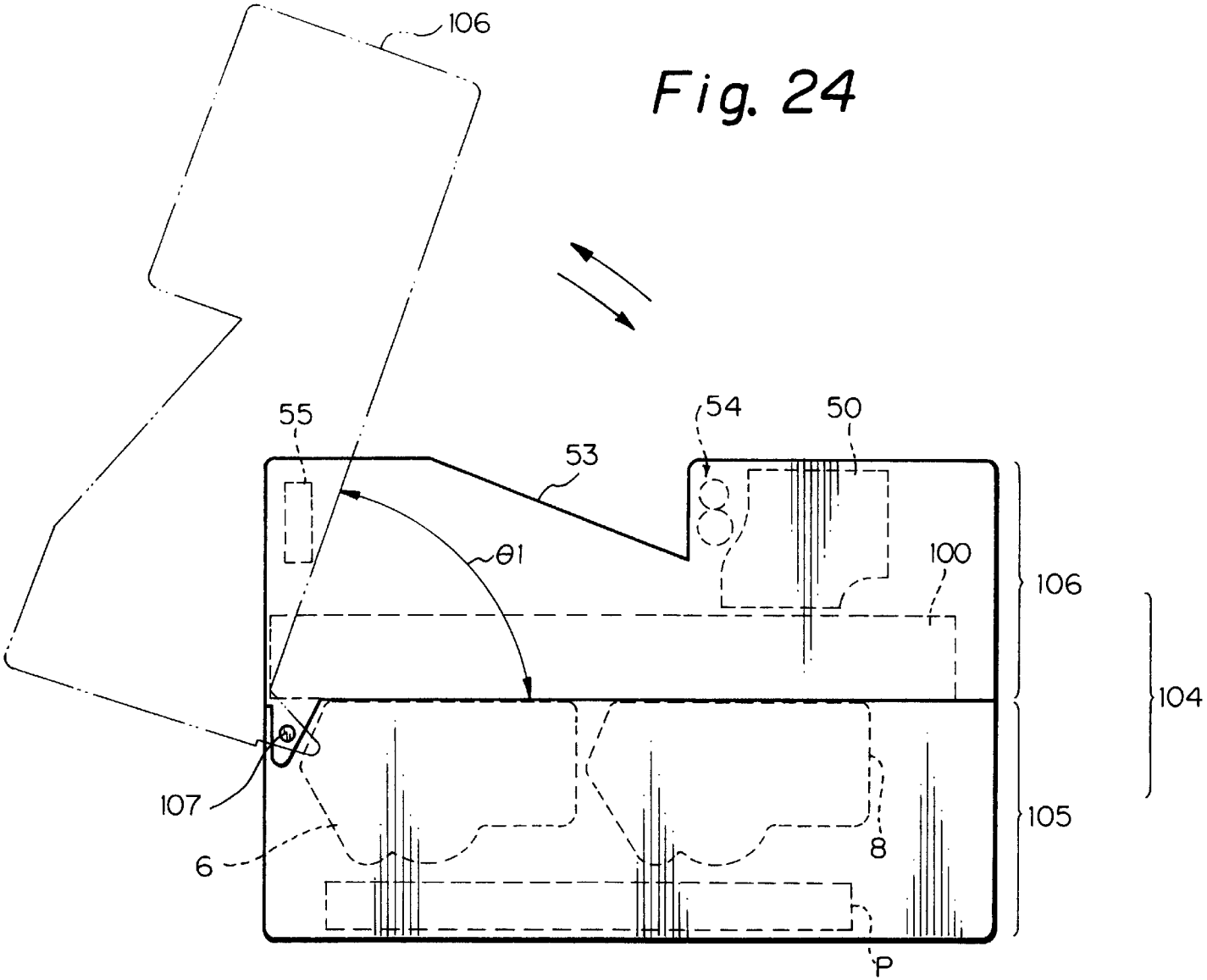
FIG. 24 shows the appearance of an image forming apparatus.

The belt 10, driven roller 13, driven roller 13, transfer roller 11, transfer brushes 41 and 42, transfer rollers 39 and 39', cleaning device 61 and so forth are accommodated in a flat box-like case and constitute a belt unit 100 (see FIG. 24). The box-like case includes the frame 92, a frame 93 playing the role of a paper guide at the same time, and guides 61*i* and 94. The belt unit 100 is supported by guides, not shown, below a partition 95 and removable from the apparatus. A belt mark sensor 101S is positioned on the partition 95 just above the driven roller 12. The belt mark sensor 101S is responsive to a mark positioned at one widthwise end of the belt 100. Various timings included in the image forming process are set on the basis of the output of the belt mark sensor 101S. In addition, the output of the belt mark sensor 101S is used to calculate the number of rotations of the belt 100. A partition is positioned just above the belt mark sensor 101S. A space 97 is formed between the partition 96 and the tray 53 for accommodating electric parts for driving and controlling the apparatus. The exhaust fan 55 discharges hot air ascribable to the electric parts to the outside of the apparatus.

Figure 2:
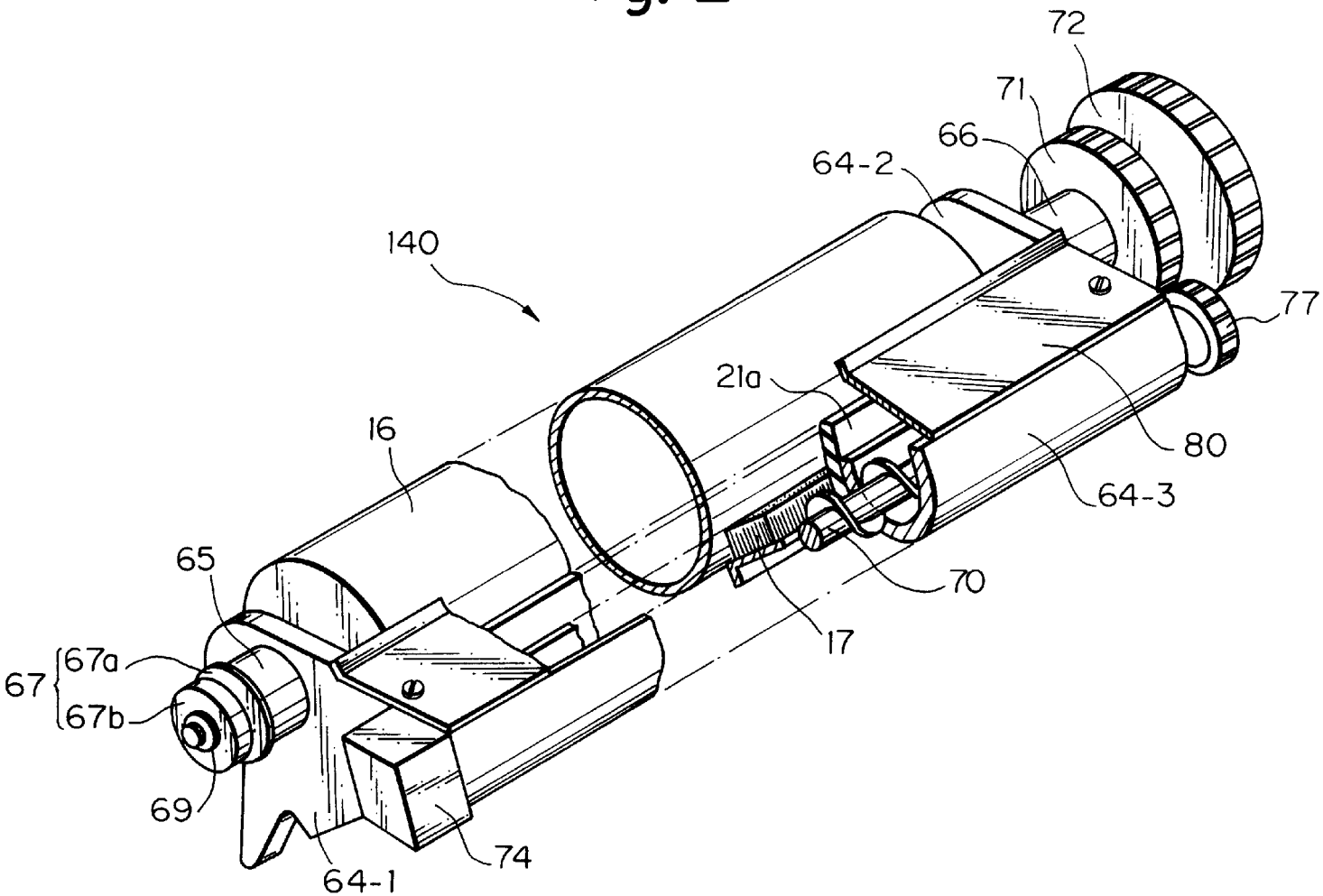
FIG. 2 is a perspective view of the image carrier unit.
Figure 3:
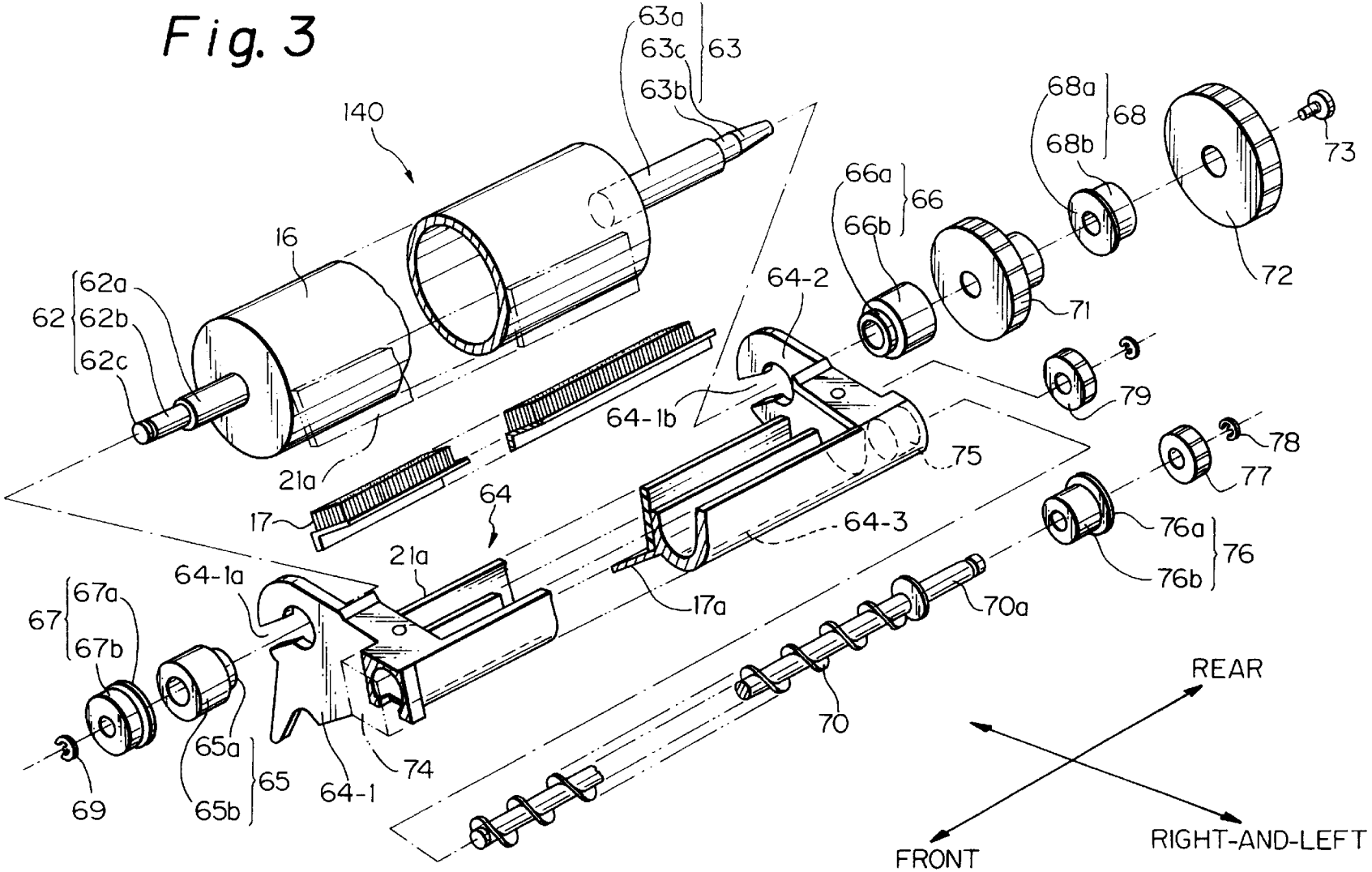
FIG. 3 is an exploded perspective view of the image carrier unit.
Figure 23:
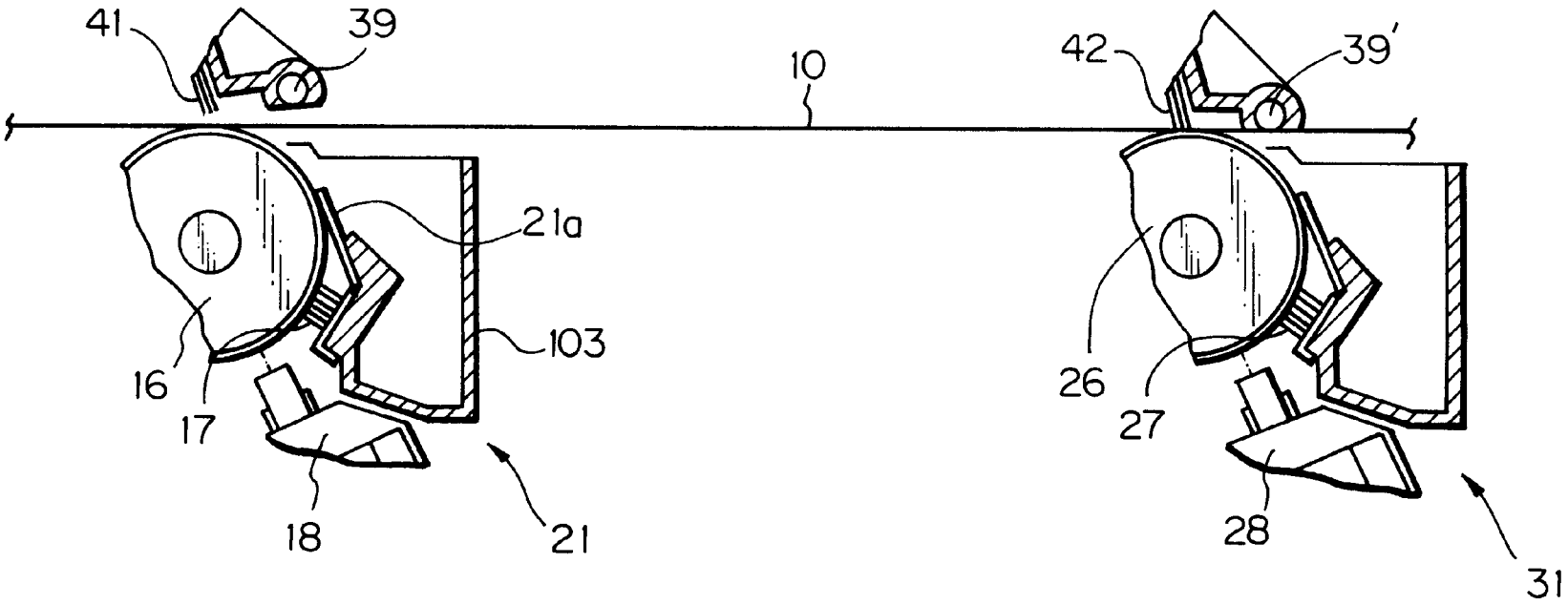
FIG. 23 shows another specific configuration of a toner collecting section included in the cleaning device.

FIG. 23 shows a modified form of the cleaning devices 21 and 31 included in the apparatus of FIG. 22. In FIGS. 1, 2, 3, 15 and 22, each cleaning devices 21 or 31 includes the auger 70 and therefore needs the gears 71 and 77 for driving it. In FIG. 23, a simple box 103 having substantially the same widthwise dimension as the cleaning blade 21*a* is used in order to omit the auger 70 and gears 71 and 77. As soon as a certain amount of toner is collected in the box 103, the drum unit including the drum 16 and constructed integrally with the box 103, as shown in FIGS. 1, 2 and 3, is bodily replaced.

As shown in FIG. 24, the entire apparatus shown in FIG. 22 or 23 is accommodated in a casing 104 made up of an upper casing part 105 and a lower casing part 106. The developing devices 6 and 8 and other members and the paper stack P are accommodated in the lower casing part 105. The belt unit 100, fixing device 50, outlet roller pair 54, exhaust fan 55, electric parts and other members are accommodated in the upper casing part 106. The tray 53 in mounted to the uppercasing part 106.

The upper casing part 106 is hinged to the lower casing part 105 via a shaft 107 at the side where the first developing device 6 is positioned in the right-and-left direction in FIG. 24. The upper casing part 106 is openable away from the lower casing part 105 to a position indicated by a dash-and-dots line in FIG. 24, so that the various members can be easily maintained or replaced. In the illustrative embodiment, the openable angle θ1 of the upper casing part 106 is selected to be 70° in order to facilitate the opening and closing operation.

[1]-f Operation of Entire Apparatus

The operation of the above image forming apparatus will be described, assuming the condition of $L=m+\alpha$.

The charger 17 and writing device 18 electrostatically form a later image to be developed by the A developing unit 19 on the drum 16 of the first image station 14. The A developing unit 19 develops the latent image to thereby form an M (magenta) toner image, The M toner image is transferred from the drum 16 to the belt 10 by the first transfer brush 41.

While the M image on the belt 10 approaches the second image station due to the rotation of the belt 10 (direction a'), the charger 27 and writing device 28 electrostatically form a latent image to be developed by the B developing section 29 on the drum 26. The B developing section 29 develops the latent image to thereby form a Y (yellow) toner image. The Y toner image is transferred to the belt 10 over the M toner image by the second transfer brush 42.

While the composite MY toner image approaches the first image station 14 due to the rotation of the belt 10, the charger 17 and writing device 18 form a latent image to be developed by the C developing section 20 on the drum 16. The C developing section 20 develops the latent image to thereby form a C (cyan) toner image. The C toner image is transferred from the drum 16 to the belt 10 over the MY image formed by the second image station 24 by the transfer brush 41.

While the composite MYC toner image approaches the second image station 24 due to the rotation of the belt 10, the charger 27 and writing device 28 form a latent image to be developed by the D developing section 35 on the drum 26. The C developing section 35 develops the latent image to thereby form a B (black) toner image. The B toner image is transferred from the drum 28 to the belt 10 over the MYC image formed by the first image station 14 by the transfer brush 42.

About the time when a full-color image is formed on the belt 10 by the transfer brush 42, the paper P fed from the paper feeder is brought to the transfer section 45 by the registration roller pair 44. The full-color image is transferred from the belt 10 to the paper P at the transfer section 45 and then fixed on the paper P. The outlet roller 54 drives the paper or printing P to the tray 53. The toner left on the belt 10 after the transfer of the full-color image is removed by the cleaning device 61.

To produce a plurality of printings, when the composite MY image is transferred at the second image station 24, an M image is transferred to the belt 10 at the first image station 14, Then, the steps (1)–(4) stated previously are repeated.

[2] First Configuration of Common Mount Members

[2]A Common Mount Members with Directly Mounted Drum Unit

FIGS. 1–17 show a specific configuration of the image forming apparatus of FIG. 21. As shown, the drum units 140 and 240 constituting the first and second image stations 14 and 24, respectively, are mounted to the side walls 300 and 400. The side walls 300 and 400 are implemented by parallel thin flat plates spaced by a distance sufficient to mount the drum units 140 and 240. The side walls 300 and 400 have their upper ends bent in the form of a letter L for reinforcement. In the following description, the side where the side wall 300 is positioned and the side where the side wall 400 is positioned will be respectively referred to as the front side and rear side, as viewed in FIG. 1 and successive figures.

Figure 4:
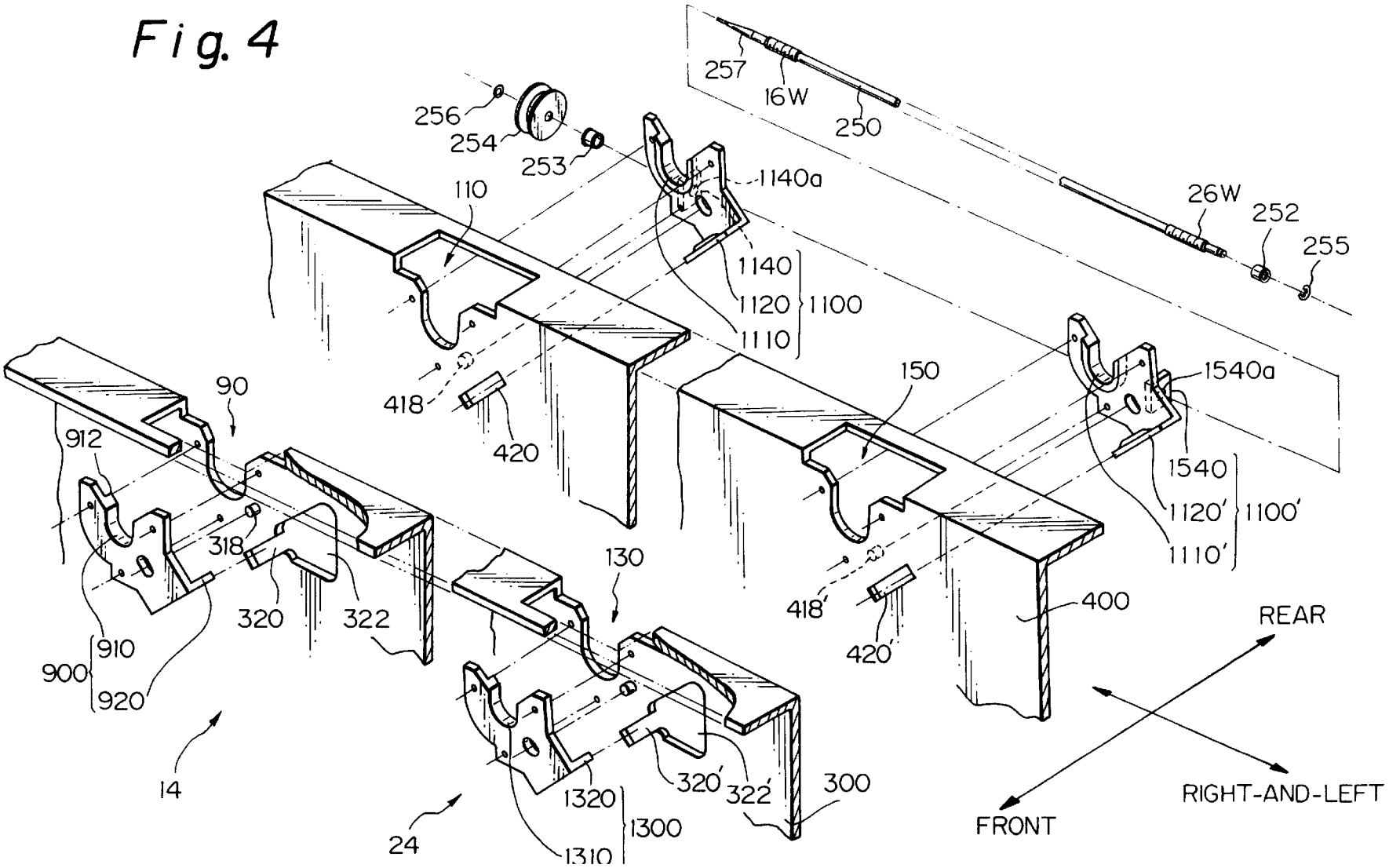
FIG. 4 is an exploded perspective view showing how common mount members are affixed to the side walls.

As shown in FIGS. 1 and 4, a mount portion 90 including a U-shaped notch is formed on the top of the side wall 300 (i.e., a stationary member) at a position where the first image station will be arranged. A mount portion 110 substantially identical in configuration with the mount portion 90 is formed on the top of the side wall 400 (i.e., a stationary member) and faces the mount portion 90. Likewise, a mount portion 130 including a U-shaped notch is formed on the top of the side wall 300 at a position where the second image station will be arranged. A mount portion 150 substantially identical in configuration with the mount portion 130 is formed on the top of the side wall 400 and faces the mount portion 130.

As for the first image station 14, the common mount member 900 is mounted to the mount portion 90 from the front side of the side wall 300 while the common mount member 1100 is mounted to the mount portion 110 from the rear side of the side wall 400. As for the second image station 24, common mount member 1300 is mounted to the mount portion 130 from the front side of the side wall 300 while a common mount member 1100' is mounted to the mount portion 150 from the rear side of the side wall 400. In this configuration, the mount members 900 and 1100 face each other in the axial direction of the drum 16 included in the drum unit 140. This positional relation also holds with the mount members 300 and 1100'.

The mount members 900 and 1100 are respectively formed with shaft support portions 910 and 1110 (62 and 63 in FIG. 3) for supporting the drum 16. Likewise, the mount members 1300 and 1100' are respectively formed with shaft support portions 1310 and 1110' (corresponding to 62 and 63 in FIG. 3) for supporting the drum 26.

The mount members 900 and 1100 have their lower ends bent in the form of a letter L for constituting support portions 920 and 1120, respectively. The support portions 920 and 1120 support the writing device 18, more specifically a base 18 included in the writing device 18. Likewise, the mount members 1300 and 1100' have their lower ends bent in the form of a latter L for constituting support portions 1320 nod 1120', respectively. The support portions 1320 and 1120' support the writing device 18.

As shown in FIG. 4, the mount members 1100 and 1100' mounted on the rear side wall 400 are identical in configuration except that their drive member support portions 1140 and 1540 for supporting the worm shaft 250 are different in position from each other. The support portions 1140 and 1540 respectively support the outer ends of the worms 16W and 26W, i.e., the axial ends of the worm shaft 250. The parts of the mount member 1100' identical with the parts of the mount member 1100 are distinguished from the latter only by dashes and will not be described specifically in order to avoid redundancy.

The support portions 920, 1120, 1320 and 1120' assigned to the writing device 18 are held in a preselected positional relation to the support portions 910, 1110, 1310 and 1110' assigned to the shafts.

At the first image station 14, the drive member support portion 1140 of the mount member 1100 includes a hole 1140*a*, for receiving the drive member (worm shaft 250) which transfers a torque to the image carrier (drum 16). Likewise, at the second image station 24, the drive member support portion 1540 of the mount member 1100' includes a hole 1540*a* for receiving the drive member (worm shaft 250) which transfers a torque to the image carrier (corresponding to the drum 26).

The drum unit 140 is mounted to the shaft support portions 910 and 1110 of the mount members 900 and 100 mounted on the side walls 300 and 400, respectively. The writing device 18 is mounted to the support portions 920 and 1120 of the mount members 900 and 1100.

At the second image station 24, the drum unit 240 is mounted to the shaft support portions 1310 and 1110' of the mount members 1300 and 1100' mounted on the side walls 300 and 400, respectively. The writing device 28 is mounted to the support portions 1320 and 1120' of the mount members 1300 and 110'. The worm shaft 250 is mounted to the drive member support portions 1140 and 1540 of the mount members 100 and 1540.

The mount members 900, 1100, 1300 and 1100' are directly mounted to the side walls 300 and 400, as stated above. Alternatively, the mount members 900, 1100, 1300 and 1100' may be mounted to respective stationary members (intermediate members hereinafter) to be mounted to the side walls 300 and 400.

The illustrative embodiment using a photoconductive element, which is a specific form of an image carrier, in similarly applicable to an image forming apparatus of the type using an image carrier other than the photoconductive element.

[2] A-a Drum Units

The drum units 140 and 240 which are the major members to be mounted to the side walls 300 and 440 are identical in construction. Only the construction of the drum unit 140 will be described in detail with reference to FIGS. 2 and 3. Although the configuration of the drum unit 240 will not be described specifically, it will be distinguished from the configuration of the drum unit 140 by dashes, as needed. The portions of the side walls 300 and 400 and members associated therewith for supporting the image stations 14 and 24 are also identical in configuration, and therefore only the portions for supporting the image station 14 will be described specifically.

Figure 15:
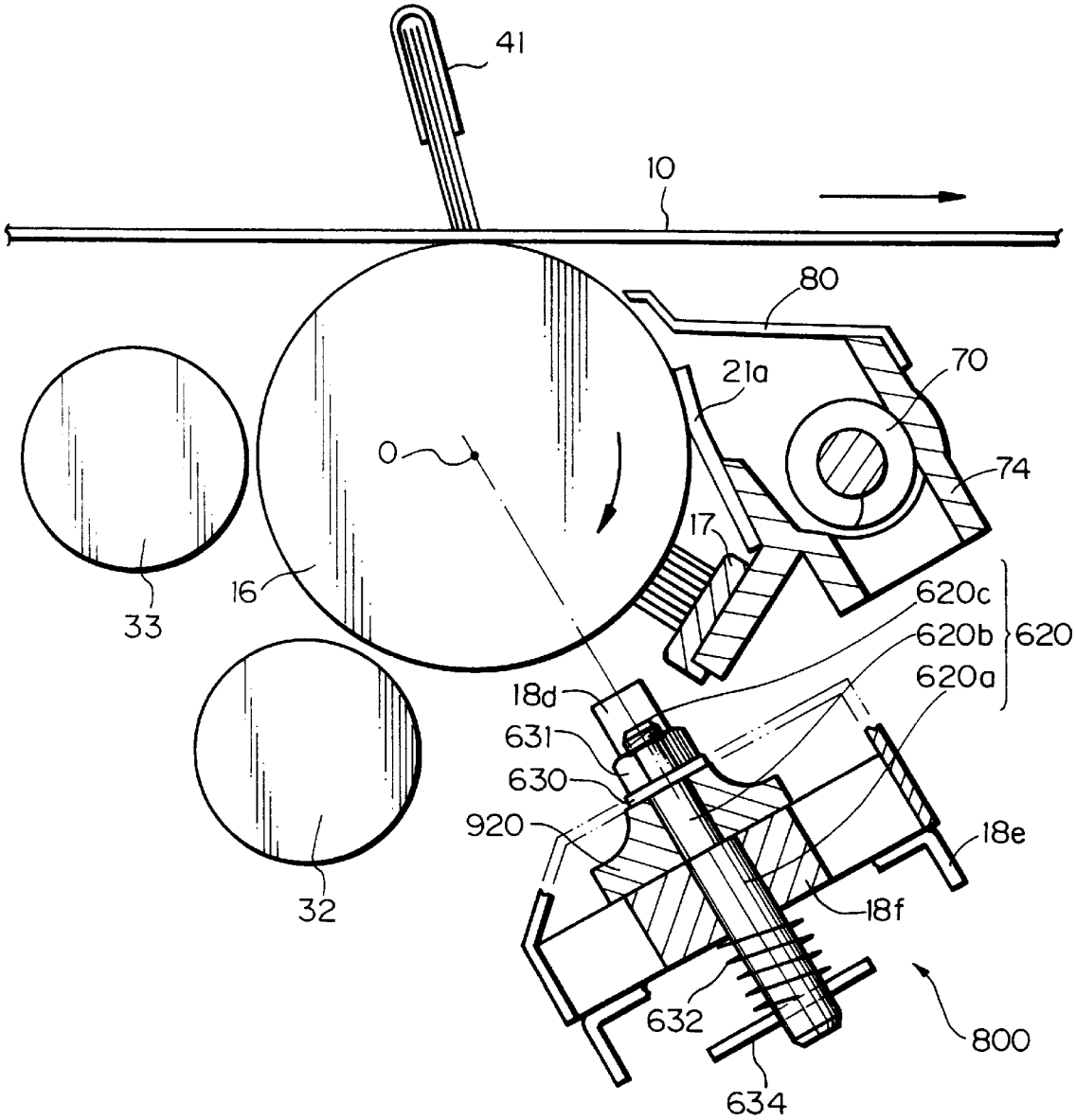
FIG. 15 is a section showing the arrangement of various members around the drum.

As shown in FIGS. 2 and 3, the shaft 62 protrudes from the front end of the drum 140 on the axis of rotation of the drum 140 (extending through the center 0 in the direction perpendicular to the sheet surface of FIG. 15). The shaft 62 has a larger diameter portion 62*a*, a smaller diameter portion, and a stop groove 62*c* sequentially formed toward the front. Likewise, the other shaft 63 protruded from the rear end of the drum 140 and has a larger diameter portion 63*a*, a smaller diameter portion 63*b*, and a tapered portion 63*c* sequentially formed toward the rear.

A case 64 supporting the drum unit 140 has a generally U-shaped configuration and is made up of a front support portion 64-1, a rear support portion 64-2, and a bridge portion 643 connecting them together. The support portions 64-1 and 64-2 include plate portions facing each other at a distance sufficient to accommodate the drum 16. The flat portions are respectively formed with keyhole-like openings 64-1*a* and 64-1*b* for receiving bearings which support the drum 16.

The keyhole-like openings 64-1*a* and 64-1*b* each is made up of a circular hole and a parallel hole narrower than the circular hole and communicating the circular hole to the outside. The parallel hole is sized to pass the larger diameter portion 62*a* of the shaft 62 or the larger diameter portion 63*a* of the shaft 63. The circular hole is sized to allow a smaller diameter portion 65*a* or 66*a* included in a bearing 65 or 66, respectively, to be press-fitted therein.

The drum 16 is mounted to the case 64 by the following procedure. The shafts 62 and 63 are respectively positioned at the centers of the openings 64-1*a* and 64-1*b* via the parallel holes. Then, the bearing 65 is coupled over the larger diameter portion 62*a* of the shaft 62 and has its smaller diameter portion 65*a* press-fitted in the opening 64-1*a*. Likewise, the bearing 66 is coupled over the larger diameter portion 63*a* of the shaft 63 and has its smaller diameter portion 66*a* press-fitted in the opening 64-1*b*. As a result, the drum 16 is rotatably supported by the case 64. Subsequently, a bearing 67 including a flange 67*a* is rotatably fitted on the smaller diameter portion 62*b* of the shaft 62, and then a stop member 69 is fitted in the stop groove 62*c*.

As for the rear shaft 63, the gear 71 for driving an auger 70, which will be described later, is affixed to the larger diameter portion 63*a*. Then, a bearing 68 including a flange portion 68*a* is rotatably fitted on the smaller diameter portion 83*b* in order to fix the gear 71 in position. After the gear 72 has been mounted to the tapered portion 63*c*, a stop screw 73 is driven into a threaded hole formed in the end of the tapered portion 63*c*. As a result, the gear 72 is affixed to the shaft 63 while being pressed against the tapered surface. Because the gear 72 is fixed in place by the tapered portion, it is accurately aligned with the axis of rotation of the drum 16.

The bridge portion 64-3 includes a surface for mounting the cleaning blade 21 of the cleaning device 21, FIG. 21. The bridge portion 64-3 additionally includes a base 17*a* for mounting the brush-like charger 17, FIG. 21.

A bore for receiving the auger or screw conveyor 70 extends throughout the shaft support portions 64-1 and 64-3 and bridge portion 64-3. In the shaft support portion 64-1, the above bore extends into the previously mentioned outlet portion 74 protruding to the front. The bore has a circular cross-section complementary to the outside contour of the auger 70. The bore is closed at axially opposite ends, but communicated to the outside via a rectangular slot formed in its bottom. The shaft support portion 64-2 in formed with a hole 75 greater in outside diameter than the auger 70. As shown in FIG. 3, the top of the bridge portion 64-3 is open so as not to obstruct the fall of the toner scraped off by the cleaning blade 21*a*. A cover 80 is mounted on the top of the bridge portion 64-3 (see FIGS. 2 and 15).

The auger 70 is inserted into the case 64 via the hole 75, as indicated by a dash-and-dot line in FIG. 3. The leading end of the auger 70 is received in the bore of the outlet portion 74. Then, a bearing 76 is fitted on a shaft portion 70*a* forming the trailing end of the auger 70. An outside diameter portion 76*b* included in the bearing 76 is press-fitted in the hole 75 until a flange 76*a* abuts against the edge of the hole 75. Further, the gear 77 is affixed to the shaft portion 70*a* and then stopped by a stop member 78. An idle gear 79 is mounted on a shaft, not shown, included in the shaft support portion 64-2 between the gears 71 and 77.

When the gear 72 is caused to rotate, the drum 16 and therefore the auger 70 rotates in such a manner as to deliver the collected toner or waste toner toward the outlet portion 74. The waste toner is caused to drop via an opening formed in the outlet portion 74 and then delivered to a waste toner collecting section, not shown by ducts 81 and 81' (see FIG. 1) connected to the outlet portion 74.

The larger diameter portion 65*b* of the bearing 65, the larger diameter portion 66*b* of the bearing 66, the outside diameter portion 67*b* of the bearing 67 and the outside diameter portion 68*b* of the bearing 68 serve to mount the drum unit 140 to another member. For this reason, no obstructions are present around the above portions in the direction perpendicular the axis of the drum unit 140.

To dismount the drum 16 from the case 64, the members around the drum 18 are sequentially removed in the reverse order. Finally, the bearings 65 and 66 are removed from the shaft support portions 64-1 and 64-2, respectively.

[2]A-b Mounting of Common Mount Member Side Wall (Front)

Figure 5:
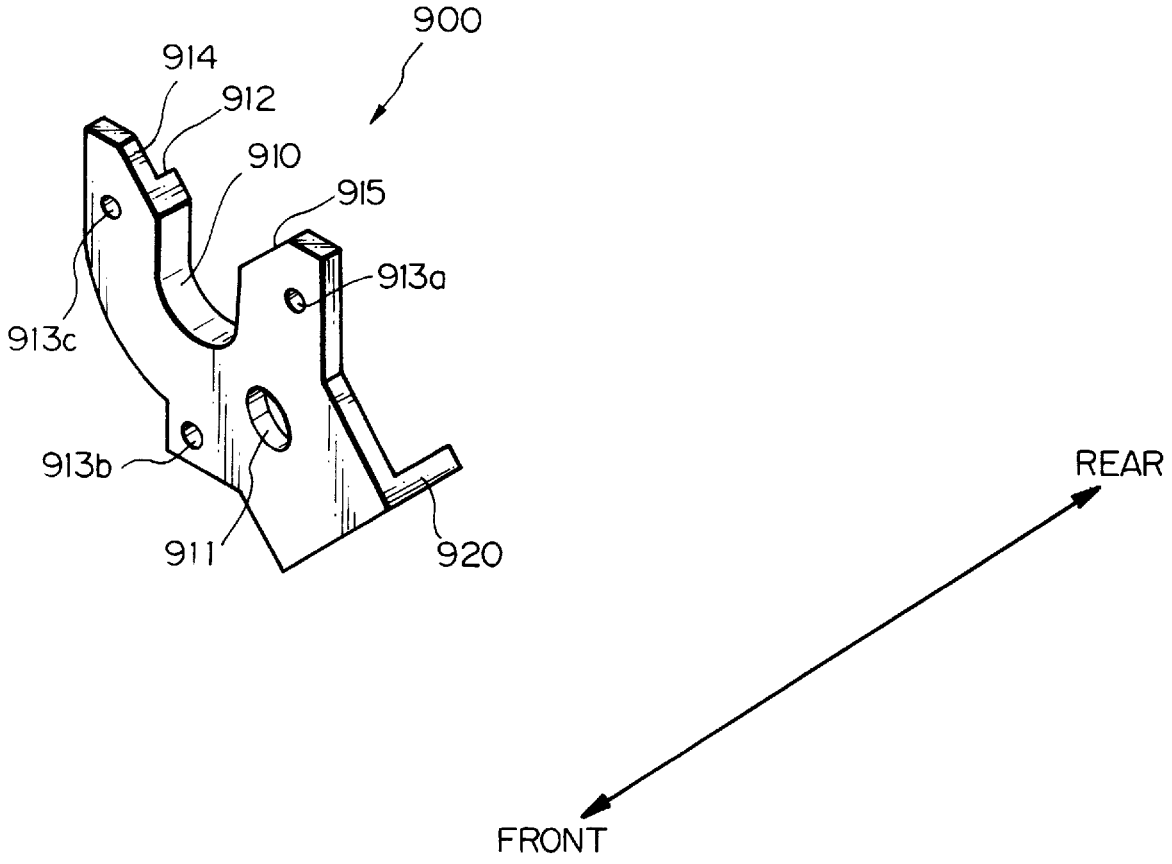
FIG. 5 is a perspective view showing front one of the common mount members.
Figure 6:
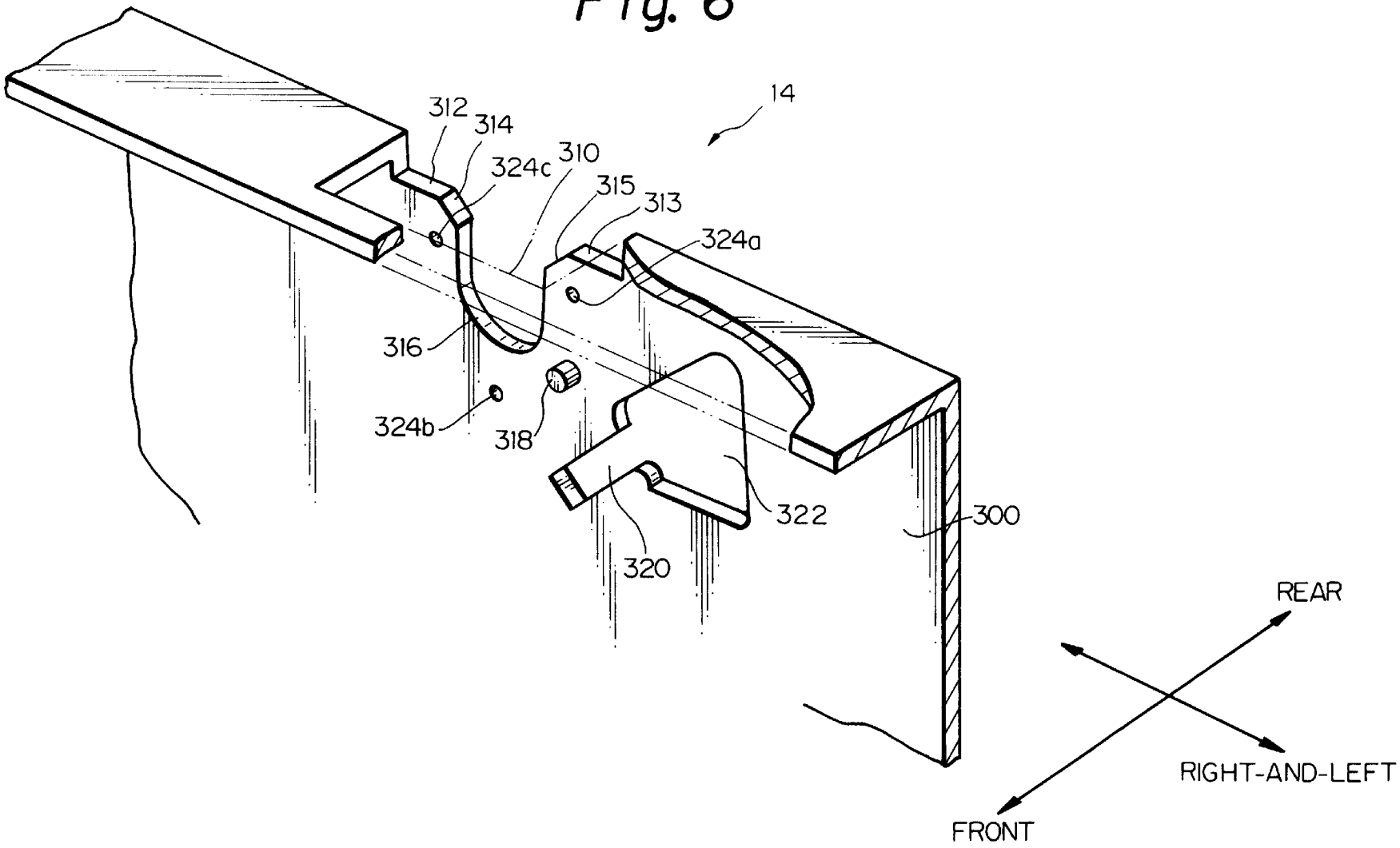
FIG. 6 is a perspective view showing front one of the side walls.
Figure 7:
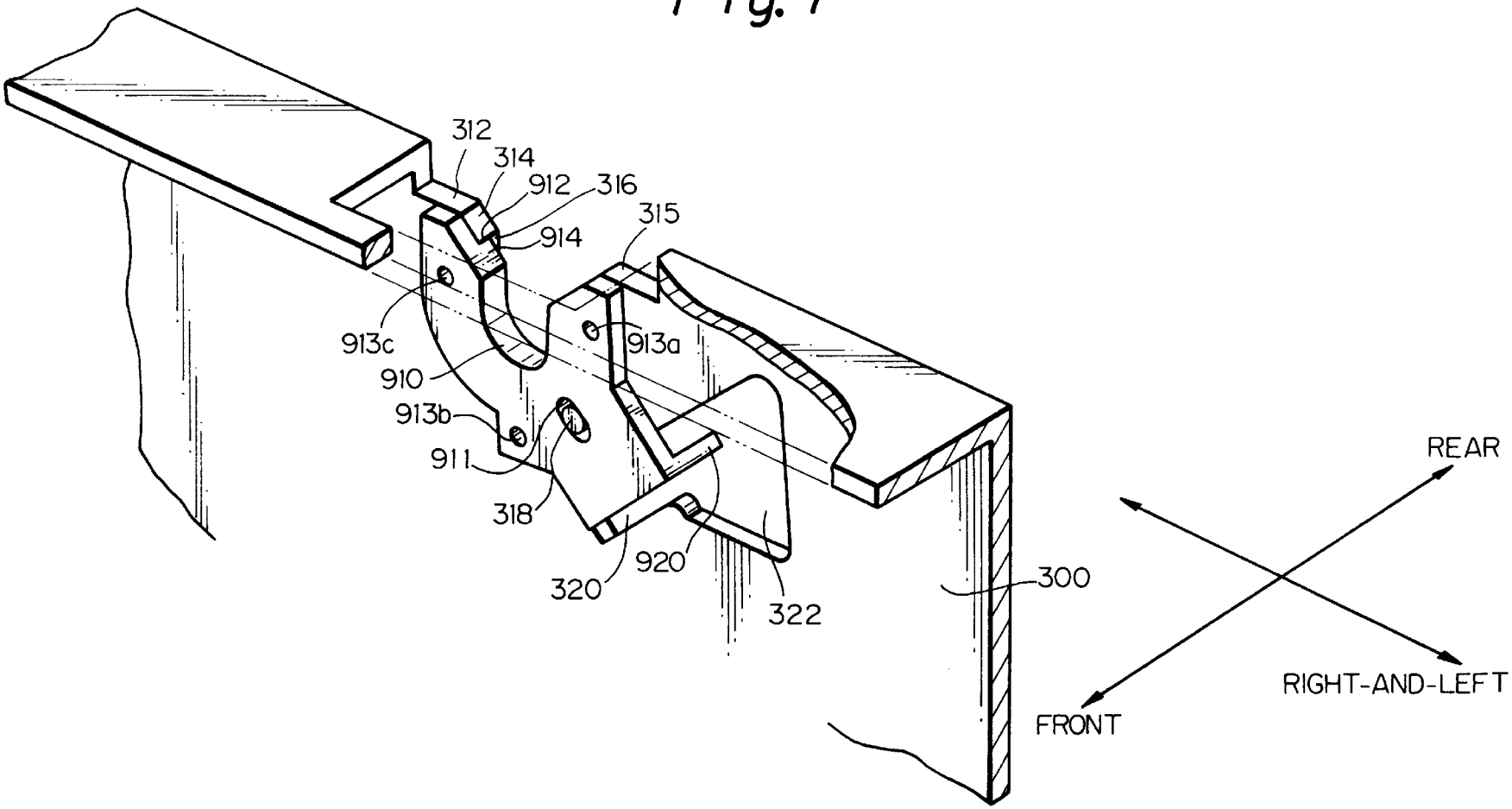
FIG. 7 is a perspective view showing the common mount member mounted to the front side wall.

FIGS. 5–7 show how the common mount member 900 is mounted to the front side wall 300. As shown in FIG. 5, the mount member 900 has, in addition to the two support portions 910 and 920, a slot 911 for positioning, a stepped portion 912 for positioning and holes 913*a*, 913*b* and 913*c*. The upper portions 910 are implemented as slants 914 and 915 for easily guiding the bearing 67. The shaft support portion 910 is implemented as a generally U-shaped notch made up of a semicircular lower portion identical in diameter with the outside diameter portion 67*b* of the bearing 67, and an upper portion also identical in diameter with the outside diameter portion 67*b*, but open to the outside. The stepped portion 912 has a U-shaped contour greater than the shaft support portion 910.

The slot 911 is elongated toward the axis of the semicircular portion of the shaft support portion 910 (coincident with the axis of the drum 16) and receives a positioning pin 381 which will be described later.

The configuration of the front side wall 300 will be described with reference to FIG. 6. As shown, the bent top of the side wall 300 where the first image station 14 should be arranged is removed in a rectangular shape, as designated by the reference numeral 310. The perpendicular portion of the side wall 300 is also notched in a stepped configuration, as designated by the reference numerals 312 and 313. A U-shaped notch 316 is formed in the side wall 300 and capable of mating with the stepped portion 912, FIG. 5.

The positioning pin 318 protrudes to the front from the perpendicular portion of the side wall 300. A hole 320 and a hole 322 communicated to each other are formed in the side wall 300 obliquely below the positioning pin 318. The holes 320 and 322 receive the writing device support portion 920 and duct 81, respectively. Holes 324*a*, 324*b* and 324*c* are formed in the side wall 300 around the notch 316 for mounting the mount member 900 to the side wall 300. Slants 314 and 315 respectively connect the upper portions of the notch 318 and stepped portions 312 and 313.

As shown in FIG. 7, the stepped portion 912 of the mount member 900 is engaged with the U-shaped notch 316 of the side wall 300, thereby positioning the axis of the shaft support portion 910. The slot 911 receives the positioning pin 318 and thereby determines the position of the writing device support portion 920 in the direction of rotation having the above axis at its center. In this condition, the holes 913*a*–913*c* and holes 324*a*–324*c* are aligned and used to affix the mount member 900 to the side wall 300. In this condition, the support portion 920 protrudes to the rear of the side wall 300 through the hole 320. The slants 914 and 915 and slants 314 and 315 are respectively flush with each other.

[3]A-c Mounting of Common Mount Member to Side Wall (Rear)

Figure 8:
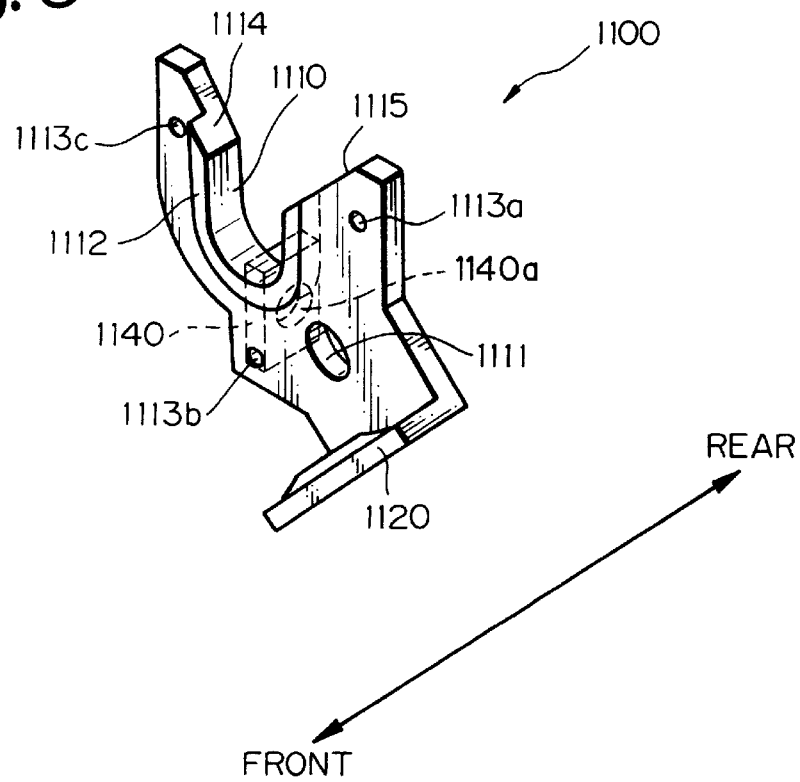
FIG. 8 is a perspective view showing one of rear common mount members.
Figure 9:
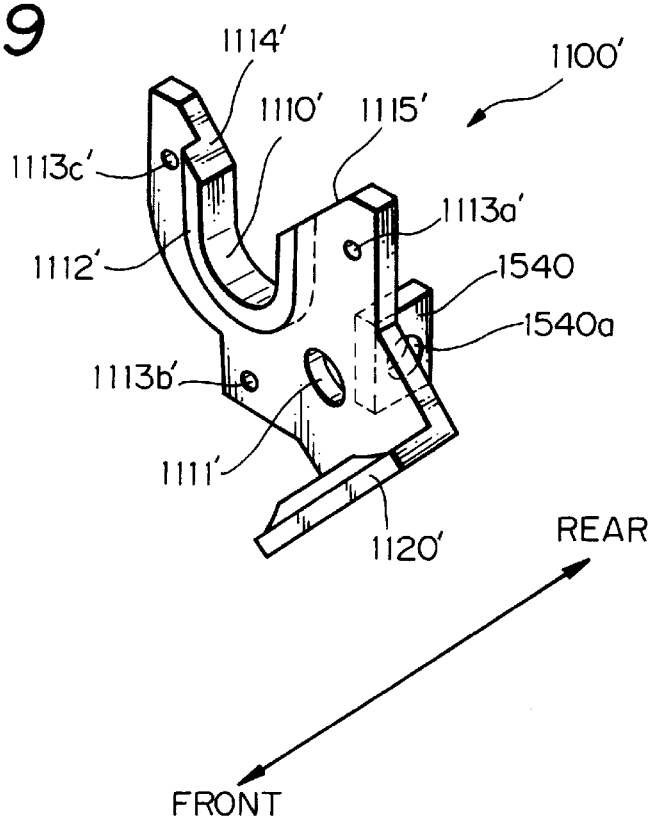
FIG. 9 is a perspective view showing the other rear common mount member.

FIGS. 8–11 show how the common mount member 1100 is mounted to the rear side wall 400. As shown in FIG. 8, the mount member 1100 has, in addition to the two support portions 1110 and 1120, a slot 1111 for positioning, a stepped portion 1112 for positioning, and holes 1113*a*, 1113*b* and 1113*c*. The upper portions are implemented as slants 1114 and 1115 for easily guiding the bearing 66. The shaft support portion 1110 is implemented as a generally U-shaped notch made up of a semicircular lower portion identical in diameter with the outside diameter portion 68*b* of the bearing 68, and an upper portion also identical in diameter with the outside diameter portion 68*b*, but open to the outside. The stepped portion 1112 has a U-shaped contour greater than the shaft support portion 1110.

The slot 1111 is elongated toward the axis of the semicircular portion of the shaft support portion 1110 (coincident with the axis of the drum 16) and receives a positioning pin 418 which will be described later. The drive member support portion 1140 formed with a hole for a bearing is formed on the rear surface of the mount member 1100.

Figure 10:
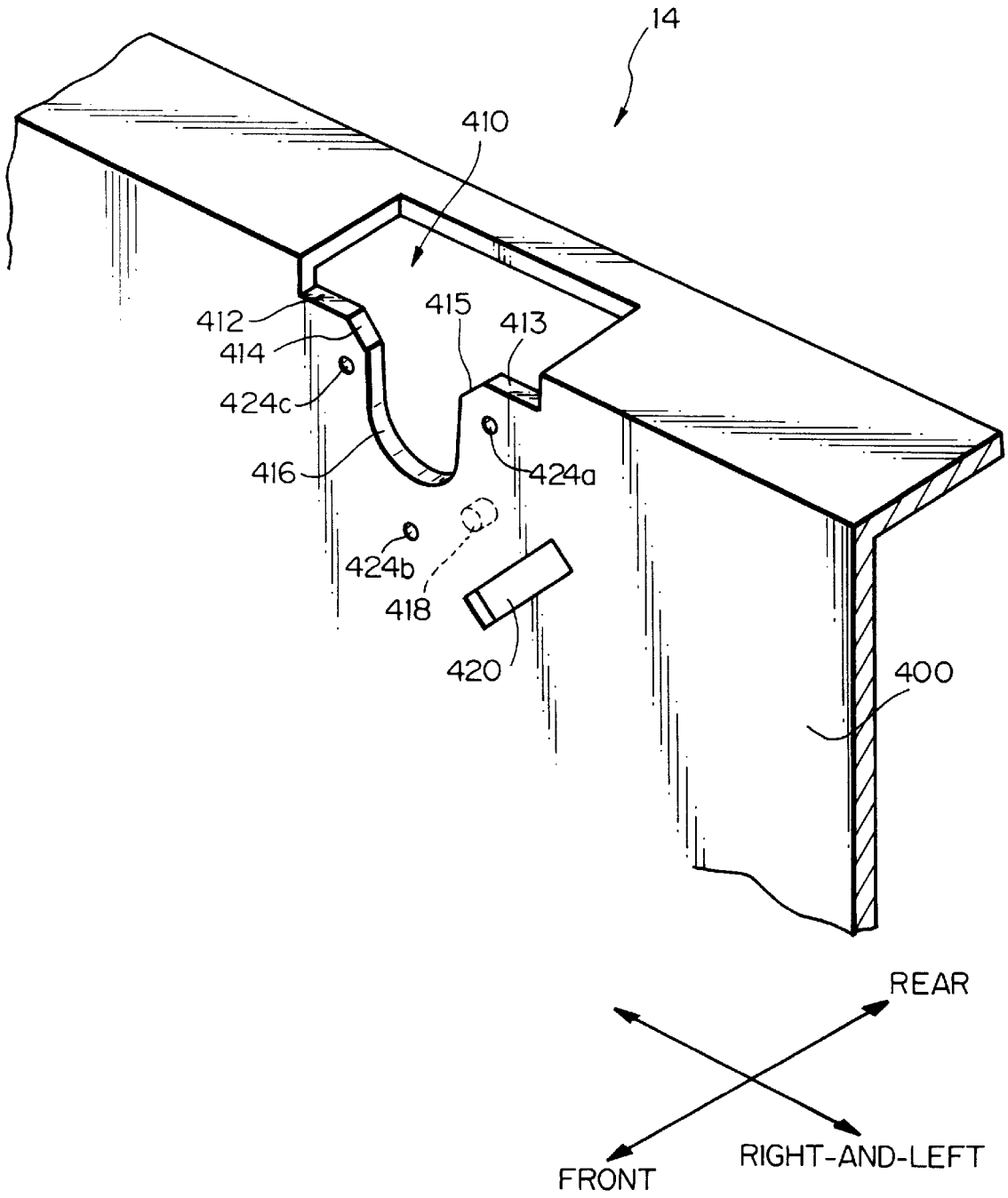
FIG. 10 is a perspective view showing the rear side wall.

The configuration of the rear side wall 400 will be described with reference to FIG. 10. As shown, the bent top of the side wall 400 where the first image station 14 should be arranged is removed in a rectangular shape, as designated by the reference numeral 410. The perpendicular portion of the side wall 400 is also notched in a stepped configuration, as designated by the reference numerals 412 and 413. A U-shaped notch 416 is formed in the side wall 400 and capable of mating with the stepped portion 1112, FIG. 8.

The positioning pin 418 protrudes to the rear from the perpendicular portion of the side wall 400. A hole 420 is formed in the side wall 400 obliquely below the positioning pin 418, so that the writing device support portion 1120 can be passed through the hole 420 from the rear to the front. Holes 424*a*, 424*b* and 424*c* are formed in the side wall 400 around the notch 416 for mounting the mount member 1100 to the side wall 400. Slants 414 and 415 respectively connect the upper portions of the notch 416 and stepped portions 412 and 413.

As shown in FIG. 8, the stepped portion 1112 of the mount member 1100 is engaged with the U-shaped notch 416 of the side wall 400, thereby positioning the axis of the shaft support portion 1110. At this instant, the positioning pin 418 is received in the slot 1111 although not shown in FIG. 11. The slot 1111 receives the positioning pin 418 and thereby determines the position of the writing device support portion 1120 in the direction of rotation having the above axis at its center. In this condition, the holes 1113*a*–1113*c* and holes 424*a*–424*c* are aligned and used to affix the mount member 1100 to the side wall 400. In this condition, the support portion 1120 protrudes to the front of the side wall 400 through the hole 420. The slants 1114 and 1115 and slants 414 and 415 are respectively flush with each other.

[2]A-d Mounting of Worm Shaft to Common Mount Members

As shown in FIG. 4, the worm shaft 250 is mounted to the common mount members 1100 and 1100' affixed to the rear side wall 400. The worm shaft 250 is sequentially inserted into the holes 1540*a* and 1140*a* formed in the drive member support portions 1540 and 1140, respectively, with the worm 16W at the head. The leading end of the worm shaft 250 preceding the worm 16W is supported by the support portion 1140 via a bearing 253. A pulley 254 is mounted on a tapered portion 257 and fixed in place by a nut 256. The trailing end of the worm shaft 250 following the worm 26W is supported by the support portion 1540 via a bearing 252 and stopped by a stop member 255. In this condition, the worms 16W and 26W are positioned beneath the axes of the shaft support portions 1110 and 111', respectively.

[2]A-e Mounting of Drum Unit to Common Mount Members

Figure 11:
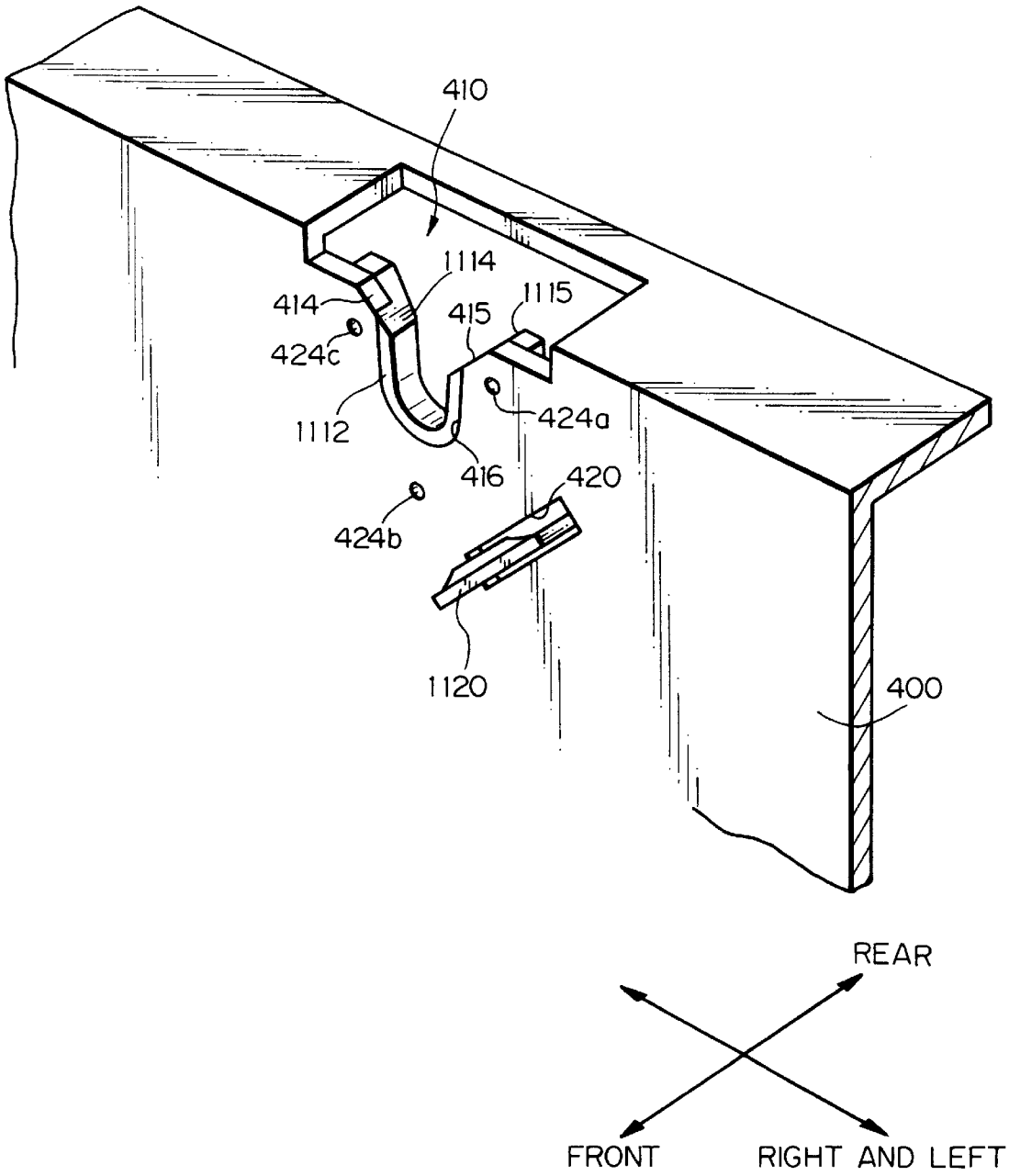
FIG. 11 is a perspective view showing the common mount member mounted to the rear side wall.

As shown in FIGS. 4, 7 and 11, at the first image station 14, the drum unit 140 is mounted with the outside diameter portion 67*b* of the bearing 67 engaging with the shaft support portion 910 of the mount member 900 and with the outside diameter portion 68*b* of the bearing 68 engaging with the shaft support portion 1110 of the mount member 1100. The axis of rotation of the drum 16 is aligned with the axes of the shaft support portions 910 and 1110.

While the drum unit 140 itself is rotatable about the axes of rotation of the drum 16, means, not shown, causes the drum unit 140 to engage with the first developing device 6 to thereby position the drum unit 140 in the direction of rotation. The shaft support portions 910 and 1110 are open at their upper ends. To prevent the bearings 67 and 68 from floating, wedge-shaped members, not shown, are respectively positioned between the outside diameter portion 67*b* and the side wall 300 and between the outside diameter portion 68*b* and the side wall 400.

The above wedge-shaped members are easily removable. Because the shaft support portions 910, 1110, 1310 and 1110' are U-shaped, the drum units 140 and 240 can be easily mounted and dismounted from the mount members 900, 1100, 1300 and 1100'. Further, by removing the bearings 65 and 66 from the case 64, it is possible to remove the drum from the drum unit 140 via the openings 54-1*a* end 64-1*b*.

At the second image station 24, the drum unit 240 is mounted to the mount members 1300 and 1100' in the same manner as at the first image station 14.

When the drum unit 140 is mounted to the mount members 900 and 1100, as stated above, the gear 72 is brought into mesh with the worm 16W. Likewise, when the drum unit 240 is mounted to the mount members 1300 and 1100', the gear 72' is brought into mesh with the worm 26W.

To cause the drums 16 and 26 to rotate in accurate synchronism with each other, the above rotary drive member using a worm shaft is preferable. In a driveline using a worm, a worm and a gear meshing, it should be positioned with high accuracy. In light of this, in the illustrative embodiment, the shaft support portion 1110 and drive member support portion 1140 are arranged on the mount member 1100 with preselected positional accuracy. This is also true with the shaft support portion 1110' and drive member support portion 1540 arranged on the mount member 1100'.

[2]A-f Mounting of Writing Unit to Common Mount Members

As shown in FIGS. 1, 7, and 11, at the first image station 14, the writing device 18 is removably mounted to the writing device support portion 920 protruding from the rear of the side wall 300 and the writing device support portion 1120 protruding from the front of the side wall 400. The following three different cases are available for mounting the writing device 18:

Case (1): The writing device 18 is mounted with the intermediary of space adjusting mechanism to adjust the space between the writing device 18 and the drum 16;

Case (2): The space adjusting mechanism is replaced with main scanning direction adjusting mechanism to adjust the position of the writing device 18 relative to the drum 16 in the main scanning direction, or line adjusting mechanism to adjust the inclination of the writing line of the writing device 18 on the drum 16 relative to the axis of rotation of the drum 16; and Case (3): Use is made of the above space adjusting mechanism, main scanning line adjusting mechanism, and line adjusting mechanism.

In any one of the case. (1)–(3), the writing devices 18 and 28 are mounted by using the writing device support portions 920, 1120, 1320 and 1120' included in the mount members 900, 1100, 1300 and 1110'.

The shaft support portions 910, 1110, 1310 and 1110' are included in the mount members 900, 1100, 1300 and 1100' and define reference positions for the drum units 140 and 240. Therefore, the drums 16 and 24 and writing devices 18 and 28 can be accurately positioned relative to each other and easily assembled. In addition, the writing devices 18 and 28 are removable from the mount members 900, 1100, 1300 and 1100', promoting easy maintenance and easy replacement of parts.

The above cases (1)–(3) will be described specifically hereinafter.

Figure 13A:
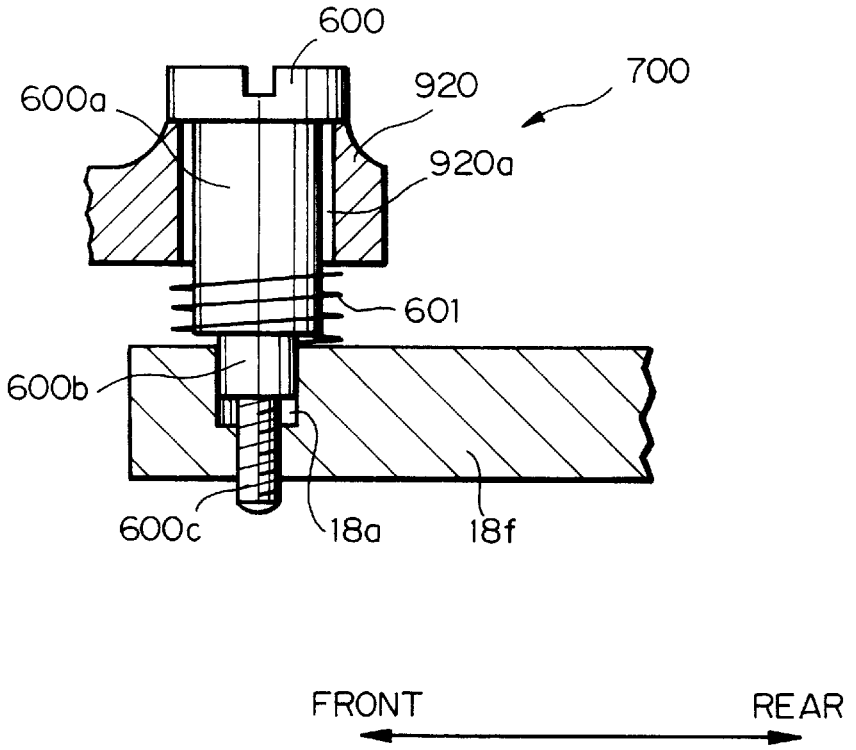
FIGS. 13A and 13B are sections each showing a particular configuration of space adjusting mechanism.

As shown in FIG. 13A, in the case (1), a stepped screw 600 has a larger diameter portion 600*a*, a smaller diameter portion 600*b*, and a threaded portion 600*c*. The larger diameter portion 600*a* is passed through a slot 920*a* formed in the writing device support portion 920 and elongate in the right-and-left direction, as viewed in FIG. 13A. After the smaller diameter portion 600*b* has been received in a hole 18*a* formed in the base 18*f* of the writing device 18, the threaded portion 600*c* is driven into a threaded hole formed in the bottom of the hole 18*a*. A spring 601 is preloaded between the base 18*f* and the underside of the support portion 920 and constantly biases the writing device 18 downward. Such space adjusting mechanism 700 is also provided between the other writing device support portion 1120 and the writing device 18. In this condition, a beam issuing from the writing device is directed toward the axis of rotation of the drum 16.

By turning the screw 600, it is possible to adjust the position of the writing device 18 relative to the support portion 920. This means that the focus of the beam to issue from the writing device 18 is adjustable. Further, when the writing device is implemented by LEDs or a semiconductor laser, the slot 920*a* serves to absorb displacements ascribable to thermal expansion and contraction and occurring in the right-and-left direction (main scanning direction) in FIG. 13A.

Figure 13B:
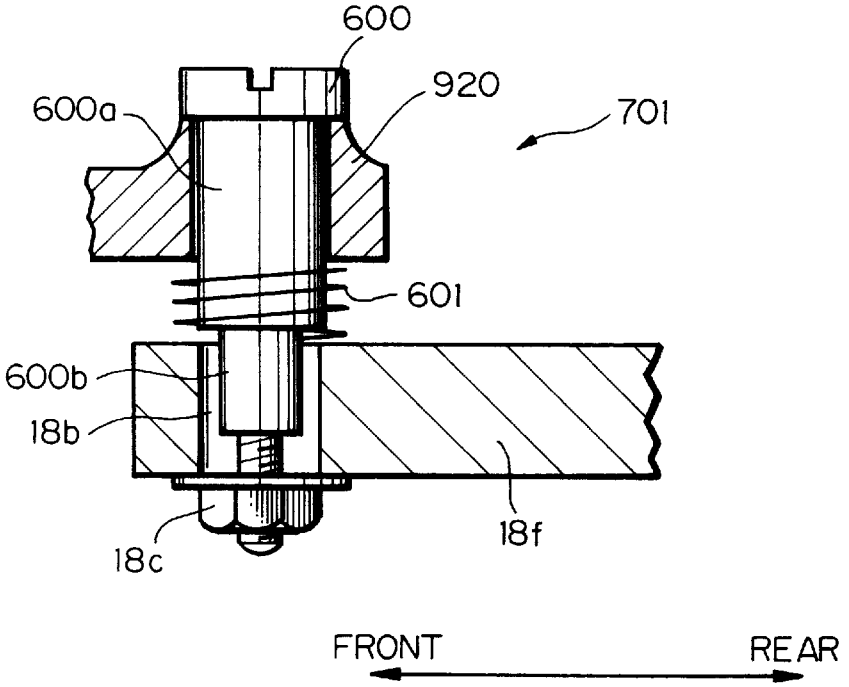

A mechanism to absorb the above displacements ascribable to heat may alternatively be provided on the base 18*f* of the writing device 18. FIG. 13B shows a specific arrangement of such a mechanism. As shown, a slot 18*b* capable of receiving the smaller diameter portion 600*b* is formed in the base 18. After the smaller diameter portion 600*b* has been passed through the slot 18*b*, the nut 18*c* is driven onto the threaded portion 600*c*. The space adjusting mechanism is generally designated by the reference numeral 701.

Figure 14:
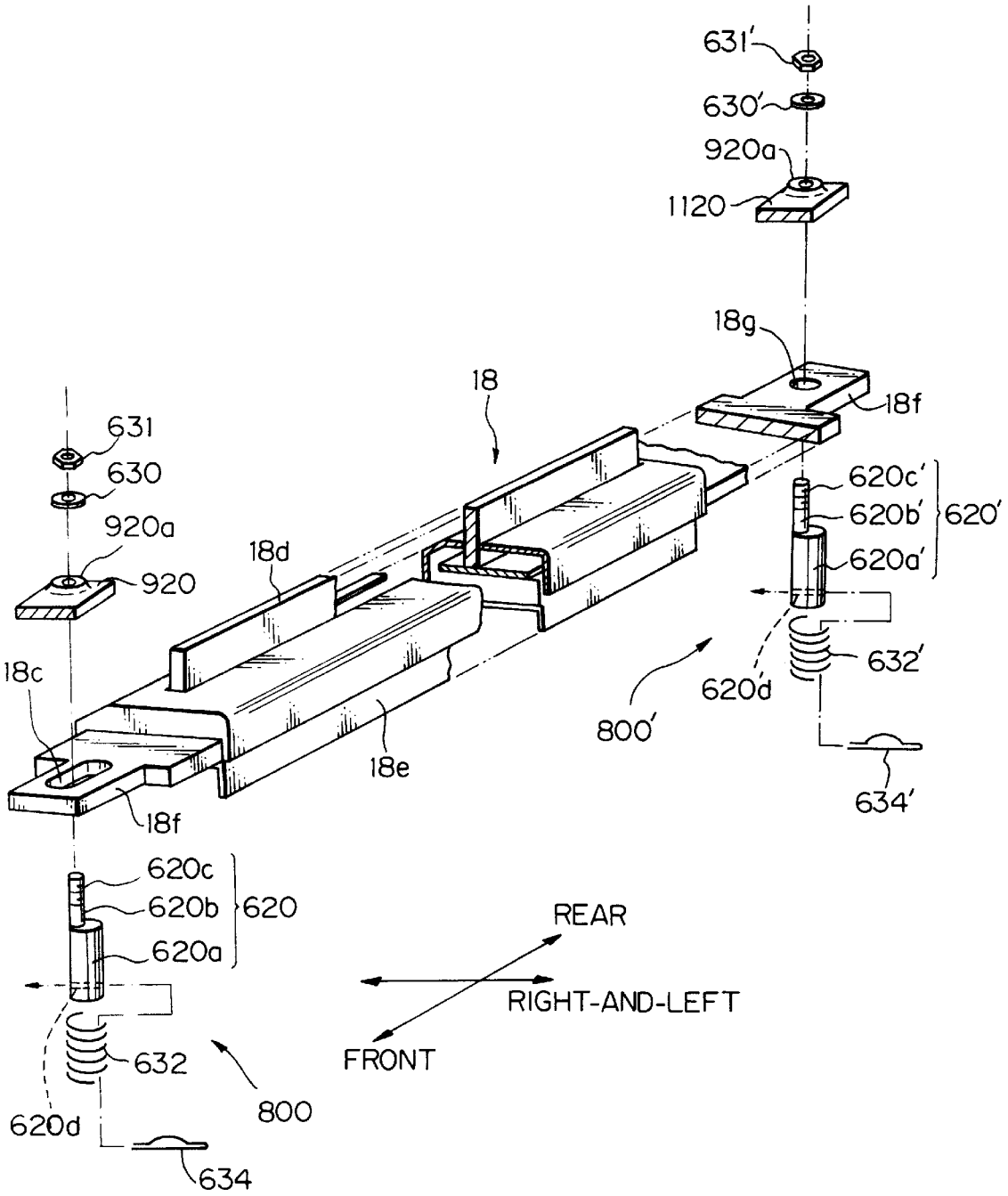
FIG. 14 is an exploded perspective view showing the adjusting mechanism.

In the case (2), if the position of the writing device 18 in the direction of focus can be implemented by the machining accuracy of parts, then the above space adjusting mechanism may be replaced with the previously mentioned main scanning line adjusting mechanism or line adjusting mechanism. The arrangement including the main scanning line adjusting function and line adjusting function will be simply referred to as adjusting mechanisms. In FIGS. 14 and 15, the front adjusting mechanism and rear adjusting mechanism are designated by the reference numerals 800' and 800, respectively.

As shown in FIGS. 14 and 15, the front adjusting mechanism 800 includes an eccentric pin 620 haying a larger diameter portion 620*a*, smaller diameter portion 620*b*, and a threaded portion 620*c*. The larger diameter portion 620*a* and smaller diameter portion 620*b* are eccentric relative to each other. A slot 18*c* is formed in the writing device 18 to play the same role an the slots 18*b* and 920*a*, FIGS. 13A and 13B. The slot 18*c* has a width capable of receiving the larger diameter portion 620*a*. A hole 920*a* is formed in the writing device support portion 920 in order to receive the smaller diameter portion 620*b*.

The rear adjusting mechanism 800' is identical in configuration with the front adjusting mechanism 800 except for the following. The slot 18*c* is replaced with a circular hole 18*g* for receiving the portion of the larger diameter portion 620*a* of the eccentric pin 620, so that the writing device 18 is adjustable in the main scanning direction. The structural elements of the rear adjusting mechanism 800' are distinguished from the structural elements of the front adjusting mechanism 800 by dashes.

At the time of assembly, the top of the base 18*f* is laid on the bottom of the writing device support portion 920. Then, a spring 632 is coupled over the larger diameter portion 620*a* of the eccentric pin 620. After a stop pin 634 has been passed through a hole 620*d* formed in the larger diameter portion 620, the larger diameter portion 620*a* is inserted into the slot 18*c*. The smaller diameter portion 620*b* is received in the hole 920*a*. Finally, a nut 631 is driven onto the threaded portion 620*c* via a washer 630.

For adjustment in the main scanning direction, after the nuts 631 and 631' have been loosened, the pin 634' of the adjusting mechanism 800' is turned by hand. As a result, the larger diameter portion 620*a*' rotates together with the writing device 18 with the smaller diameter 620'*b* serving as a shaft. The writing device 18 is therefore moved in the main scanning direction. For adjustment in the subscanning direction, the front adjusting mechanism 800 is operated in the same manner.

By the above procedure, the writing device 18 is caused to rotate about the position where the eccentric pin 620' and circular hole 18*g* are engaged with each other. As a result, the inclination of the writing line of the writing device 18 is adjusted relative to the axis of rotation of the drum. In this manner, both the adjustment in the main scanning direction and the adjustment of the inclination of the line are achieved. In addition, the line is matched to the axis of rotation of the drum.

An adjusting mechanism similar to the adjusting mechanisms 800 and 800' are included in the second image station 24. With this configuration, it is possible to obviate a deviation in writing line and therefore in image (colors) between the first and second image stations 14 and 24. When the adjusting mechanism is provided in the first image station 14, the second image station 24 may not affect the mechanical adjustment of the writing device in the main scanning direction using the eccentric pin 620' and circular hole 18*g*. In such a case, the image station 24 will electrically control the timing for modulating the beam with the image signal. This successfully matches the write start positions of the first and second image station 14 and 24.

An error in the inclination of the writing line relative to the axis of rotation of the drum 16 translates into a change in the diameter of the beam on the drum 16 in the main scanning direction. So long as the error does not exceed an allowable range, adjustment in the individual image station is not necessary. However, parallelism between the writing lines of the two image stations must be adjusted and can be adjusted by the above adjusting mechanism.

For example, assume that the adjusting mechanism (corresponding to the adjusting mechanisms 800 and 800') is not provided in the second image station 24, and that the adjusting mechanisms 800 and 800' are provided in the first image station 14. Then, the adjusting mechanisms 800 and 800' are operated on the basis of the result of writing affected at the second image station 24, i.e., such that the writing line at the first image station 14 is parallel to the writing line at the second image station 14. Alternatively, an adjusting mechanism corresponding to the adjusting mechanisms 800 and 800' may be provided only in the second image station 24, in which case the writing device 18 at the first image station 14 will be affixed to the support portions 920 and 1120.

Of course, the mechanism for absorbing displacements ascribable to heat is not necessary when the writing device is of the kind not generating heat causative of such displacements. In the illustrative embodiment, use is made of LEDs (not shown) and a converging light transmitting body. A fin 18*e* for heat radiation is formed on the bottom of the writing device 18.

Figure 16A:
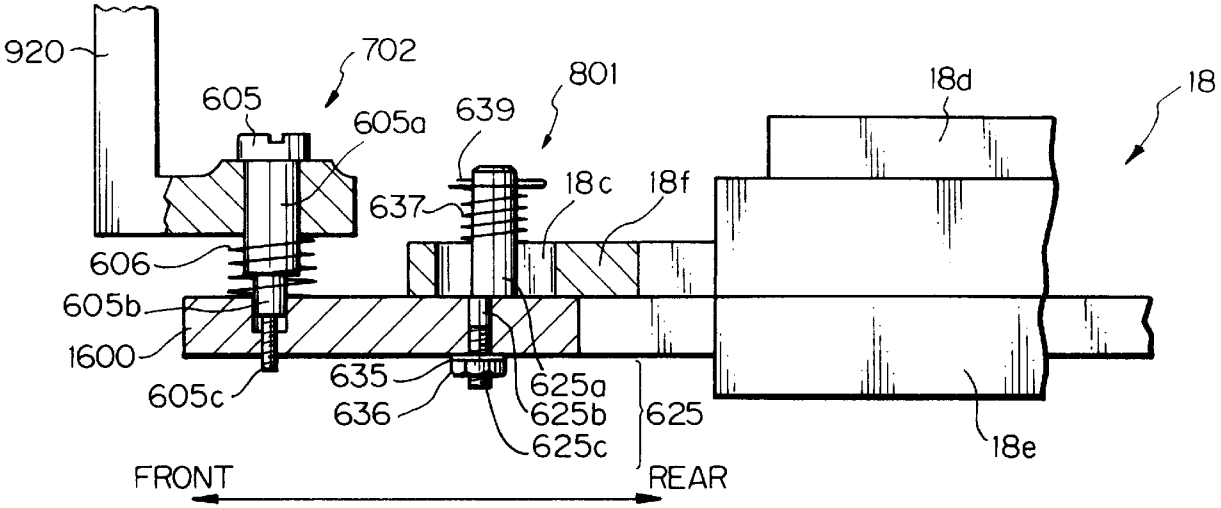
FIG. 16A is a partly sectional front view showing another specific configuration of the adjusting mechanism.
Figure 16B:
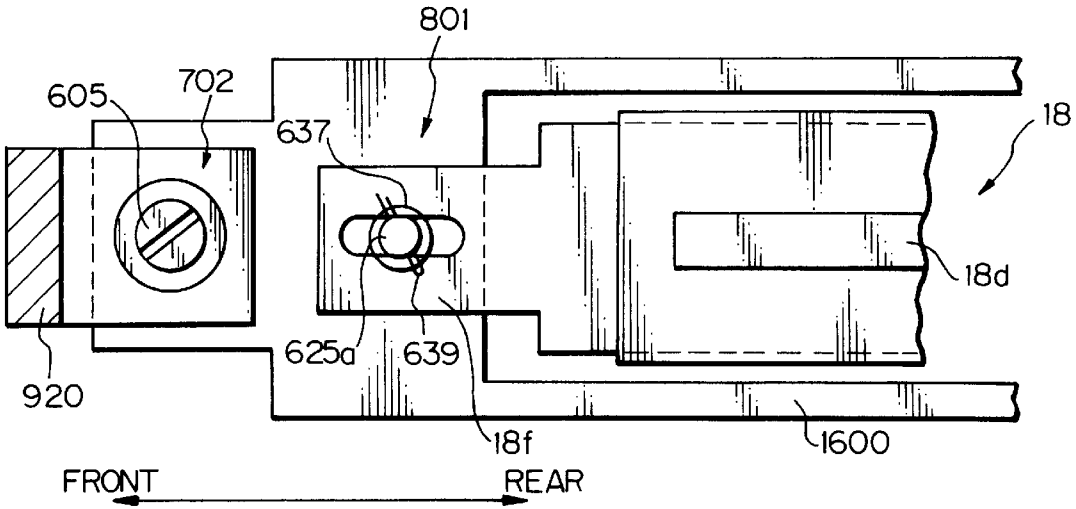
FIG. 16B is a plan view of the configuration of FIG. 16A.

In the case (3), all of the space adjusting mechanisms, main scanning direction adjusting mechanisms and line adjusting mechanisms, are used. FIGS. 16A and 16*b* show the three adjusting mechanisms associated with the front writing device support portion 920. The arrangement of FIGS. 16A and 16B is also associated with the rear writing device support portion 1120 except that the slot 18*c* is replaced with the circular hole formed in the larger diameter portion 625*a*. In FIGS. 16A and 16B, the writing device 18 is arranged on an intermediate support member 1600 bridging the front and rear support portions 920 and 1120.

As shown in FIGS. 16A and 16B, space adjusting mechanism 702 having the configuration shown in FIG. 13 intervenes between the support portion 920 and the intermediate support member 1600. Adjusting mechanism 801 having the configuration shown in FIGS. 14 and 15 and having the main scanning line adjusting function and line adjusting function intervenes between the intermediate support member 1600 and the writing device 18.

The space adjusting mechanism 702 includes a stepped screw 605 having a larger diameter portion 605*a*, smaller diameter portion 605*b*, and a threaded portion 605*c*. After the larger diameter portion 605*a* has been passed through the support portion 920, the smaller diameter portion 605*b* is positioned in the larger diameter portion of a stepped hole formed in the intermediate support member 1600. Then, the threaded portion 605*c* is driven into the smaller diameter portion of the stepped hole. A compression spring 601 is preloaded between the support portion 920 and the intermediate support member 1600. By turning the stepped screw 605, it is possible to displace the intermediate support member 1800 and therefore to adjust the space between the writing device 18 and the drum. This allows a dot having a preselected diameter to be formed on the drum. The spring 601 insures the accurate adjusting operation.

The adjusting mechanism 801 includes an eccentric pin 625 having a larger diameter portion 625*a*, a smaller diameter portion 625*b*, and a threaded portion 625*c*. The larger diameter portion 625*a* and smaller diameter portion 625*b* are eccentric relative to each other. The larger diameter portion 624*a* passed through the slot 18*c* of the base 18*f* while the smaller diameter portion 625*b* is passed through the hole of the intermediate support member 1600A, and nut 636 is driven onto the threaded portion 625*c* via a washer 635. A compression spring 637 is coupled over the larger diameter portion 625*a*. A stop pin 639 is used to prevent the spring 637 from slipping out. For adjustment, the operator loosens the nut 636 and then turns the eccentric pin 625 by nipping the stop pin 639.

Figure 17:
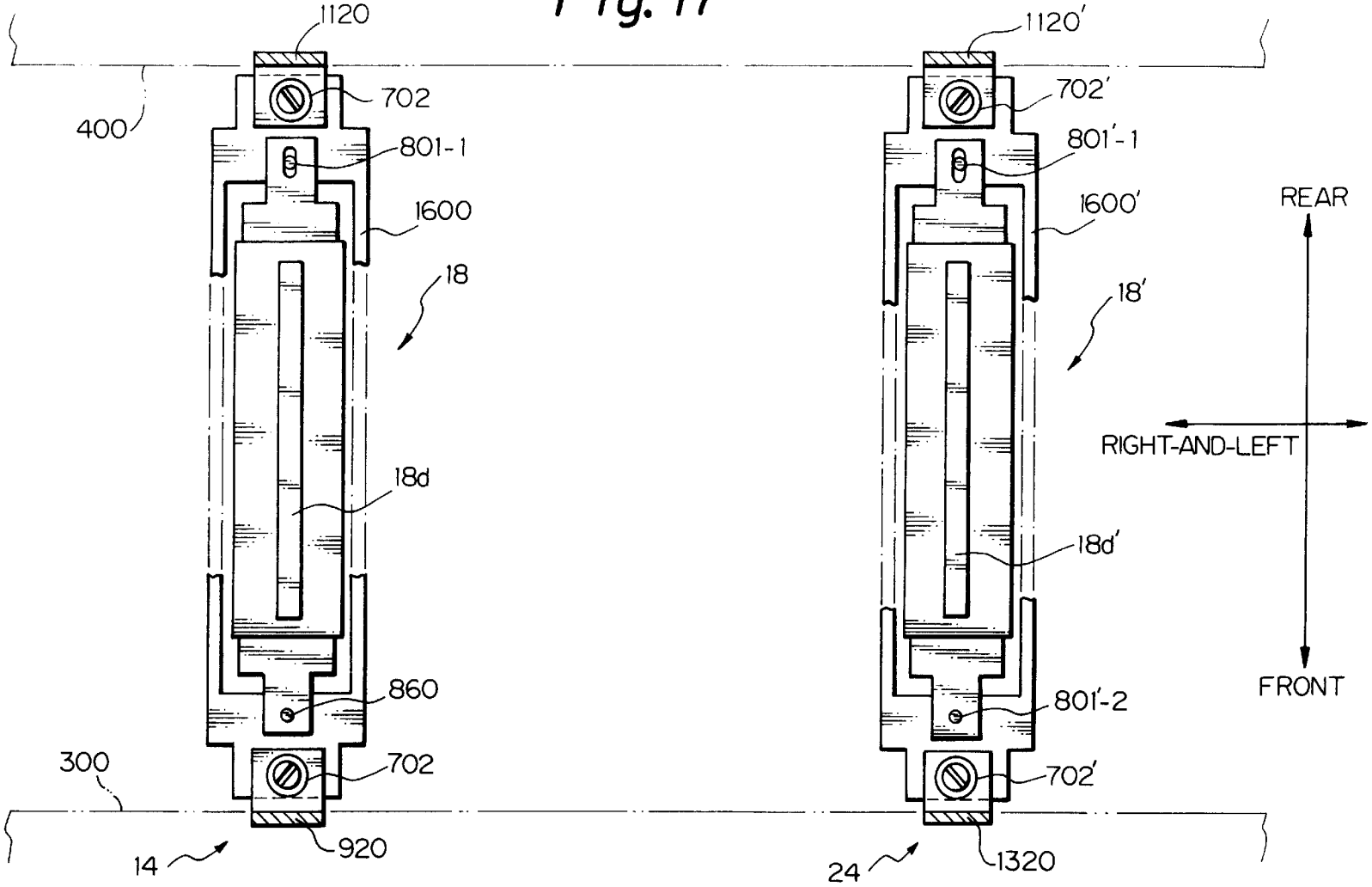
FIG. 17 demonstrates specific adjustment between image stations effected by the adjusting mechanism.

FIG. 17 shows how the two writing devices are respectively supported at the first and second image stations 14 and 24. As shown, at the first image station 14, the space adjusting mechanism 702 is provided between the intermediate support member 1600 and each of the writing device support portions 920 and 1120. This allows the distance between the writing device 18 and the drum 16 to be adjusted.

At the first image station 14, the writing device 18 is rotatably supported by the intermediate support member 1600 via a pin 860 at the front side. At the rear side, the writing device 18 is supported by adjusting mechanism 801-1 identical with the adjusting mechanism 801 via a slot which absorbs displacements ascribable to heat. An eccentric pin included in the adjusting mechanism 801-1 has eccentricity as great as about 0.1 mm to 0.2 mm. This allows the writing device 18 to rotate about the pin 860 such that the axis of rotation of the drum 16 and the line of the light transmitting body 18*d* become parallel to each other.

At the second image station 24, space adjusting mechanism 702' identical with the space adjusting mechanism 702 is arranged between an intermediate support member 1600' and each of writing device support portions 1320 and 1120'. At the front side, the writing device 28 is supported by the intermediate support member 1600' via an eccentric pin and a circular hole corresponding to the eccentric pin 620' and circular hole 18*g* of the adjusting mechanism 800'. At the rear side, adjusting mechanism 801'-1 identical with the adjusting mechanism 801 is arranged. At the front side, adjusting mechanism 801'-2 including an eccentric pin and a circular hole corresponding to the eccentric pin 620' and circular hole 18*g* of the adjusting mechanism 800' is arranged. With this configuration, it is possible to adjust the writing device 28 in the main scanning direction, subscanning direction, and direction of focus.

The eccentric pin of the adjusting mechanism 801'-1 has eccentricity as great as about 0.1 mm to 0.2 mm like the eccentric pin of the adjusting mechanism 801-1. The adjusting mechanism 801'-1 allows the parallelism between the writing lines of the first and second image stations 14 and 24 to be adjusted.

On the other hand, the adjusting mechanism 801'-2 is used to adjust the writing position of the writing device 18 in the main scanning direction in relation to the writing position of the writing device of the first image station 14. The amount of this adjustment does not have to exceed one half of the distance between nearby pixels (dot pitch); only if a phase between the pitches is eliminated, then adjustment can be affected by adjusting the timing for the application of the image signal. The eccentricity of the eccentric pin may be small. Should the eccentricity be great, an inclination would occur in the subscanning direction. In light of this, the eccentric pin of the adjusting mechanism 801'-2 is provided with eccentricity as small as about 0.05 mm.

If the mechanical machining accuracy can implement the accurate distance between the writing devices 18 and 28 and the drums 16 and 26, then the adjusting mechanisms 702 and 702' and intermediate support members 1600 and 1600' are not necessary. In such a case, the writing devices 18 and 28 will be directly supported by the writing device support portions 920, 1120, 1320 and 1120'.

[2]A-g Other Examples of Image Carrier and Image Station (1) In the above embodiment, the writing device 18 is implemented as light a emitting device. When the image carrier is implemented as a drum-like medium capable of forming a latent image either electrically or magnetically, the writing device 18 will be replaced with a writing device to form a latent image based on electric or magnetic variation. The photoconductive drum may be replaced with a photoconductive belt.

(2) While the above description has concentrated on two image stations, the common mount members shown and described are applicable even to an image forming apparatus including a single image station or three or more images stations. In such a case, one of the common support members provided in a pair in the axial direction of the drum (e.g. rear support member) may be provided with the drive member support portion (corresponding to the support portion 1140 or 1150) at all of the image stations. If desired, neither one of the common support members may be provided with the drive member support portion, in which case the drum will be driven by suitable method.

(3) In the above configuration (2), when the apparatus includes three or more image stations, image stations including the drive member support portions and image stations not including them may be combined.

(4) When three or more image stations are available, all of them or all of them except for one may be selectively provided with the adjusting mechanism assigned to the inclination of the writing line on the drum and the adjusting mechanism 800, 800', 801, 801-1, 801-1' and 801-2'. If such mechanisms are arranged at the front side and rear side facing each other, then it is possible not only to match the inclination of the writing line to the axis of the drum but also to match the line to the axis of the drum.

Assume that the positional deviation from the axis of the drum does not have to be adjusted because, e.g., mechanical machining accuracy is sufficient. Then, after the adjustment for matching the writing line to the axis of the drum has been affected at a reference image station by using the front and rear adjusting mechanisms, the inclination of the writing line should only be affected at each of the other image stations such that the writing line becomes, parallel to the writing line of the reference station. It therefore suffices to adjust either one of the front and rear adjusting mechanisms.

If it is desired to set up parallelism between the axes of the drums of all of the image stations, then extra measures are needed. In practice, however, mechanical machining accuracy suffices, and makes the above extra measures needless.

It is to be noted that the above modifications may be combined in any suitable way.

[2]A-h Developing Unit

In the specific configurations shown and described, the drum unit 140 is mounted to the common mount members 900 and 1100 mounted on the side walls 300 and 400, respectively. The writing device 18 is supported by the support portions 920 and 1120 included in the mount members 900 and 1100, respectively. Consequently, the positional relation between the drum unit 140 and the writing device 18 is determined via the mount members 900 and 1100. How the other drum unit 240 is mounted to the common mount members 1300 and 1100' will not be described specifically in order to avoid redundancy.

In a specific construction to be described hereinafter, the drum units and associated developing devices can be assembled together. By mounting the drum units by use of the common mount members and mounting the developing devices to the drum units, it is possible to accurately position the developing devices and writing devices. In the specific construction, the first developing device 6 associated with the drum 16 and mounted on a unit case will be referred to as a developing unit. A holding mechanism is provided on one end of the developing unit for removably holding and positioning the outside diameter portion 67*b* of the bearing 67 which supports the drum 16. A stationary locking portion engageable with the side wall 300 or 400 is provided on the other end of the developing unit.

Figure 25:
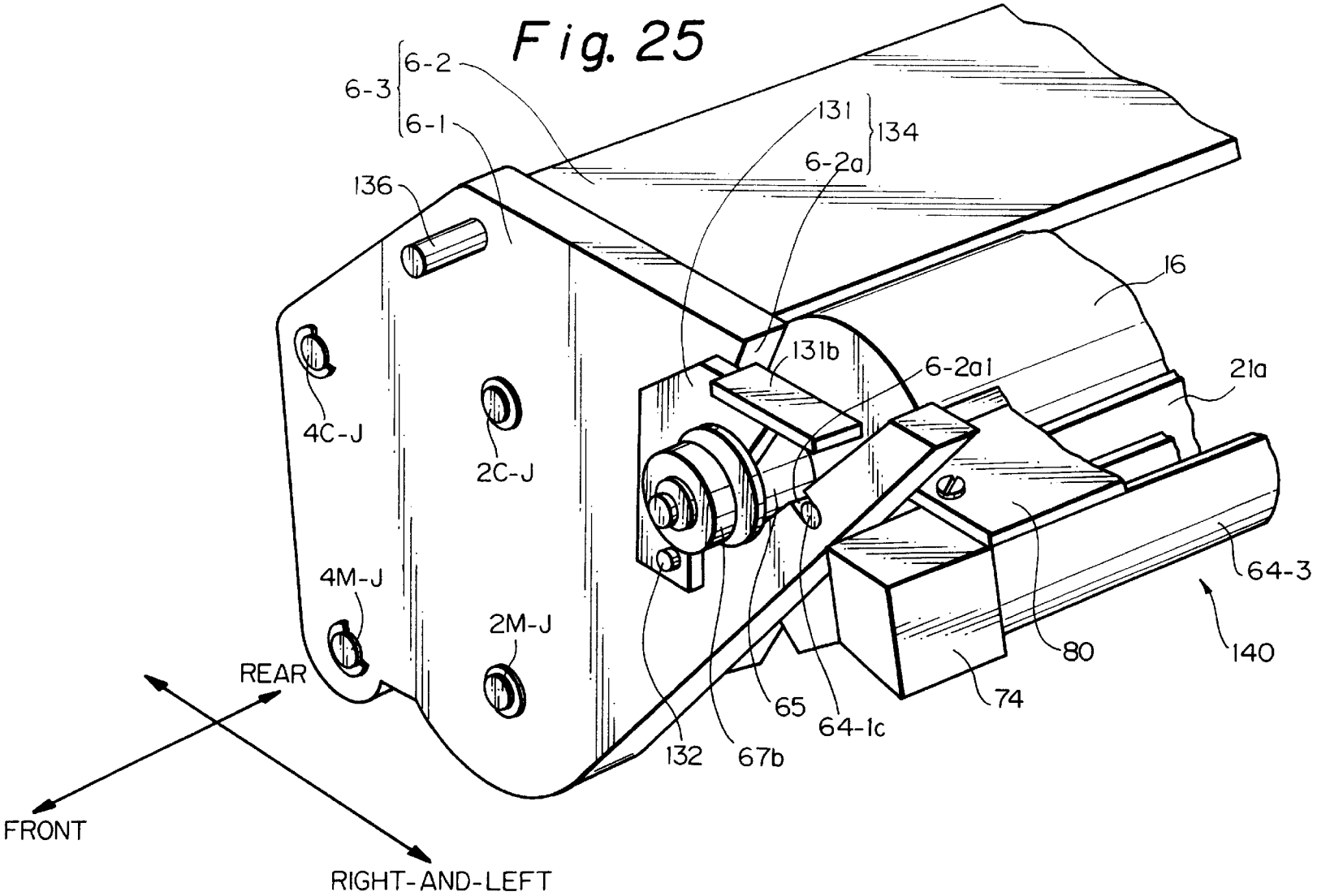
FIG. 25 is a perspective view showing a composite unit consisting of a developing unit and a drum unit.
Figure 26:
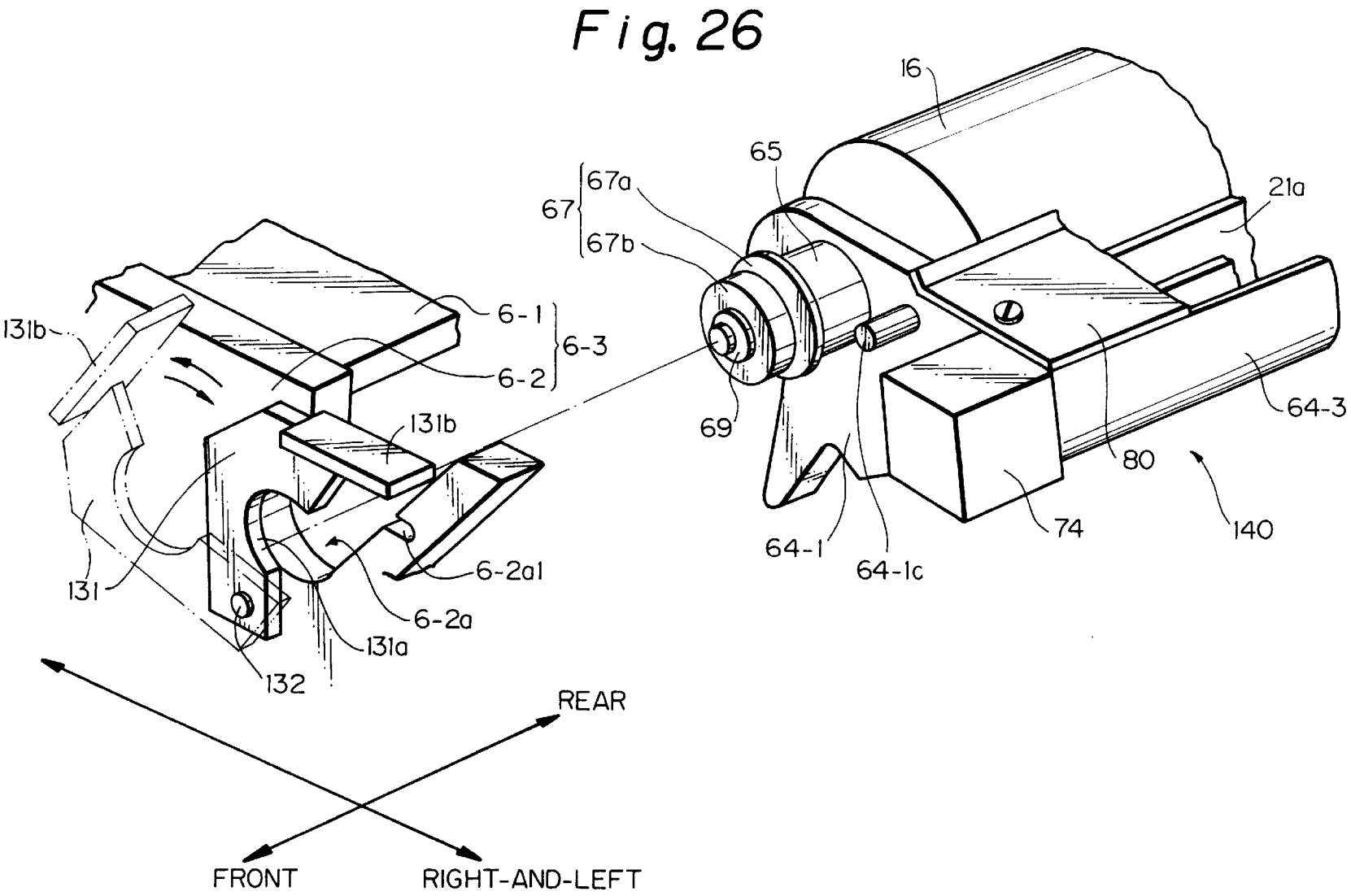
FIG. 26 is an exploded perspective view of the composite unit.

Specifically, as shown in FIG. 25, the first developing unit 6 shown in FIGS. 21 and 22 as well as in other drawings is accommodated in unit cases 6-1 and 6-2, constituting a developing unit 6-3. Labeled 2C-J and 2M-j in FIG. 25 are respectively the shaft portions of the paddles 2C and 2M shown in FIGS. 21 and 22, while labeled 4C-J and 4M-J are the shaft portions of the screws 4C and 4M, respectively. A unit case, not shown, identical in size with the unit case 6-2 faces the unit case 6-2. FIG. 25 shows the drum unit 140 mounted to the developing unit 6-3. FIG. 26 shows the drum unit 140 dismounted from the developing unit 6-3.

As shown in FIG. 26, the unit case 6-2 is formed with a generally U-shaped opening 6-2*a* at one end in the right-and-left direction. The opening 6-2*a* is obliquely open at its upper end. The opening 6-2*a* has a bottom portion sized to receive the outside diameter portion 67*b* of the bearing 67 and is sequentially flared upward in order to facilitate the mounting and dismounting of the bearing 67.

When the outside diameter portion 67*a* simply rests on the bottom of the opening 6-2*a*, the positional relation between the developing rollers 32 and 33 and the cleaning blade 21*a* and charger 17 on the periphery of the drum 16 is not determined although the distances between the axis of the drum 16 and the axes of the rollers 32 and 33 may be determined. In light of this, as shown in FIG. 26, a pin 64-1*c* is studded on the shaft support portion 64-1. In addition, a recess or detent mechanism 6-2*a*1 is formed in the inclined edge of the opening 62*a* such that when the outside diameter portion 67*b* of the bearing 67 rests on the bottom of the opening 6-2*a*, the recess 6-2*a*1 receives the pin 64-1*c*.

Figure 27:
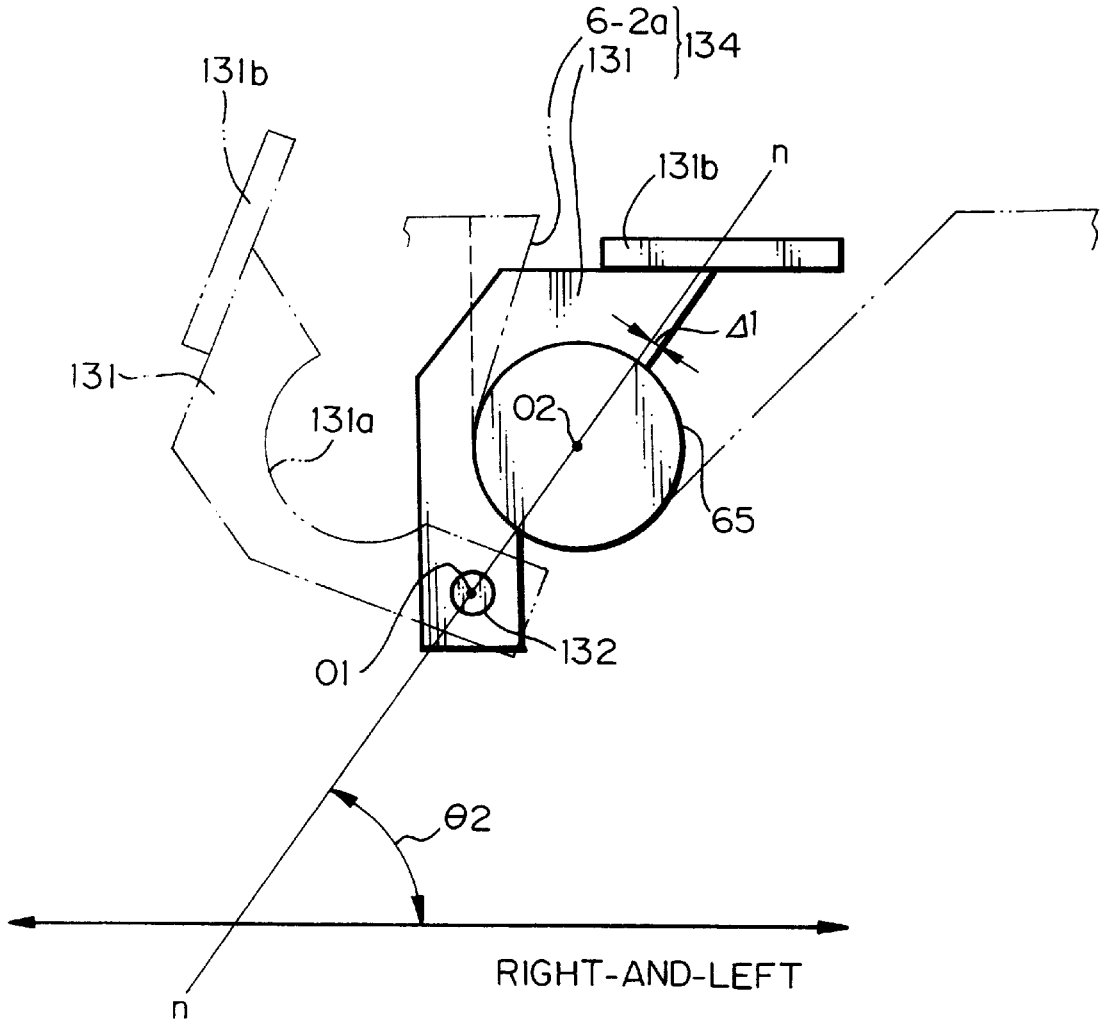
FIG. 27 shows a configuration in which a lever holds a bearing.

A lever or pressing mechanism 131 is pivotally mounted on one side of the unit case 6-2 in order to press the outside diameter portion 67*b* of the bearing 67 received in the opening 6-2*a* downward against the bottom of the opening 6-2*a*, thereby retaining the portion 67*b* in the opening 6-2*a*. As shown in FIG. 27, the lever 131 is formed with a semicircular recess or locking portion 131*a* engageable with the outside diameter portion or engaging portion 67*b*. The operator puts the outside portion 67*b* of the bearing 67 in the opening 6-2*a* while putting the pin 64-1*c* in the recess 6-2*a*1, and then turns the lever 131 from an open position indicated by a dash-and-dots line in FIG. 27 to a closed or fixing position indicated by a solid line in FIG. 27 by holding a grip 131*b*. As a result, the recess 131*a* is engaged with the outside diameter portion 67*a*.

In the above condition, the recess 131*a* covers at least the top left half of the periphery of the outside diameter portion 67*b* with respect to a line n—n connecting the center 0 of a shaft 132 and the center 0 of the outside diameter portion 67*b*. More specifically, the lower corner of the recess 131*a* is positioned on the line n—n. The upper corner of the recess 131*a* elastically deforms aver the line n—n by a small dimension of Δ1, thereby firmly holding the bearing 67. That is, when the lever 131 is moved toward the solid-line position, it is slightly elastically deformed and firmly presses the outside diameter portion 67*b* toward the line n—n in a click fashion. To release the bearing 65, the operator opens the lever 131 to the dash-and-dots line position so as to uncover the upper periphery of the outside diameter portion 67*b*. In this condition, the operator can pull the drum unit 140 in the direction of the opening 6-2*a* by gripping the unit 140.

Figure 28:
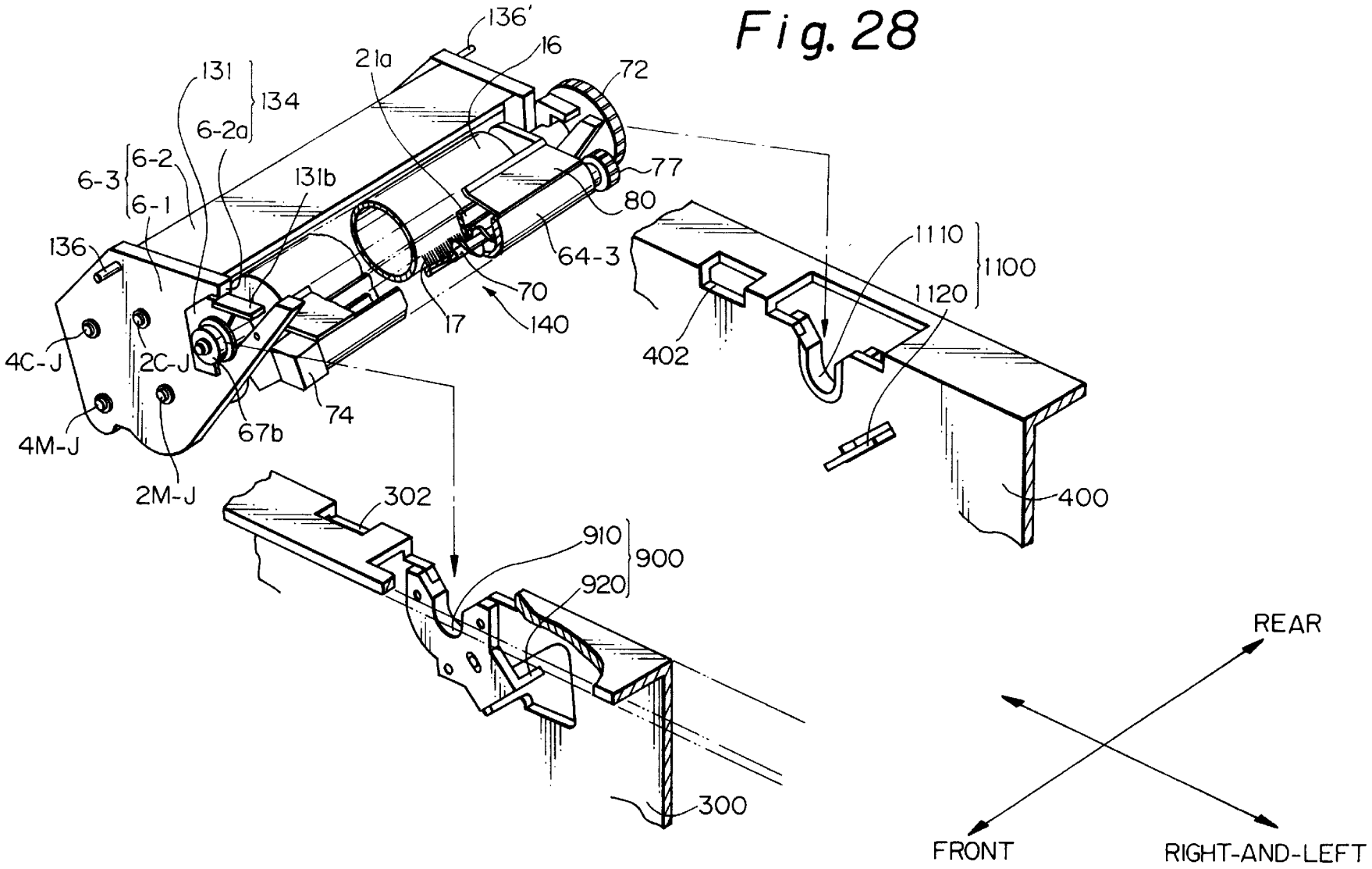
FIGS. 28 and 29 show how the composite unit is counted to the side walls with the drum unit serving as a reference.

As shown in FIGS. 25 and 28, a pin 136 is studded on the other end of the unit case 62 in the right-and-left direction opposite to the side where the holding means 134 is positioned. The pin 136 is received in a notch 302 formed in the side wall 300 and plays the role of a locking member. A pin 136' identical with the pin 136 is studded on the rear end of the unit case 6-2, as shown in FIG. 28.

A procedure for mounting the combination of the developing unit 6-3 and drum unit 140 to the side walls 300 and 400 by use of the holding mechanism 134 will be described with reference to FIG. 28. At the front side, the outside diameter portion 67*b* of the bearing 67 protrudes from the front of the unit case 6-1. The outside diameter portion 67*b* is positioned in the shaft support portion 910 of the common mount member 900. Likewise, at the rear side, the outside diameter portion 68*b* of the bearing 68 is positioned in the shaft support portion 1110 of the common mount member 1100. As for the left side of the above combined unit, the pins 136 and 136' are respectively received in the notches 302 and 402 by gravity. As a result, the combined unit is mounted to the side walls 300 and 400.

Figure 29:
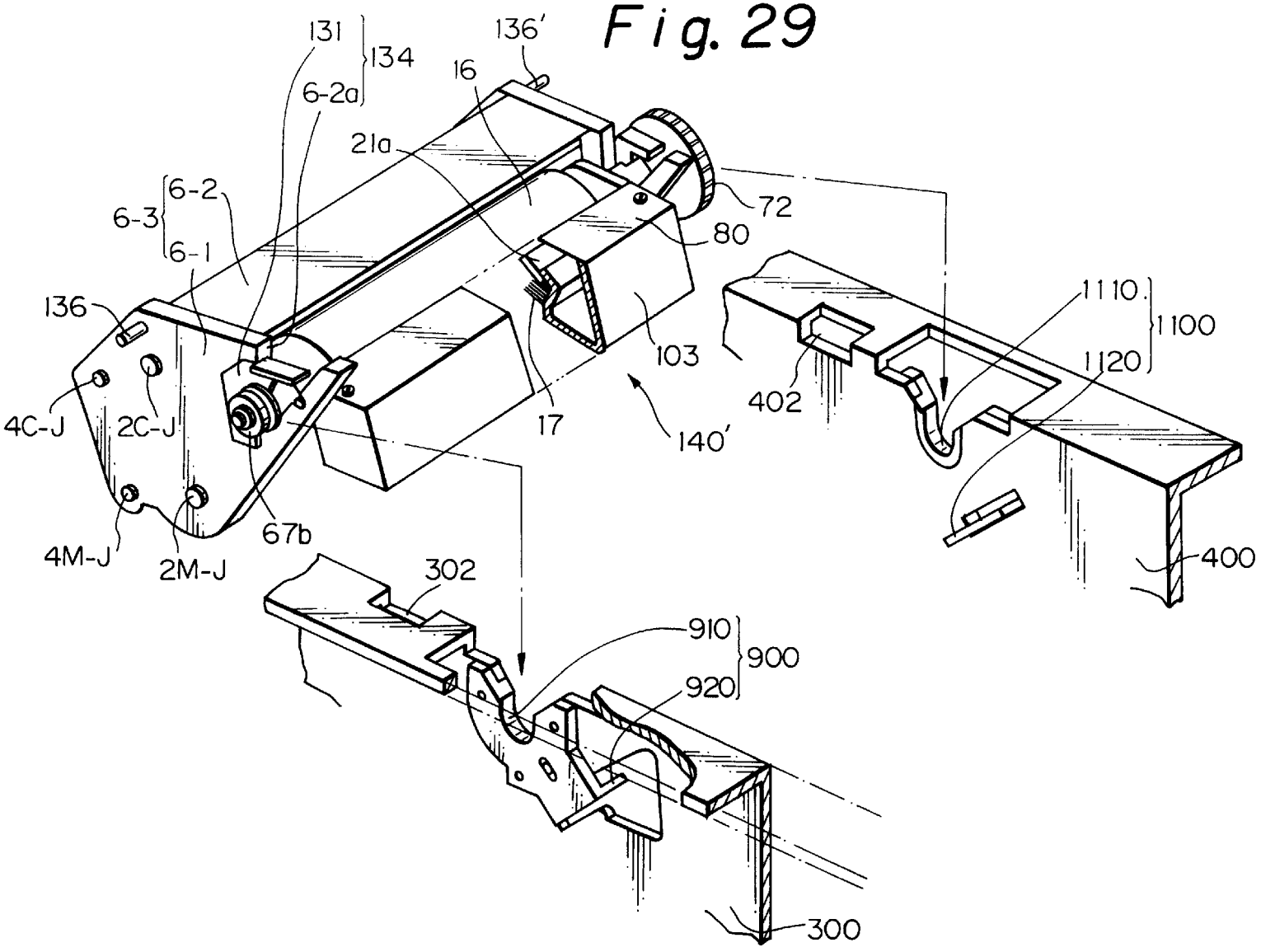

The cleaning device included in the drum unit 140 at FIG. 28 and using the box 103 in place of the auger 70 and outlet portion 74 has been described with reference to FIG. 23. As shown in FIG. 29, a drum unit 140' including this type of cleaning device may be combined with the developing unit 6-3 shown in FIGS. 25 and 26 and mounted to the side walls 300 and 400 via the mount members 900 and 1100 in exactly the same manner as in FIG. 28. As shown in FIG. 29, the drum unit 140' has the box 103 in place of the auger 70 and does not need the gears 71 and 77 shown in FIG. 28.

In each of the configurations shown in FIGS. 28 and 29, the larger diameter portion 67*b* of the bearing 67 is received in the opening 6-2*a* at the right side. At the left side, the pin 136 is received in the notch 302.

To stabilize the outside diameter portion 68*b* received in the shaft support portion 1110, the outside diameter portion 68*b* is pressed downward. For example, a slide member slidable in the right-and-left direction is mounted on the side wall 300 and slid to press the outside diameter portion 68*b*. This is also true with the side wall 400. To release the outside diameter portion 68*b*, the slide member is slid in the other direction. The slide member may have a configuration to be described later with reference to FIG. 50.

As shown in FIG. 12, at the left side, the gear 72 is caused to rotate by the worm 16W and, in turn, causes the drum to rotate clockwise. As a result, a moment tending to raise the pin 136 about the holding means 134 acts on the pin 136. However, this moment is negligible, compared to the weight of the combined unit, and does not raise the pin 136.

Figure 30:
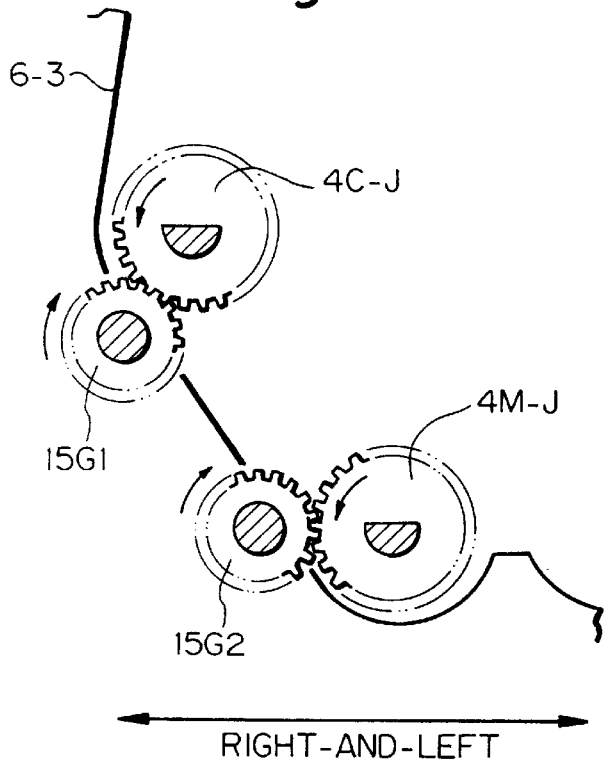
FIG. 30 shows a driveline for driving a screw for conveyance.

In addition as shown in FIG. 30, the gears 4C-J and 4M-J are mounted on the developing unit 6-3 coaxially with the developing rollers 4C and 4M, respectively. Drive gears 15G1 and 15G2 connected to a drive source are capable of meshing with the gears 4C-J and 4M-J, respectively, in the condition shown in FIG. 30. The gears 15G1 and 4C-J mesh with each other at a bottom left position, and each rotates in a particular direction indicated by an arrow. As a result, a moment tending to press the pin 136 against the edge of the notch 302 acts on the pin 136. Likewise, as for the gears 15G2 and 4M-J, a moment tending to press the pin 136 against the edge of the notch 302 acts on the pin 136. This prevents the pin 136 from rising above the notch 302. It is therefore needless to provide an extra member for pressing the slide member.

The writing device 18 and the drum unit 140 with the developing unit 603 are mounted to the same common mount members 300 and 400. Therefore, the writing device 18, developing unit 6-3 and drum unit 140 are held in a preselected position via the common mount members.

Further, when the lever 131 is opened away from the outside diameter portion 67*b*, the combined assembly of the drum unit 140 and developing unit 6-3 can be mounted and dismounted from the common mount members 900 and 1100 affixed to the side walls 300 and 400, respectively. If desired, only the developing unit 140 may be mounted and dismounted from the mount members 900 and 1100 while leaving the developing unit 6-3 on the side walls 300 and 400.

Assume that the assembly of the drum unit 140 and developing unit 6-3 is mounted to or dismounted from the mount members 900 and 1100 affixed to the side walls 300 and 400, respectively. Then, because the upper casing part 106 is openable by the angle θ1 of about 70°, as stated with reference to FIG. 24, the assembly is apt to interfere with the belt unit 100 mounted on the casing part 106. The belt 10 is exposed to the outside on the underside of the belt unit 100.

Figure 33:
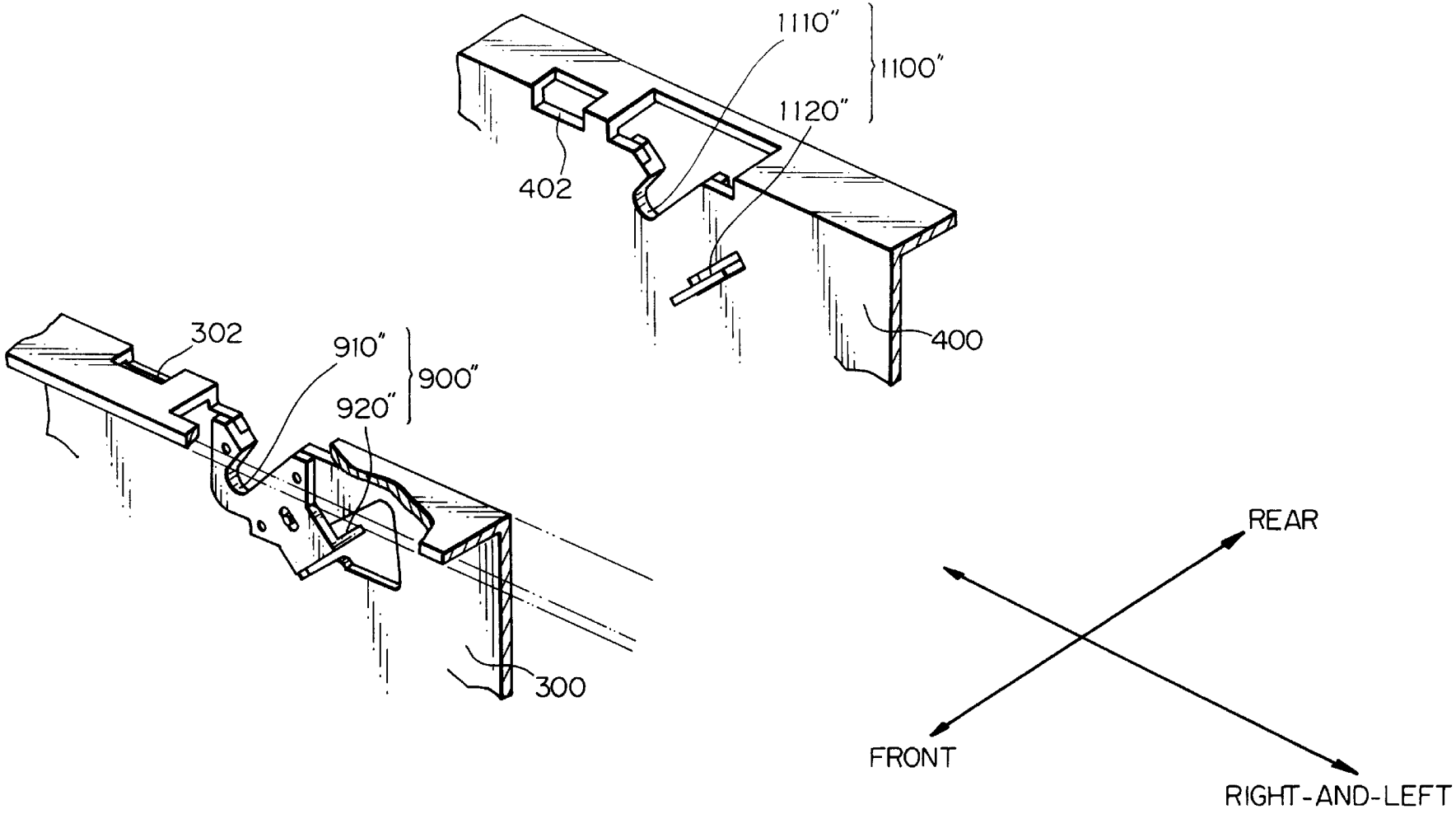
FIG. 33 is a perspective view showing an inclined opening formed in the common mount member.

In light of the above, as shown in FIG. 27, the opening 6-*a*2 is inclined by substantially the same angle as the upper casing part 106. This prevents the drum 16 or the drum unit 140 to be mounted and dismounted from the developing unit 6-*a*2 from interfering with the belt 10. As shown in FIG. 33, when the opening 6-2*a* is so inclined, use is made of shaft support portions 910" and 1110" included in common mount members 900" and 1110", respectively, and inclined in the same direction as the opening 6-2*a*. Also, writing device support portions 920" and 1120" are configured in matching relation to the shaft support portions 910" and 1110", respectively.

When the shaft support portion 910 extends in the perpendicular direction, the opening 6-*a*2 is configured such that one edge at the opening 6-*a*2 extends perpendicularly on the common mount member, as indicated by a broken line in FIG. 27. In this case, the drum unit 140 is lifted perpendicularly upward and must be prevented from interfering with the belt 10.

Figure 31:
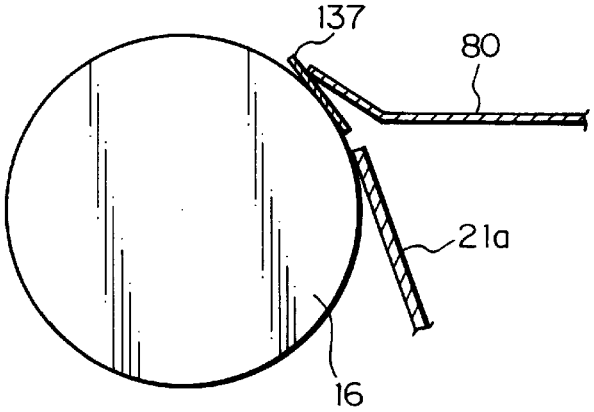
FIG. 31 shows a seal structure included in the cleaning device for preventing toner from leaking.

When the drum unit 140 is removed from the side walls 300 and 400 and then put on a flat surface by accident, the unit 140 in apt to bodily tilt and cause toner to flow out of the bridge portion 64-3 and box 103. To obviate this occurrence, as shown in FIG. 31, a thin seal cover 137 formed of synthetic resin is affixed to the shaft support portions 64-1 and 64-2 and held in contact with the leading edge of the cover 80 and the periphery of the drum 16.

Figure 32:
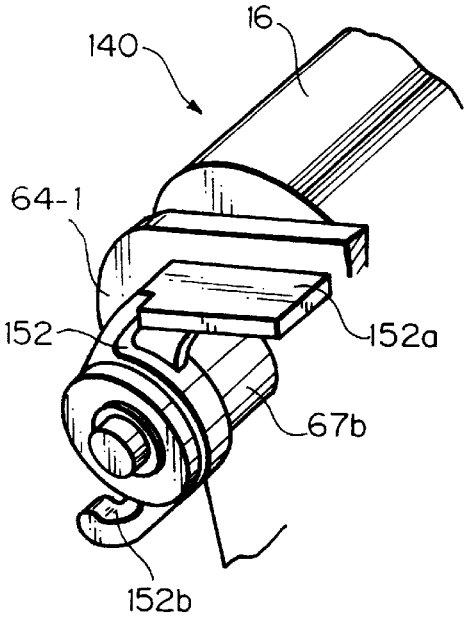
FIG. 32 shows a specific configuration in which a lever is provided on the image carrier side.

In FIGS. 25–29, the lever 131 is provided on the developing unit 6-3 to play the role of a pressing mechanism. Alternatively, as shown in FIG. 32, a lever 152 may be included in the drum unit 140 and rotated integrally with the bearing 67 of the drum 16. The lever 152 has a grip 152*a* at one end and a locking recess 152*b* at the other end. In this case, the developing unit 6-3 (not needing the lever 131) is provided with a shaft portion engageable with the recess 152.

The lever 152 shown in FIG. 32 may not be used a mechanism for mounting the drum unit 140 to the developing unit, but may be used to mount it to the body of an image forming apparatus. This allows the drum unit 140 to be easily mounted to an image forming apparatus and thereby facilitates the maintenance and replacement of the drum unit 140. Also, a lever corresponding to the lever 152 may be mounted on the bearing portion of the drum 18 itself. This will facilitate the maintenance and replacement of the drum 16.

[3] Second Configuration of Common Mount Members

[3]B Common Mount Members with Directly Mounted Developing Unit

In FIGS. 25–29 and 30, so long as the drum unit 14 and developing unit 6-3 are mounted to or dismounted from the common mount members 900, 900", 1100 and 1100" in the form of an assembly, no problems arise. However, dismounting only the drum unit 140 while leaving the developing unit 6-3 on the mount members 900, 900", 1100 and 1100" is problematic, as follows.

Figure 34:
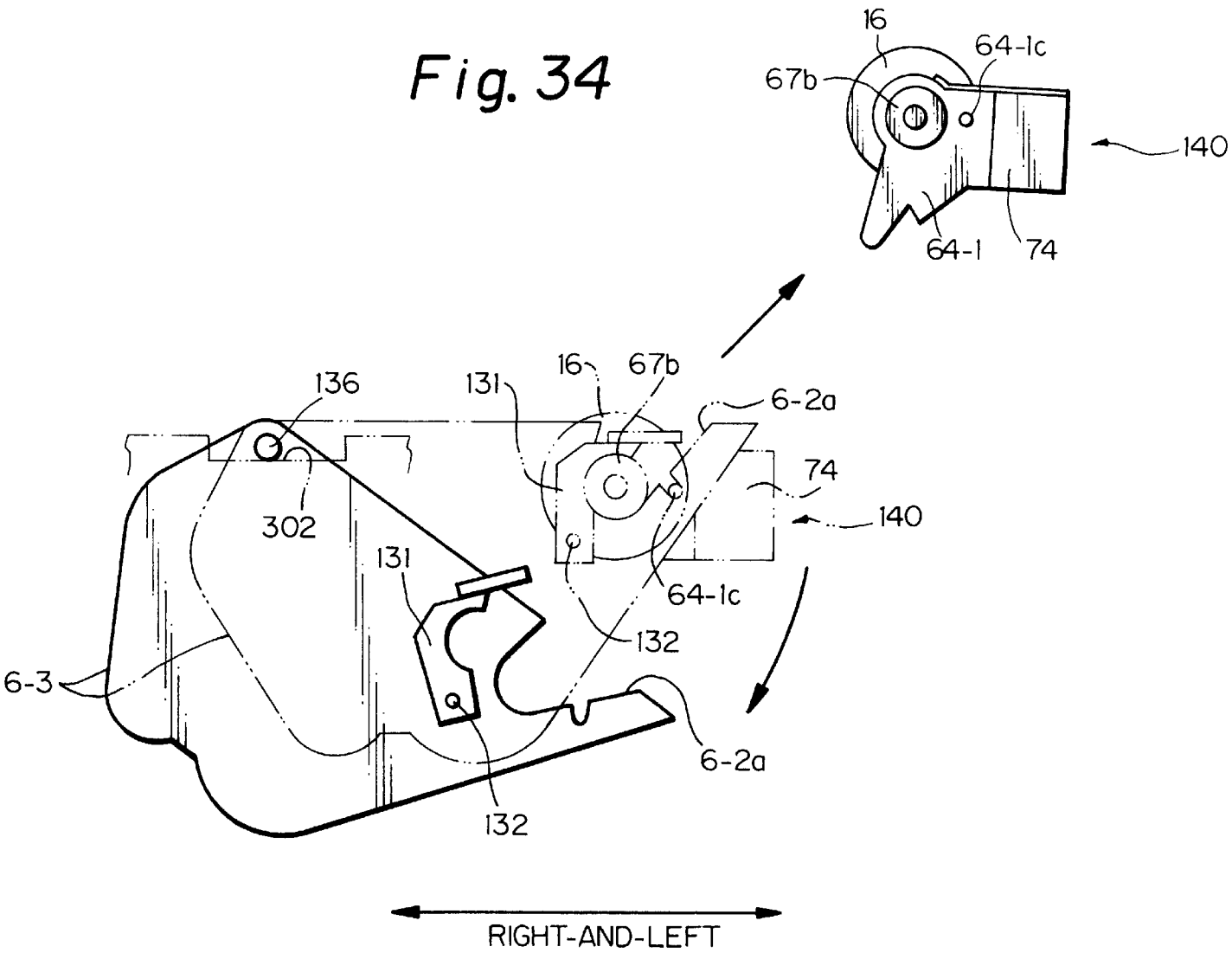
FIG. 34 demonstrates how the developing unit tilts when the drum unit is removed from the composite unit.

As shown in FIG. 34, the developing unit 6-3 and drum unit 140 combined together are mounted on the side walls and common mount members, as indicated by dash-and-dots lines. In this condition, at the right side, the outside diameter portion 67*b* of the bearing 67 is received in the shaft support portion 910 of the mount member 900 (not shown in FIG. 34 for clarity). At the left side, the pin 136 is received in the notch 302. Assume that the operator removes only the drum 140. Then, the operator opens the lever 131 away from the outside diameter portion 67*b*. At this instant, the developing unit 6-3 tends to rotate due to a moment acting about the pin 136 and ascribable to the weight of the unit 6-3. However, the developing unit 6-3 does not rotate because the outside diameter portion 67*b* is sandwiched between the shaft support portion 910 and the edge of the opening 6-2*a*.

When the operator lifts the drum unit 140, the outside diameter portion 67*b* is released from the shaft support portion 910 and opening 6-2*a*. As a result, the developing unit 6-3 looses the support at the right side and tilts clockwise about the pin 136 due to its own weight until it abuts against the bottom of the apparatus, as indicated by a solid line in FIG. 33. Then, the operator intending to mount the drum unit 140 must raise the developing unit 6-3. In a specific construction to be described, the drum unit 140 can be mounted and dismounted from the developing unit 6-3 without any displacement of the developing unit 6-3 relative to the side walls and common mount members.

In the specific construction, the positional relation between the developing unit and the writing device is determined via a developing unit support section supporting the developing unit, and the common mount members including the writing device support portions.

Specifically, as shown in FIG. 3B, common mount members 900A and 1100A mounted on the side walls 300 and 400, respectively, are basically identical with the mount members 900 and 1100 described with reference to FIGS. 1 and 4 as well as other drawings. The writing device support portions 920 and 1110 are replaced with writing device support portions 920A and 1100A while the shaft support portions 910 and 1110 are replaced with developing unit support portions 910A and 1110A. Common mount members corresponding to the mount members 1300 and 1100', FIGS. 1 and 4, are positioned at the left of the mount members 900A and 1100A, although not shown or describe in order to avoid redundancy. The notches 302 and 402 shown in FIG. 29 are also formed in the sidewalls 300 and 400, respectively. A developing unit 6-3A to be mounted to the mount members 900A and 1100A corresponds to the developing unit 6-3, FIG. 28, and includes the first developing device 6 of FIGS. 21 and 22. The developing device 6 includes the A developing section 19 and B developing section 20, so that the developing unit 6-3 has a plurality of developing device storing developers of different colors.

[3]B-a Developing Unit

The developing unit 6-3A includes an intermediate support member 200 to be received in and positioned by the developing unit support portion 91 OA. An intermediate support member (not visible in FIG. 36) identical with the support member 200 is positioned on the rear end of the developing unit 6-3A. As shown in FIG. 37, the intermediate support member 200 includes a convex engaging portion 201 engageable with the developing unit support portion 910A. In addition, the support member 200 includes a concave engaging portion 202 engageable with a receiving port 65A2 included in the developing unit 140 (see FIG. 36). The concave engaging portion 202 is open at its top. The engaging portion 201 has the same radius of curvature as the support portion 910A.

Figure 35:
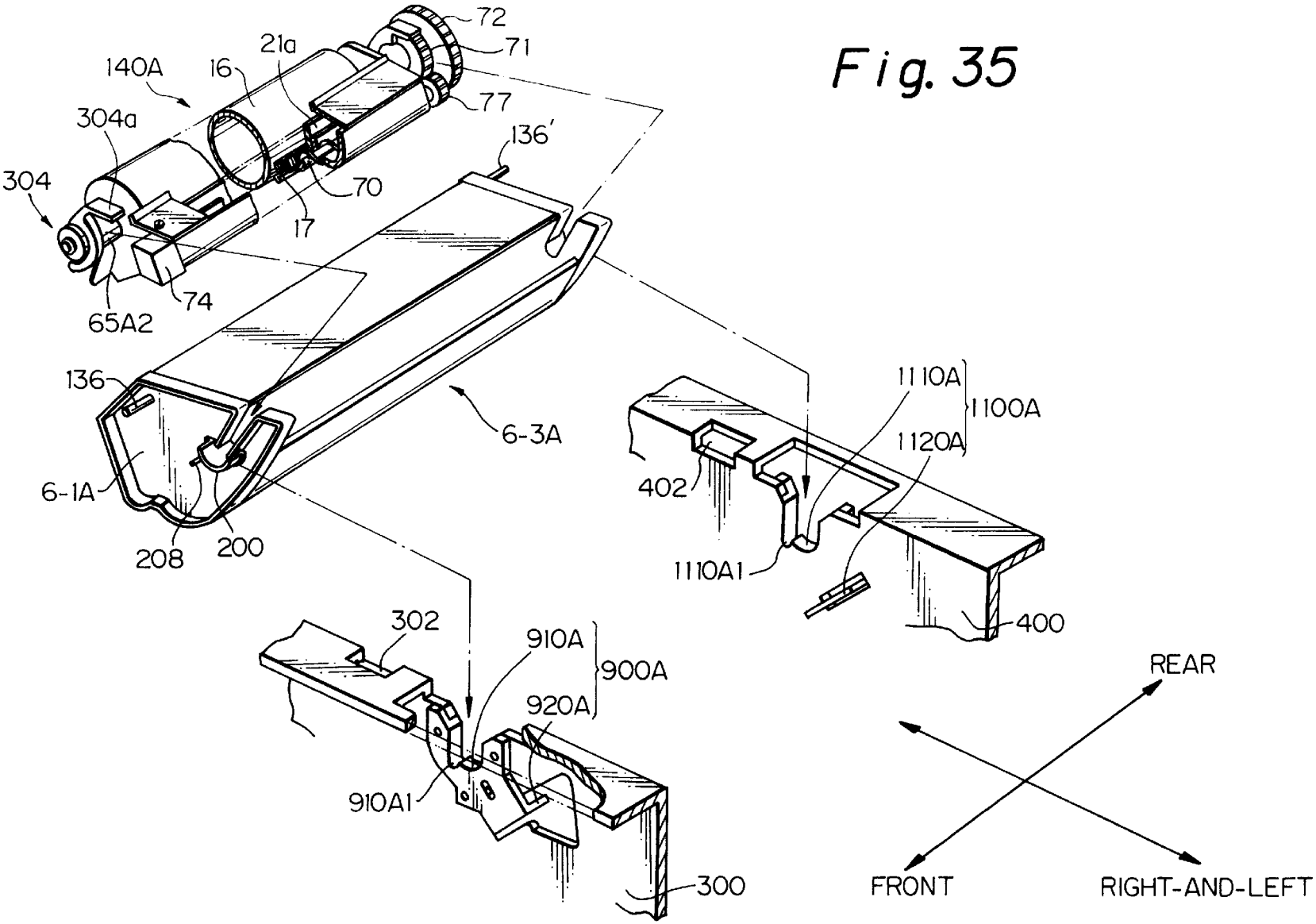
FIGS. 35 and 36 are exploded perspective views showing how the composite unit is mounted to the side walls with the developing unit serving as a reference.

FIG. 35 shows the drum unit 140A in detail. The drum unit 140A shown in FIG. 35, like the drum unit 140 shown in FIG. 28, is of the type delivering the waste toner to the outlet portion 74 by using the auger 70. By contrast, a drum unit 140A' shown in FIG. 36, like the drum unit 140' shown in FIG. 29, is of the type delivering this waste toner removed by the cleaning blade 21*a* to the box 103 extending in the widthwise direction of the drum 16. The drum unit 140A' does not need the auger 70 and therefore the gears 71 and 77 for driving it. As for the rest of the construction, the drum units 140 and 140A' are identical. The drum units 140A and 140A' can be mounted and dismounted from the developing unit 6-3A in exactly the same manner.

Figure 36:
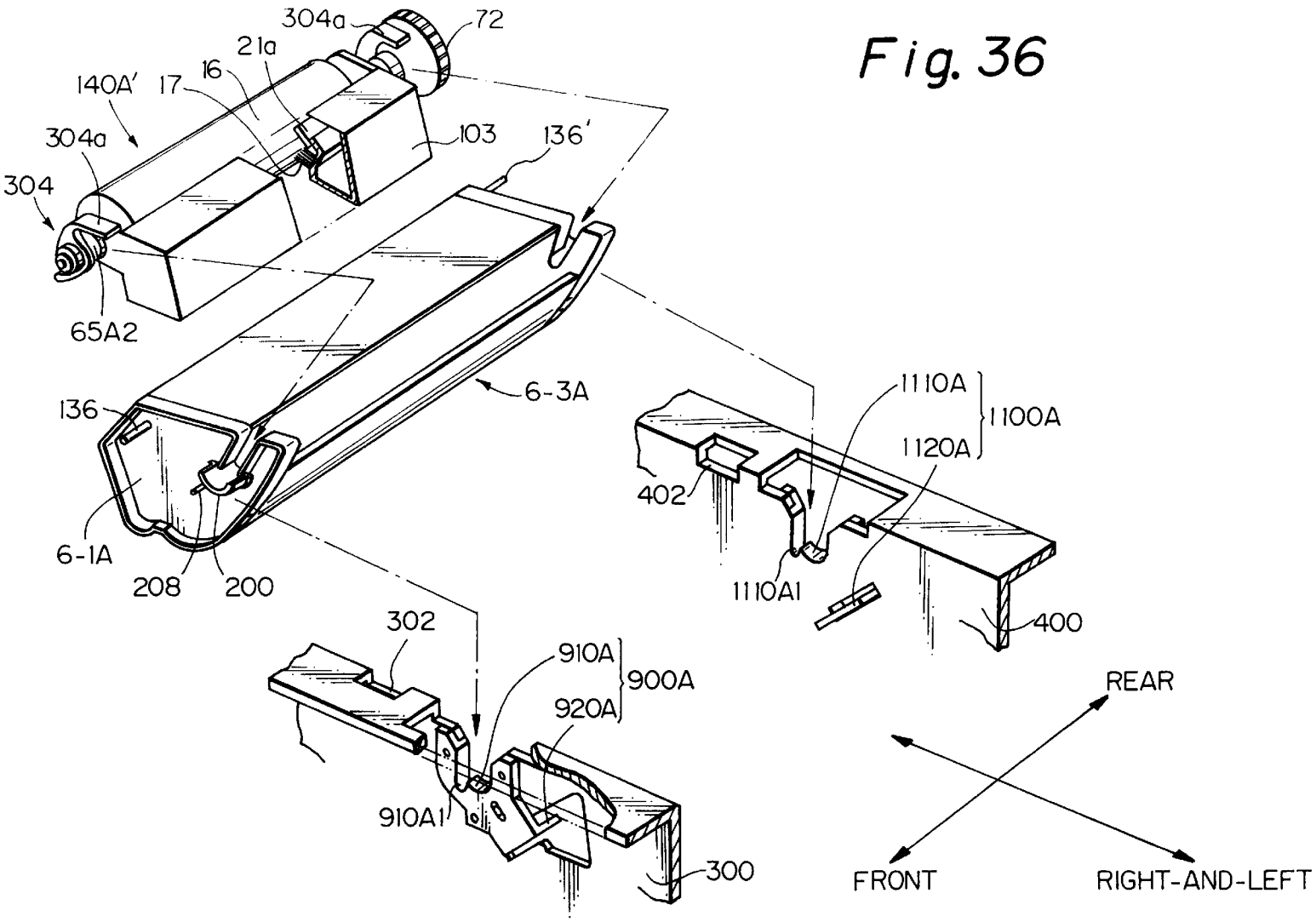
Figure 37:
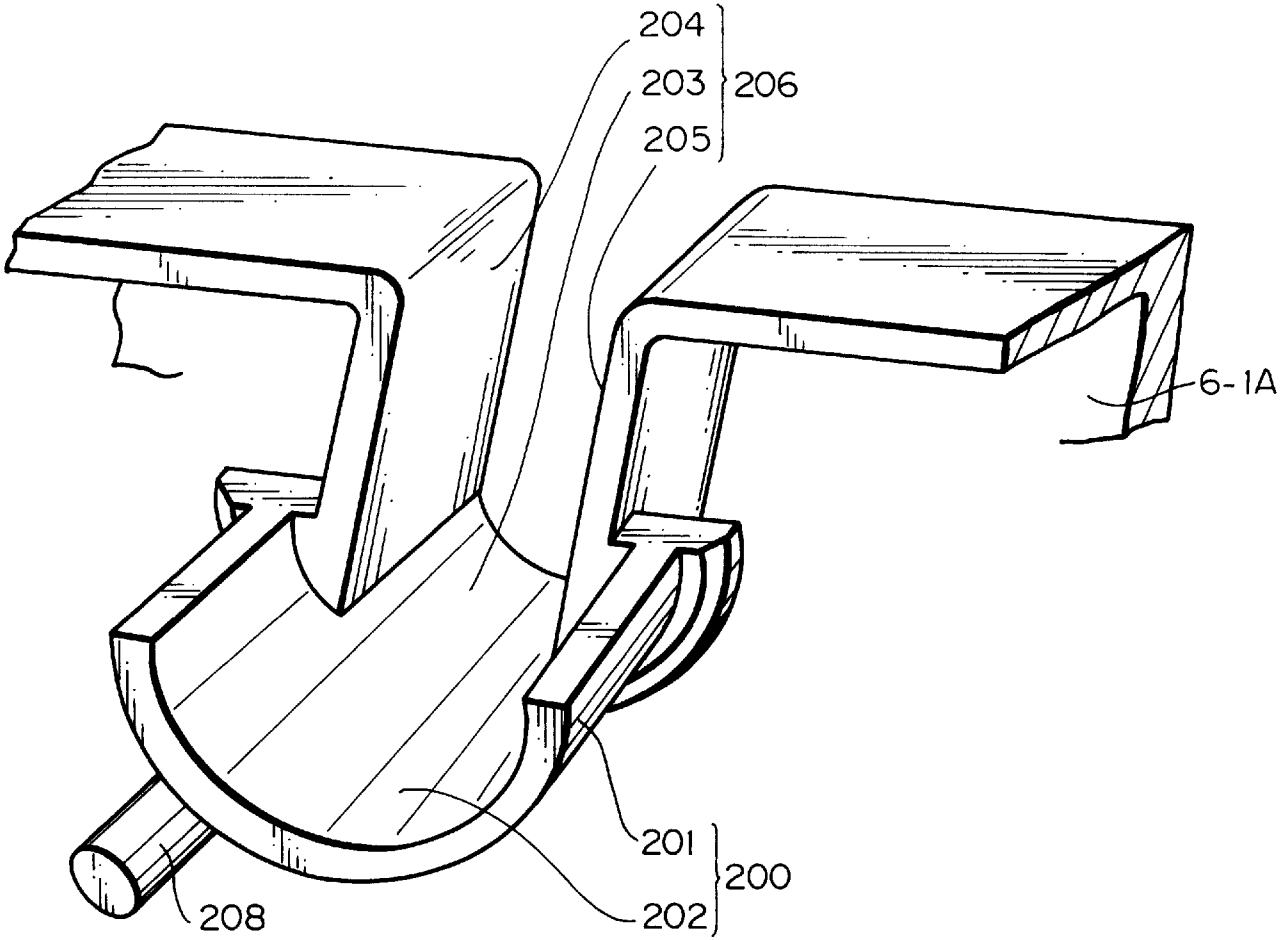
FIG. 37 is an exploded perspective view showing an intermediate support member.

As shown in FIG. 36, the developing unit 6-3A, like the developing unit 6-3A of FIG. 28, includes the pins 136 and 136'. The pins 136 and 136' are respectively engageable with the side wall 300 and 400 at positions other than the intermediate support member 200. At the front side, the pin 136 is received in the notch 302 with the intermediate supporting member 200 mating with the developing unit support portion 910A. This is also affected at the rear side. As a result, the developing unit 6-3A is removably mounted to the side walls 300 and 400 via the common mount members 900 and 1100A. In this manner, the developing unit 6-3A is supported at two points at the front and at two points at the rear and therefore held stable at all times.

The drum unit 140 is mounted to the developing unit 6-3A stably held on the side calls 300 and 400 from the above. This allows the drum unit 140 to be freely mounted and dismounted from the developing unit 6-3A without affecting the position of the unit 6-3A relative to the side walls 300 and 400. This will be described more specifically hereinafter.

Figure 39:
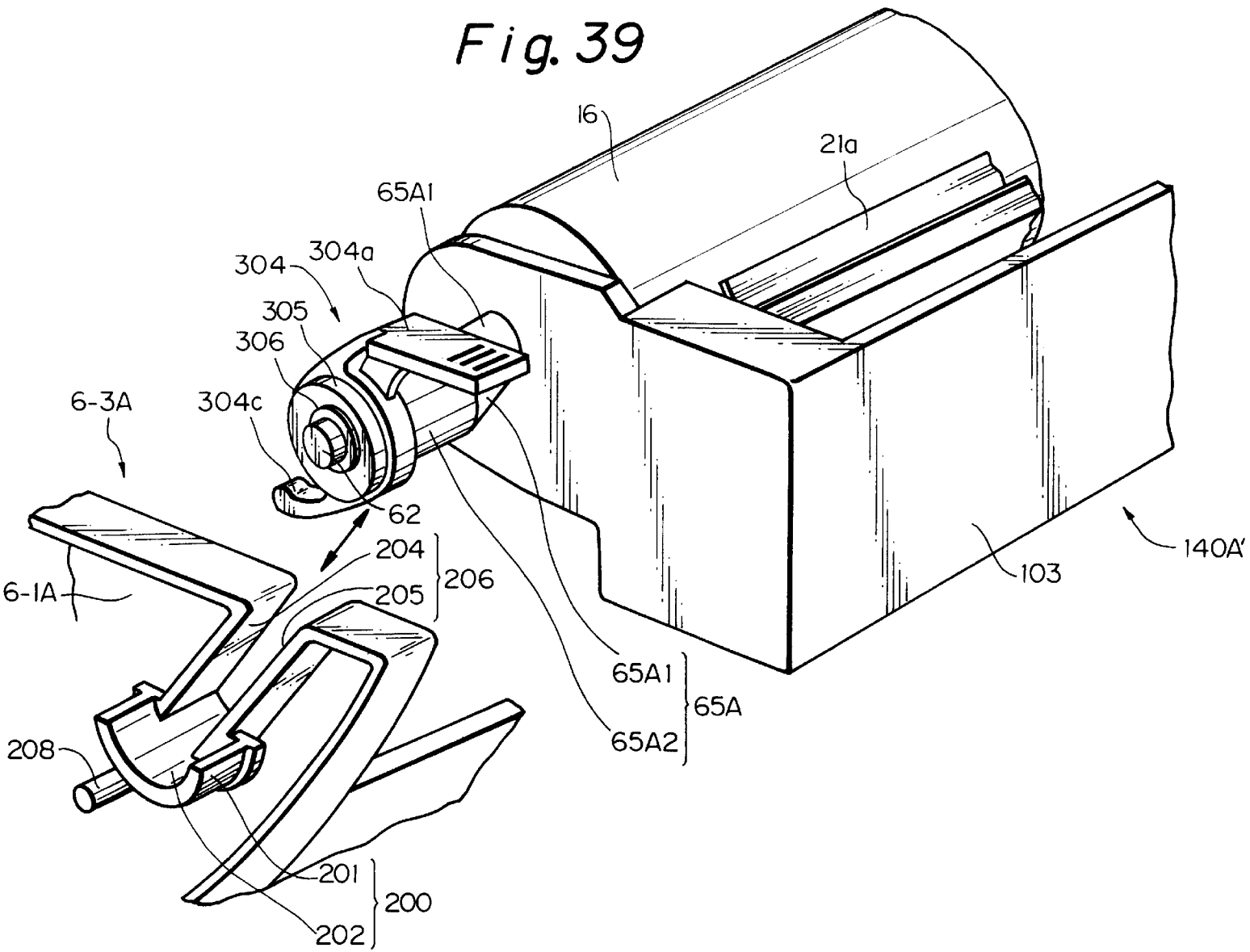
FIG. 39 is an exploded perspective view of the composite unit.

As shown in FIGS. 37 and 39 in an enlarged scale, a front unit case 6-1A forming the casing of the developing unit 6-3A is formed with a generally U-shaped groove 206 made up of a bottom surface 203 and parallel side surfaces 204 and 205 extending upward from the bottom surface 203. The bottom surface 203 is coaxial with and has the same radius curvature as the engaging portion 202.

Figure 38:
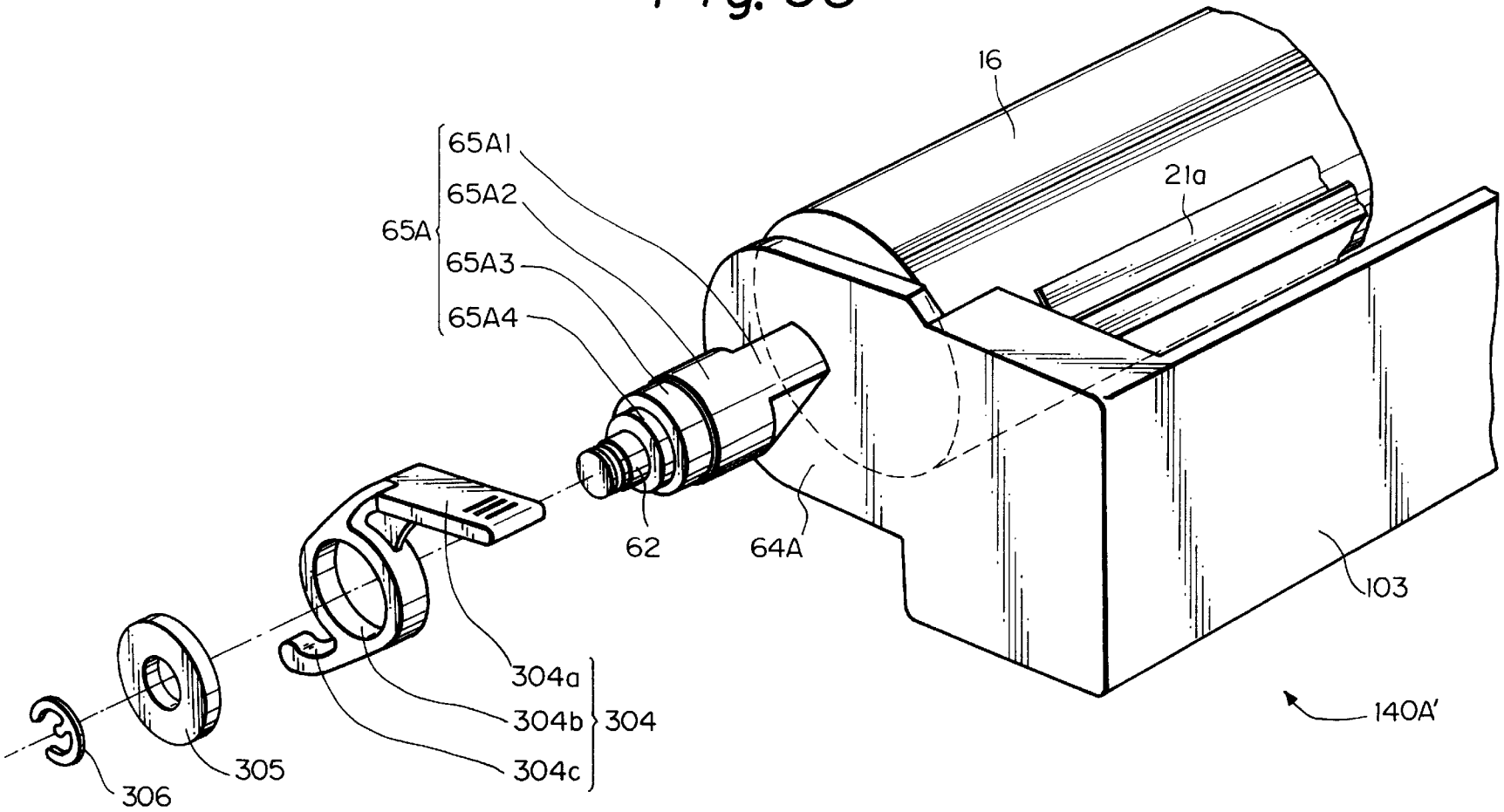
FIG. 38 is an exploded perspective view showing a relation between the drum unit and the lever.
Figure 43:
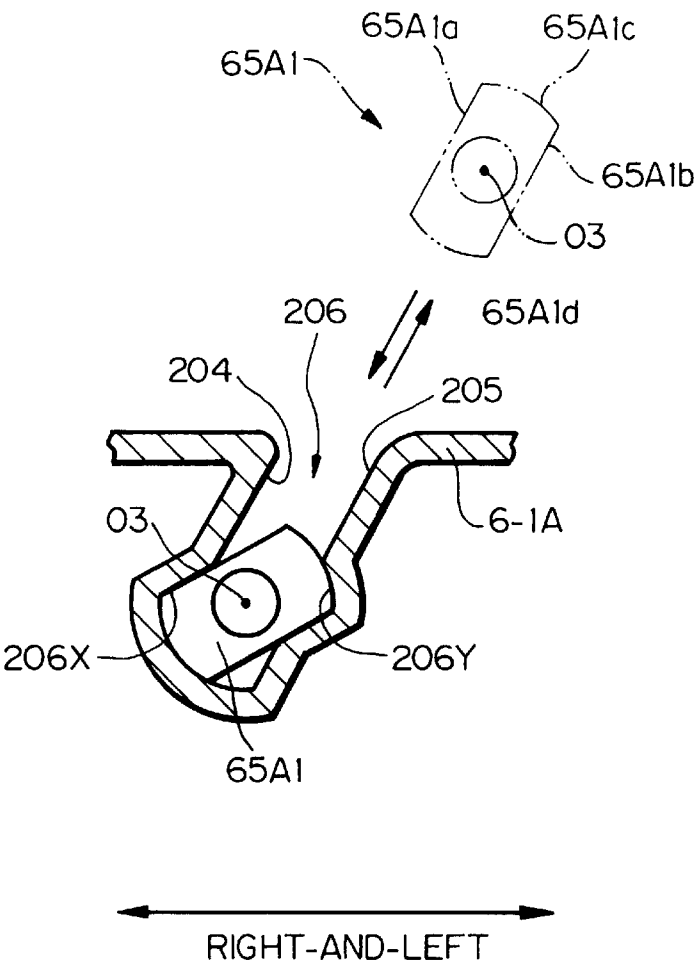
FIGS. 42 and 43 show a relation between an oval portion and a groove.
Figure 42:
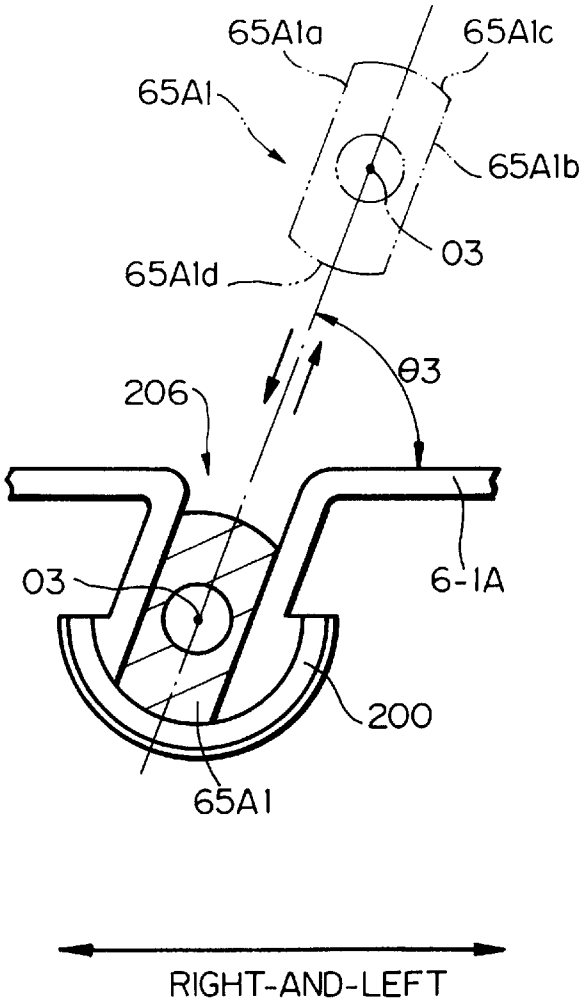

As shown in FIG. 38, this box 103 is constructed integrally with a drum case 64A. A bearing 65A is affixed to one end of the drum case 64A and rotatably supports the shaft 62 of the drum 16. As shown in FIGS. 42 and 43, the bearing 65A includes a generally oval portion 65A1, a receiving portion 65A2 haying a cylindrical cross-section, an outside diameter portion 65A3, and an outside diameter portion 65A4.

As shown in FIGS. 42 and 43, the oval portion 65A1 includes parallel flat portions 65A1*a* and 65A1*b* equally divided with respect to the center 03 of a hole for receiving the shaft 62, curved portions 65A1*c* and 65A1*d* forming a part of a circle having the same diameter as the receiving portion 65A2 and having the center 03. The distance between the flat portions 65A1*a* and 65A1*b*, i.e., the thickness of the oval portion 65A1 is so sized as to be slidably received in the groove 206. The flat portions 65A1 and 65A1*b* are inclined by a preselected angle relative to the charger 27 and cleaning blade 21*a*, as seen in the axial direction. This preselected angle allows the developing rollers 32 and 33 included in the developing unit 6-3A to execute the image forming process of FIGS. 21 and 22 in combination with the drum 16.

As shown in FIGS. 39 and 42, when the oval portion 65A1 is received in the groove 206, the curved portion 6541*d* contacts the bottom 203 due to its own weight. The drum unit 140A' can therefore be mounted to the developing unit 6-3 in a preselected position. In addition, the drum unit 140A' can be easily removed from the developing unit 6-3A only if pulled out obliquely upward. In this manner, only the drum unit 140A' can be mounted and dismounted from the developing unit 6-3A without forcing the operator to touch the developing unit 6-3A.

Assume that the drum unit 140A' is mounted to or dismounted from the developing unit 6-3A mounted on the side walls 800 and 400, as shown in FIG. 36. Then, when the drum unit 1404 is lifted in the perpendicular direction, it interferes with the belt 10 because of the limited openable angle θ1 at the upper casing part 106. In light of this, as shown in FIG. 42, the groove 206 is inclined by an angle θ3 corresponding to the angle θ1 relative to the horizontal. By so limiting the mounting and dismounting direction of the drum unit 140A, it is possible to prevent the drum unit 140A from interfering with the belt 10 and to facilitate the operation.

[3]B-b Mounting of Developing Unit to Common Mount Members

When the drum unit 140' in simply received in the groove 206 due to its own weight, it cannot be held in a sufficiently stable manner. In light of this, an affixing mechanism to press the receiving portion 65A2 against the engaging portion 202 or releasing it is provided. A first example of the affixing mechanism is implemented by a lever pivotally mounted to a part of the drum unit 140A' and having a locking portion at its free end, and an engaging portion included in the developing unit 6-3A and engageable with the locking portion.

The first example of the affixing mechanism will be described with reference to FIG. 38. As shown, the outside diameter portion 53A3 is smaller in diameter then the receiving portion 65A2 and is isolated from the portion 65A2 by a shoulder against which the end of the lever 304 will abut. The lever 304 has an inside diameter portion 304*b* engageable with the outside diameter portion 65A2, a grip 304*a* forming the free end of the lever 304, and a recess or locking portion 304*c* facing the grip 304*a*. After the inside diameter portion 304*b* of the lever 304 has been engaged with the outside diameter portion 65A3, a washer 306 is fitted on the outside diameter portion 65A4 smaller in diameter then the outside diameter portion 65A3. Then, a stop ring 306 is fitted on the shaft 62. As a result, the lever 304 is pivotally mounted to the outside diameter portion 65A3. On the other hand, as shown in FIG. 39, a shaft 208 is studded on the position of the unit case 6-1A around the intermediate support portion 200 and engageable with the recess 304*c*.

As shown in FIGS. 35 and 36, a recess 910A1 for receiving the above shaft 208 is formed in the developing unit support portion 910A. Likewise, a recess 110A1 is formed in the other developing unit support portion 1110A for the same purpose.

Figure 40:
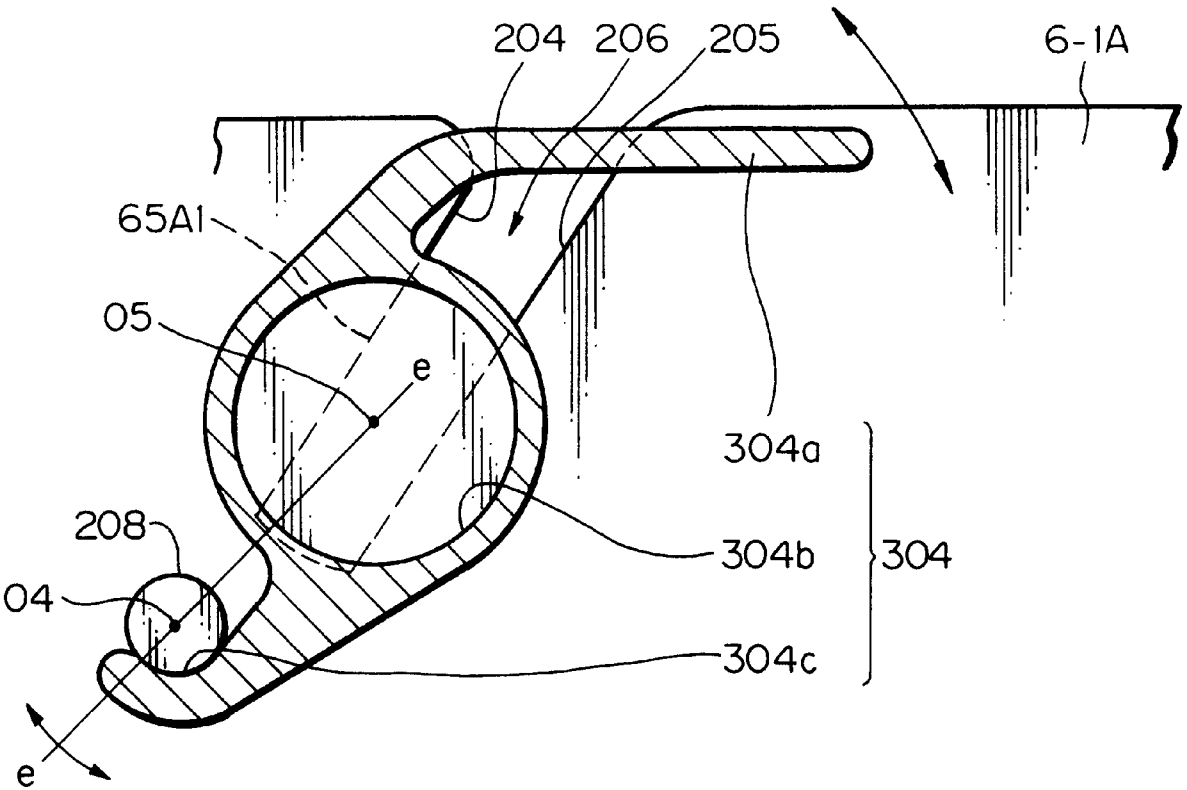
FIG. 40 shows how the lever holds and releases a shaft.
Figure 41:
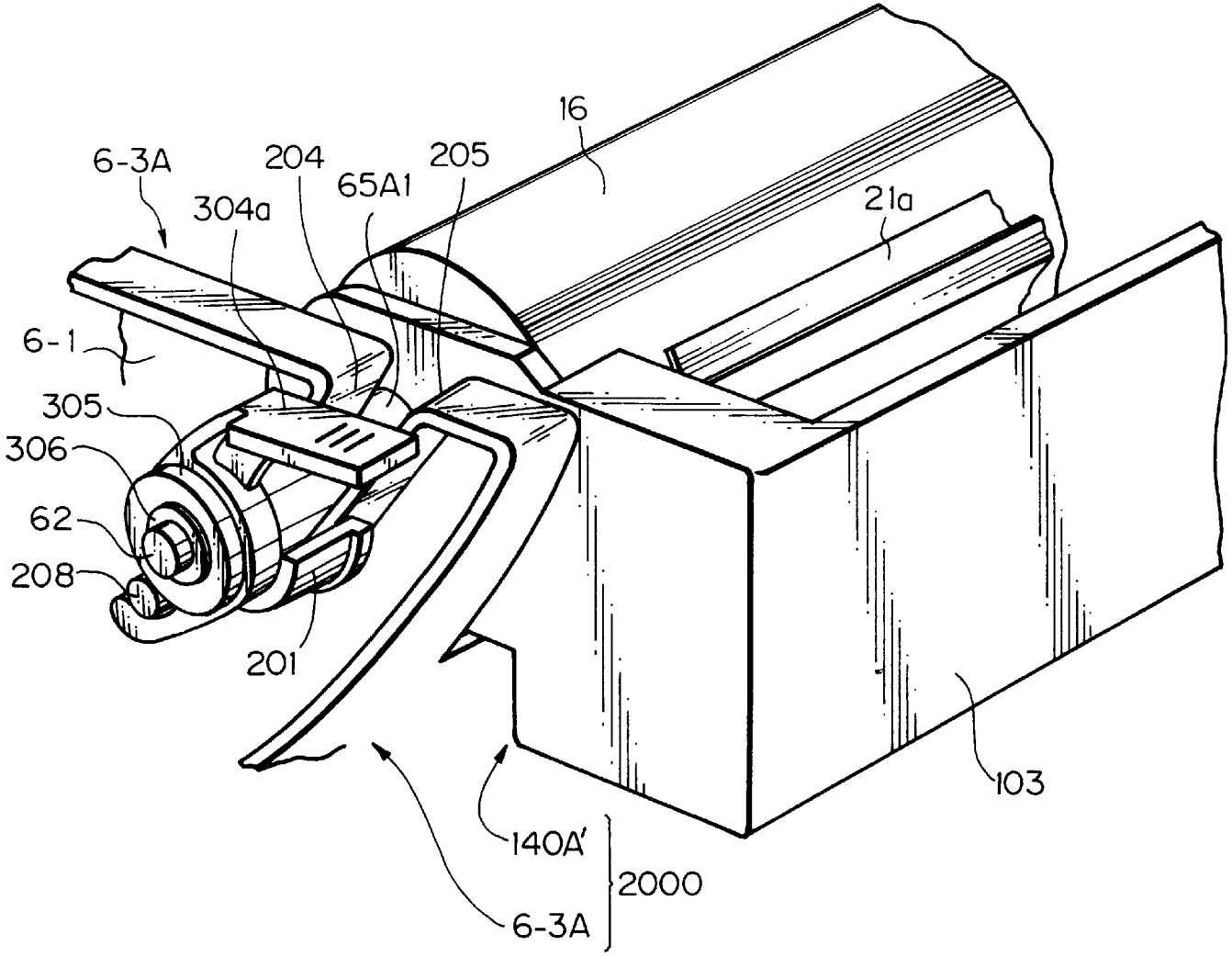
FIG. 41 is an exploded perspective view showing the composite unit.

The drum unit 140A' is mounted to the developing unit 603A with the receiving portion 65A2 engaging with the engaging portion 202. Then, the recess 304*c* is engaged with the shaft 208 via the grip 304. As shown in FIG. 40, the end of the recess 304*c* elastically deforms and extends on the shaft 208 over a line e—e connecting the center 04 of the shaft 208 and the center 05 of the shaft 62. As a result, the end of the recess 304*c* firmly holds the shaft 208 and thereby presses the receiving portion 65A2 against the engaging portion 202. FIG. 41 shows a condition wherein the drum unit 104A' is locked to the developing unit 6-3A in the above configuration. The developing unit 6-3A and drum unit 140A' so combined will be referred to as a composite unit 2000. To remove the drum unit 140A' from the developing unit 6-3A, the operator turns the lever 304 in the reverse direction in order to release the recess 304 from the shaft 208, pulls out the oval portion 65A1 along the groove 206, and then lifts the drum unit 208.

The grip 304*a* is used also when the operator lifts the drum unit 140A' away from the developing unit 6-3A. Some specific configurations of the grip 304*a* will be described hereinafter.

Figure 44:
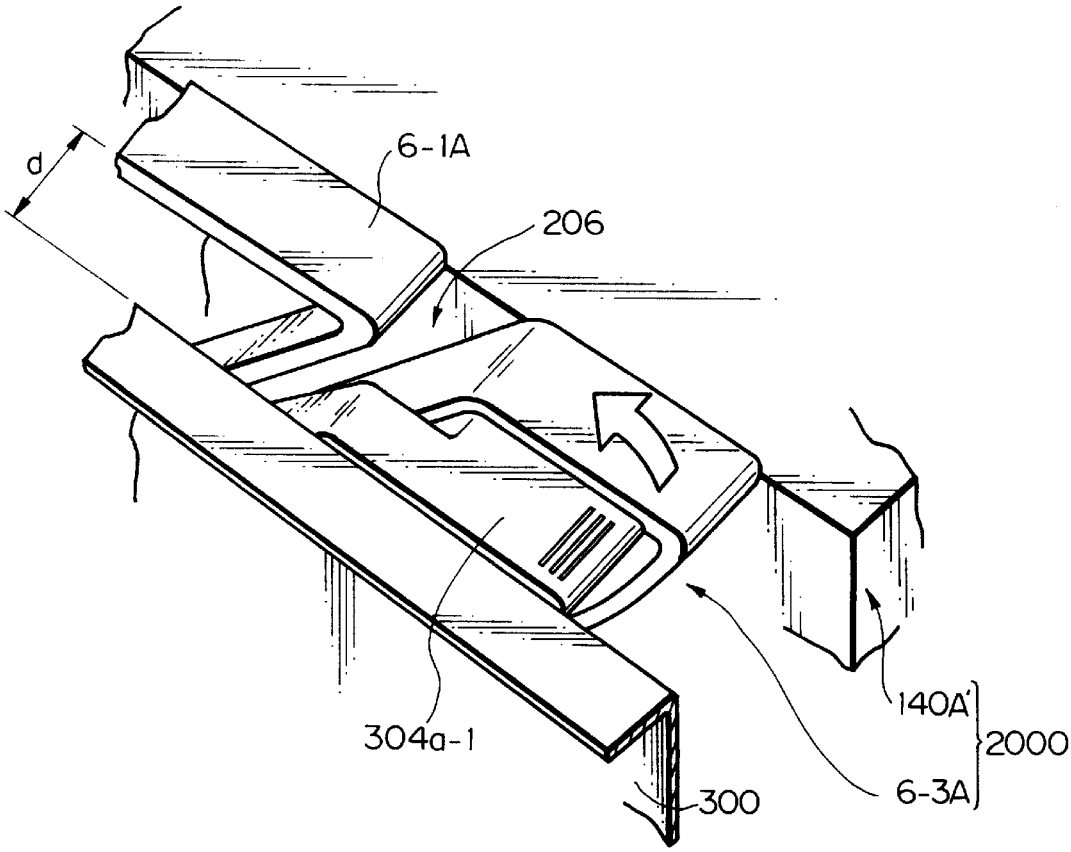
FIGS. 44 and 45 are perspective views each showing a specific configuration of a grip.

FIG. 44 shows a grip 304*a*1 corresponding to the grip 304*a*. The grip 304*a*1 is positioned in a space d between the side wall 300 and the unit case 6-1A. The operator puts a finger or fingers in the space d, lifts the grip 304*a*-1, and then lifts the drum unit 104A' away from the developing unit 6-3A.

Figure 45:
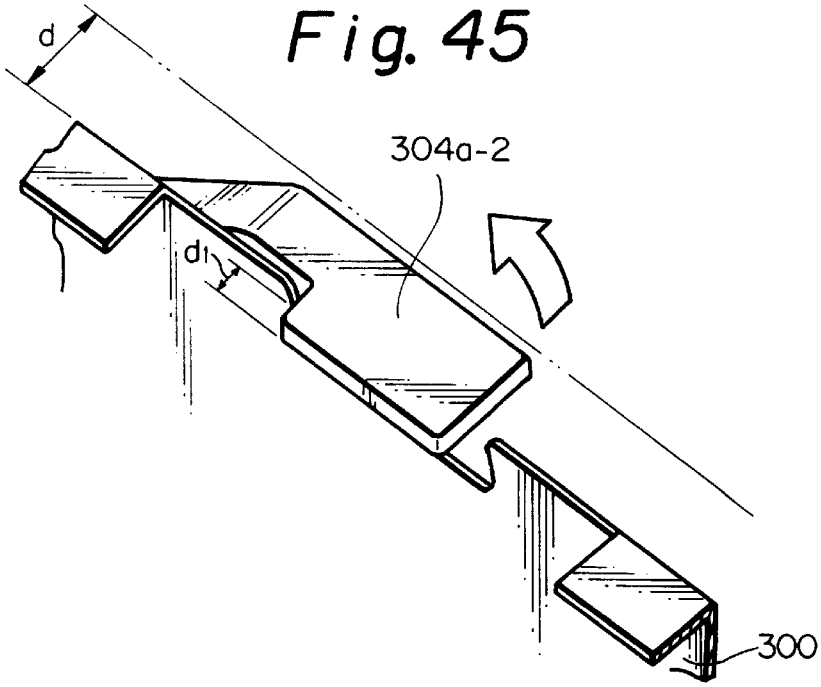

FIG. 45 shows a grip 304 protruding from the side wall 300 to the front side by a dimension dl. The operator can therefore lift the grip 304*a*-2 by simply touching the grip 304, i.e., without putting fingers in the space d, FIG. 44.

Figure 46A:
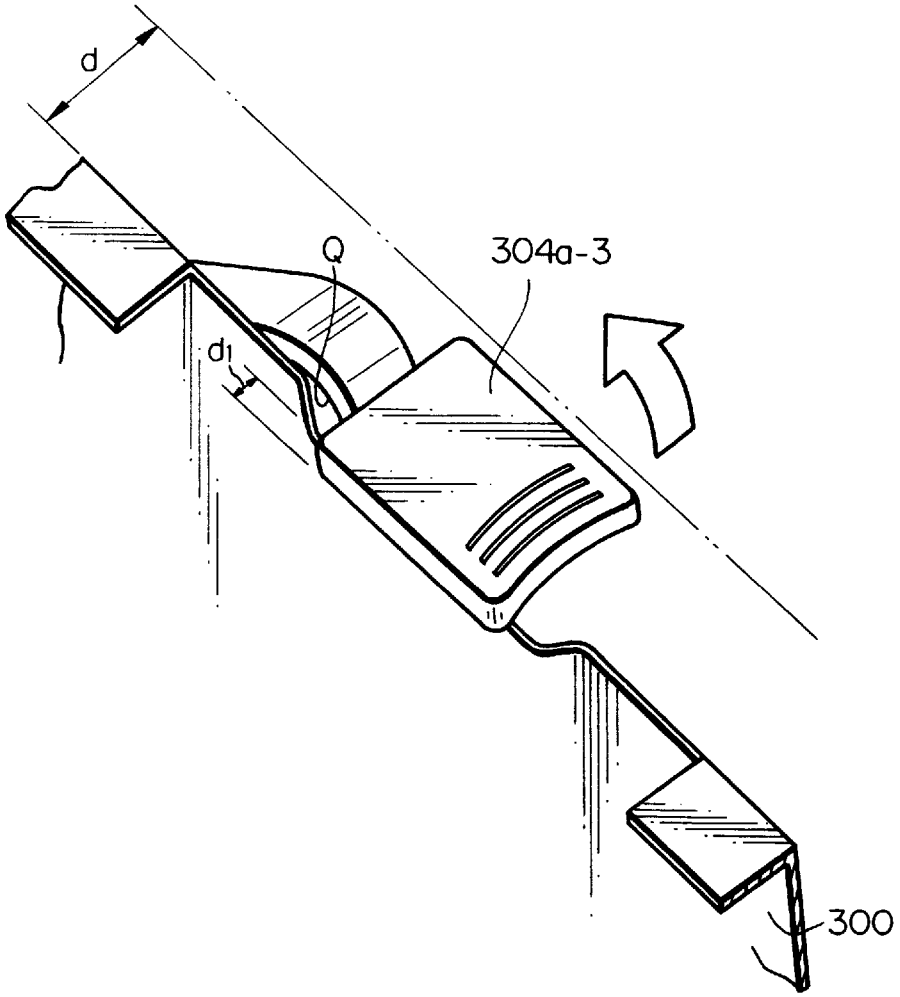
FIG. 46A is a perspective view showing another specific configuration of the grip.
Figure 46B:
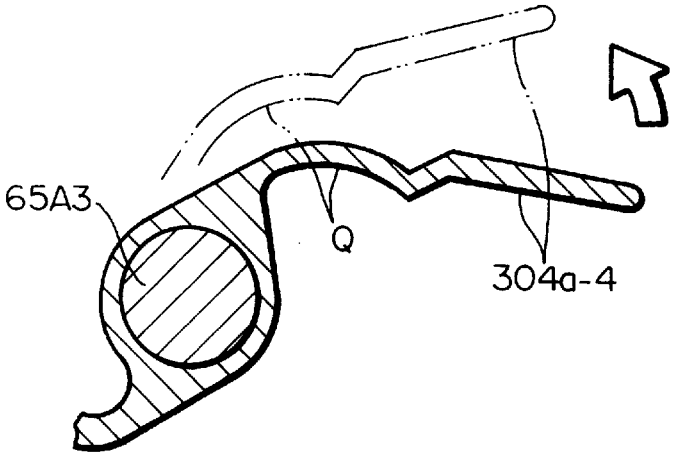
FIG. 46B is a section of the grip of FIG. 46A.

FIG. 46A shows a grip 304*a*-3 also protruding from the side wall 300 to the front by the distance d1. FIG. 46B shows a grip 304*a*-4 including a curved portion Q convex upward. The curved portion Q is positioned at the base end of the grip 304*a*-3 adjoining the outside diameter portion 65A3. The operator by lifting the grip 304*a*-4 may lift the developing unit 140A' by touching the curved portion Q.

Figure 47A:
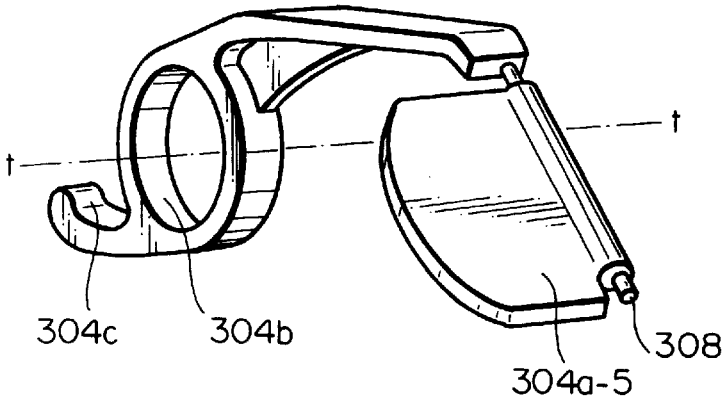
FIG. 47A is a perspective view showing a lever including a grip.
Figure 47B:
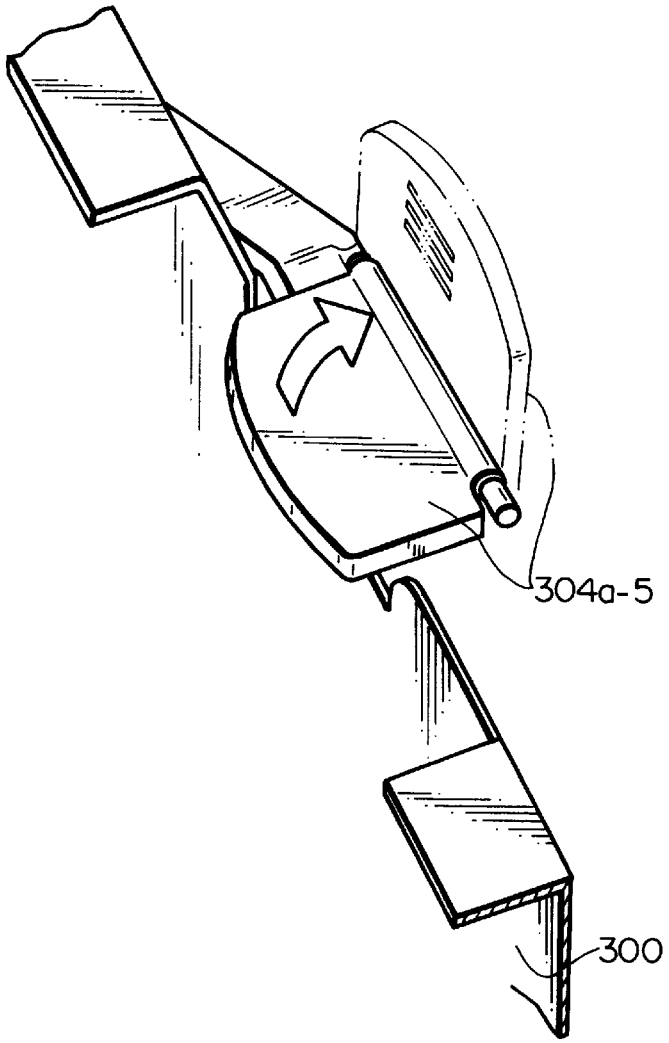
FIG. 47B is a perspective view showing the grip of FIG. 47A.

FIG. 47A shows a grip 304*a*-5 having a flat configuration and rotatably mounted on a shaft 308. The shaft 308 is positioned in a horizontal plane containing the axis t—t of the inside diameter portion 304*b*, and extends in a plane parallel to the direction perpendicular to the axis t—t. The grip 304*a*-5 is movable between a flat position shown in FIG. 47A and a perpendicular position shown in FIG. 47B in a click fashion. When the recess 304*c* is engaged with the shaft 208, the grip 304*a*-5 is held in the flat position indicated by a solid line. As shown in FIG. 47B, to remove the drum unit 140A' from the developing unit 6-3A, the operator raises the grip 304*a*-5 in the perpendicular direction and then lifts the drum unit 140A' away from the developing unit by nipping the flat portion of the grip 304*a*-5.

Figure 48A:
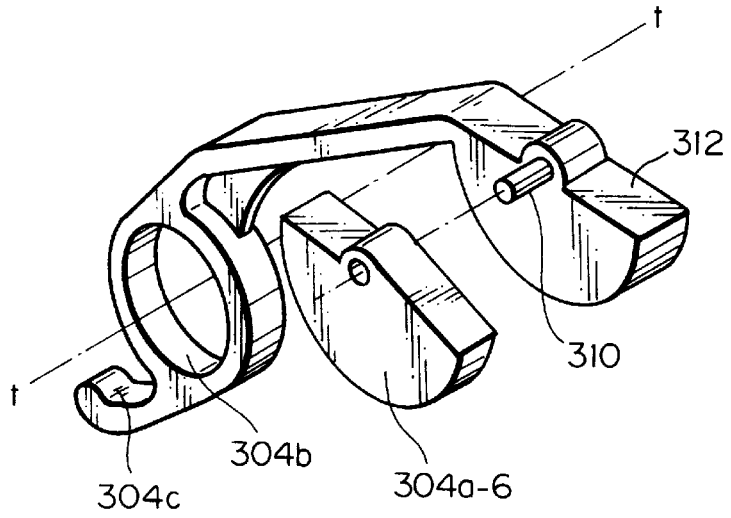
FIG. 48A is a perspective view showing a lever including a grip.
Figure 48B:
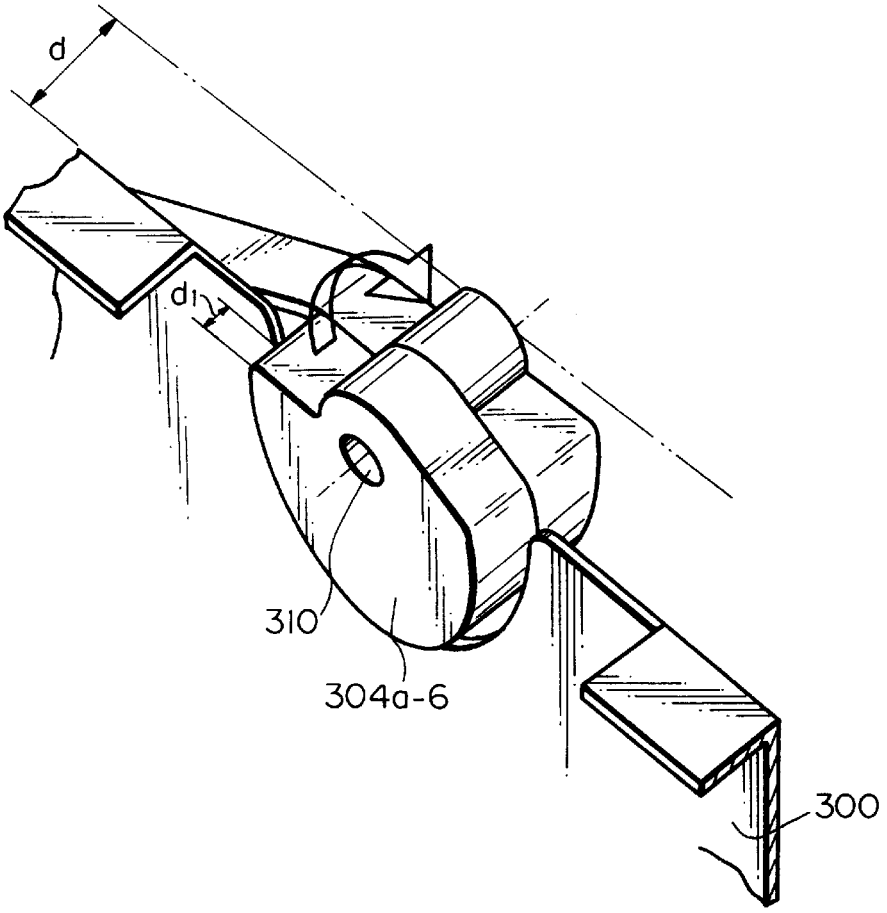
FIG. 48B is a perspective view showing the grip of FIG. 48A.
Figure 49A:
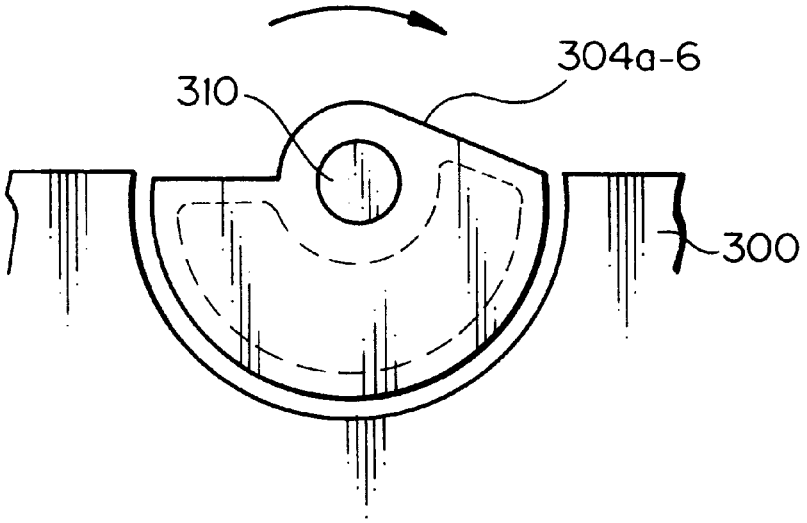
FIG. 49A shows the grip in a position for locking the lever.
Figure 49B:
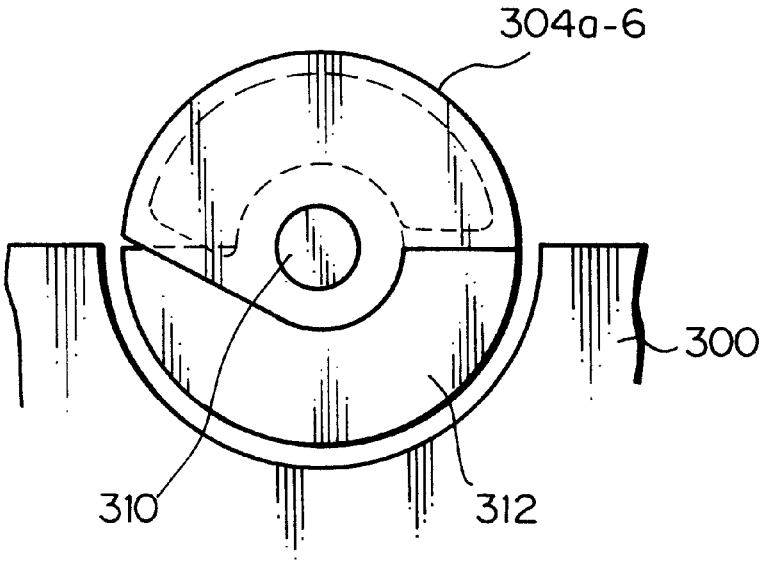
FIG. 49B shows the grip in a position for releasing the lever.

FIG. 48A shows a grip 304*a*-6 that is rotatably mounted on a shaft 310 parallel to the axis t—t of the inside diameter portion 304*b*. The shaft 31 is affixed to a semicircular member 312 having a curved portion facing downward. The grip 304*a*-6 has its inner portion reduced in thickness. As shown in FIGS. 48A and 49B, the grip 304*a*-6 is movable between a position where it aligns with the member 312 and the other position shown in FIG. 49B in a click stop fashion.

Specifically, when the recess 304*c* is engaged with the shaft 208, the grip 304*a*-6 is positioned such that its curved portion faces downward. To remove the drum unit 140A' from the developing unit 6-3A, the operator nips the portion of the grip 304*a*-6 protruding from the side wall 300 by the distance dl and then turns it by 180° until the curved portion faces upward. In this condition, the operator raises the lever by nipping the thinned portion of the grip 304*a*-6 in order to release the recess 304*c* from the shaft 208, and then lifts the drum unit 140A' from the developing unit 6-3A.

Reference will be made to FIG. 43 for describing a second example of the affixing mechanism. As shown, the bottom of the U-shaped groove 206 is formed with recesses capable of locking the oval portion 65A1 in accordance with the displacement of the oval portion 65A1. Specifically, a recess 206X receives the corner of the oval portion 65A1 where the flat portion 6541*a* and curved portion 65A1*c* join other. A recess 206Y receives the corner of the oval portion 65A1 where the flat portion 65A1*b* and curved portion 6541*c* join each other. Assume that the oval portion 65A1 positioned on the bottom of the groove 206 is rotated about the center 03. Then, the recesses 206X and 206Y respectively correspond to spaces formed by the above corners biting into the side surfaces 204 and 205.

In the above configuration, only if the oval portion 6541 is positioned in the groove 206 and then rotated clockwise, can it be held in the preselected position shown in FIG. 43. When the oval portion 65A1 is rotated counterclockwise until the flat portions 65A1*a* and 65A1*b* become parallel to the side surfaces 204 and 205, it can be pulled out of the groove 206.

The developing unit 6-3A and drum unit 140A' are combined in the form of the composite unit 2000 (see FIG. 41) by the above affixing mechanism. Then, the composite unit 2000 can he mounted and dismounted from the side walls 300 and 400 via the intermediate support member 200 associated with the mount member 900A and the pins 136 and 136' respectively associated with the side walls 300 and 400.

The affixing mechanism surely affixes the drum unit 140' to the developing unit 6-3A. The pins 136 and 136' do not rise above the side walls 300 and 400 because of the weight of the developing unit 6-3A and the downward movement, as stated with reference to FIG. 28, and therefore do not need any special pressing mechanism. However, the intermediate support member 200 cannot be stably positioned on the developing unit support portion 910A without resorting to some pressing mechanism.

Figure 50:
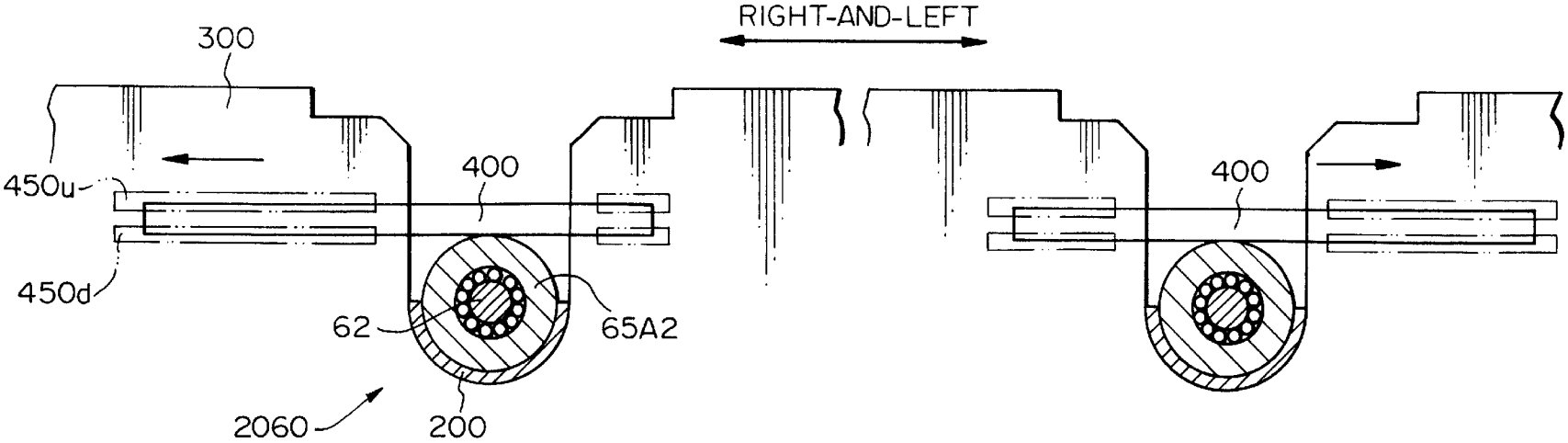
FIG. 50 is a front view showing a slide member.
Figure 51:
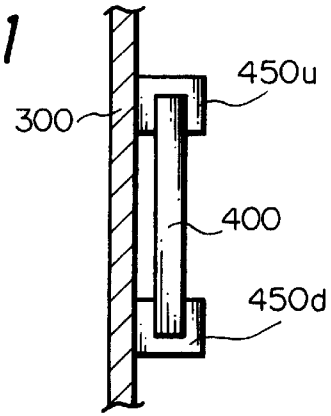
FIG. 51 shows an upper guide and a lower guide supporting the slide member.

In light of the above, as shown in FIG. 50, a slide member 400 is movable toward and away from a position where it faces the intermediate support member 200 with the intermediary of the receiving portion 65A2. When the slide member 400 sandwiches the receiving portion 65A2 between it and the intermediate support member 200, the composite unit 2000, FIG. 41, is firmly retained on the mount member 200. The slide member 400 is a flat elongate plate. An upper guide 450*u* and a lower guide 450*d* are affixed to the side wall 300. The slide member 400 has its upper edge and lower edge supported by the upper guide 450*u* and lower guide 450*d*, respectively, and is slidable in the right-and-left direction. As shown in FIG. 51, the upper guide 450*u* and lower guide 450*d* each has a generally U-shaped section for receiving the slide member 400.

The slide member 400 is movable between a pressing position and a retracted position respectively indicated by a solid line and a phantom line in FIG. 50. Also shown in FIG. 50 is a slide member 400' for pressing the composite assembly of the drum 26 and second developing device 8, FIG. 22. The slide member 400' has the same configuration as the slide member 400.

The two slide members 400 and 400' shown in FIG. 50 may be replaced with a single long slide member capable of sandwiching the spaced receiving portions between it and the intermediate support portion at the same time. The long slide member is so sized as to be capable of pressing and releasing the spaced receiving portions in the right-and-left direction. The upper guide 450*u* and lower guide 450*d* will also be sized to allow the slide member to move over such a stroke.

[4] Assembly Using Common Mount Members

[4]A An Assembly Using Drum Unit as Reference

In the configuration described with reference to FIG. 28 and other drawings, the support portion (shaft support portion 910) for supporting the receiving portion (outside diameter portion 67*b*) assigned to the image carrier (drum unit 140) and the support portion (writing device support portion 920) for supporting the writing device 18 (see FIGS. 14 and 24) are formed in the common mount member 900 in a preselected relation adequate for image writing. First, the mount member 900 is mounted to the side wall 300. Then, the writing device 18 is mounted to the mount member 900. On the other hand, the image carrier (drum unit 140) is mounted to the developing unit 6-3, or a composite unit of the image carrier and developing unit is prepared beforehand. Subsequently, the receiving portion (outside diameter portion 67*b*) of the drum 16 included in the composite unit is mounted to the mount member 900. Such a procedure using the drum unit as a reference allows the operator to separate the drum unit and developing unit and replace them individually or to perform necessary maintenance at a place where the operator can easily handle them in the form of the composite unit. In addition, the operator can combine the drum unit and developing unit and then mount them to the apparatus body.

[4] B Assembly Using Developing Unit as Reference

In the configuration shown in FIGS. 35, 36 and other drawings, the support portion (common mount member 900A) for supporting the intermediate support member 200 mounted on the developing unit 6-3A and the support portion (writing device support portion 920) for supporting the writing device 18 (see FIGS. 14 and 24) are formed in the common mount member 900A in a preselected relation adequate for image formation. First, the mount member 900A is mounted to the side wall 300. Then, the writing device 18 and developing unit 6-3A are mounted to the mount member 300. Finally, the drum unit 140' (140) is mounted to the intermediate support member 200 of the developing unit 6-3A.

In this procedure, the mount member 900A, intermediate support member 200 and receiving portion 65A2 are sequentially stacked in this order. Therefore, the drum unit 140A' (140A) positioned on the top of the stack via the receiving portion 65A2 can be mounted and dismounted from the side wall 300 (mount member 900A) alone without effecting the underlying developing unit 6-3 at all.

Moreover, the compost to unit 2000, FIG. 41, including the drum unit 140A or 140A' can be bodily mounted and dismounted from the side wall 300. Such a procedure allows the operator to separate the drum unit and developing unit and replace them individually or to perform necessary maintenance at a place where the operator can easily handle them in the form of the composite unit. In addition, the operator can mount the entire composite unit 2000 to the apparatus body.

In summary, it will be seen that the present invention provides an image forming apparatus having various unprecedented advantages, as enumerated below.

(1) An image carrier and members around it can be easily and accurately mounted to common mount members together. Portions of stationary members expected to mount the common mount members are machined in a preselected configuration. This allows different kinds of stationary members to share the common mount members and thereby promotes the use of common parts.

(2) A drive member for driving the image carrier can be accurately mounted.

(3) When a plurality of image stations are arranged, not only an accurate relation in position between the image carrier and writing device of the individual image station but also an accurate relation between the image carriers and writing devices of the different image stations can be implemented via the common mount members. This is also true when a single image station is available.

(4) The image carrier can be easily replaced with high positional accuracy when deteriorated.

(5) The distance between the writing device and the image carrier is adjustable to enhance the accuracy of dots forming a latent image. Further, the focus, for example, can be adjusted after assembly, so that the writing device can be prepared as a subassembly beforehand.

(6) Deformation ascribable to heat generated by the writing device can be absorbed to obviate damage and mechanical errors.

(7) The dislocation of an image in the main scanning direction is obviated in the individual image station and between different image stations.

(8) When a plurality of image stations are arranged, the adjusting mechanism assigned to the main scanning direction is not provided in one image station. The deviation of an image can therefore be obviated between the image stations by a minimum number of adjusting mechanisms. This successfully eliminates the deviation of image and color between the image stations.

(9) The inclination of a writing line is adjustable in order to obviate the deviation of an image and therefore the deviation of image and color between the image stations.

(10) Eccentricity and therefore the amount of adjustment is easily adjustable.

(11) It is possible to control a position in the direction of rotation with accuracy and to synchronize the image carriers of different image stations with respect to the above position.

(12) When two image stations are arranged, accurate assembly is achievable to obviate the deviation of an image between the stations. Particularly, a color image is free from the deviation of a color.

(13) A developing unit and the image carrier can be mounted and dismounted from the common mount member integrally with each other via the holding mechanism. Therefore, not only the image carrier and writing device but also the image carrier, writing device, and developing unit can be accurately positioned relative to each other. In addition, the accurate assembly and easy maintenance of the developing unit are promoted.

(14) The image carrier can be easily mounted and dismounted from the developing unit because of the guiding function of an open groove. The pressing mechanism and detent mechanism allow the developing unit and image carrier to be surely positioned relative to each other. A locking portion allows the developing unit to be easily mounted to the apparatus body. If the above groove is open upward, then the image carrier can be stably mounted due to its own weight.

(15) By limiting the orientation of the groove, it is possible to limit the direction in which the image carrier is removed from the developing unit. The image carrier therefore does not interfere with or damage other members.

(16) The pressing mechanism is implemented as a lever. The operator can easily assemble and disassemble the developing unit and image carrier by operating the lever.

(17) When the lever is provided on the image carrier or on the image carrier side, the operator can mount and dismount the image carrier from a desired object easily and accurately.

(18) The operator can assemble or replace only the image carrier by operating the lever.

(19) Support portion for supporting the developing unit and a support portion for supporting the writing device are formed in the common mount member in a preselected relation. The developing unit and writing device can be mounted and dismounted from the common mount member. It is therefore possible to accurately position the writing device and developing unit via the common mount member and to enhance accurate assembly and easy maintenance of the developing unit.

(20) An intermediate support member to be supported by the developing unit support portion is included in the developing unit. The writing device and developing unit can therefore be accurately and easily positioned relative to each other on the common mount member via the intermediate support member.

(21) Because the developing unit includes a plurality of developing units each storing a developer of particular color, a multicolor image forming apparatus can be assembled and maintained with case.

(22) The intermediate support member included in the developing unit is removably engaged with the image carrier. This enhances accurate positioning of the developing unit and image carrier relative to each other and therefore accurate position of the image carrier and the writing device via the developing unit.

(23) The intermediate support member is supplemented as a generally U-shaped open groove. The image carrier can therefore be easily dismounted from the developing unit and can be mounted thereto with accuracy. In addition, charger and cleaning devices can be accurately mounted.

(24) An oval portion contiguous with the receiving portion of the image carrier is received in the groove of the developing unit, insuring an accurate positional relation between the image carrier and the developing unit.

(25) The affixing mechanism allows a composite unit consisting of the image carrier and developing unit to be surely retained.

(26) A lever mounted on the receiving portion of the image carrier or on the developing unit side facilitates the combination and separation of the image carrier and developing unit.

(27) A grip is available for the operator to easily lift the image carrier.

(28) The image carrier can be easily mounted and dismounted from the developing unit by being rotated.

(29) A locking member allows the developing unit to be easily mounted and dismounted from a stationary member.

(30) An intermediate support member and a locking portion included in the developing unit allow the developing unit to be easily mounted and dismounted from a stationary member alone or in the form of a composite unit.

(31) A slide member is capable of easily holding or releasing the common mount member of the composite unit.

(32) The operator can handle the composite unit at an easy-to-work plate.

(33) The image carrier can be easily mounted and dismounted from the apparatus body alone or in the form of a composite unit.

Various modifications will become possible for those skilled in the art after receiving the teachings of the present disclosure without departing from the scope thereof.

What is claimed is:

1. An image forming apparatus for writing a latent image on a rotatable image carrier with writing means, developing the latent image to thereby produce a toner image, and transferring the toner image to a recording medium, said image forming apparatus comprising:

a shaft support portion for supporting a shaft included in the image carrier; and a writing means support portion for supporting the writing means;

wherein a positional relation between the image carrier and the writing means is set by a common mount member affixed to at least one stationary member, said common mount member comprises two independent members facing each other in an axial direction of the image carrier and each being affixed to said at least one stationary member, and one of said two independent members includes a drive member support portion for supporting a drive member which transfers a torque to the image carrier.

2. An apparatus as claimed in claim 1, wherein, said common mount member supporting a single image carrier and at least said writing means supported by said common mount member constitute a single image station, and at least one image station n is arranged in said apparatus.

3. An apparatus as claimed in claim 1, further comprising a developing unit including a developing device for developing the latent image and a unit case accommodating said developing device, wherein said developing device has at one end thereof holding means for positioning and removably holding a receiving port on supporting the image carrier, and has at the other side a first locking portion engageable with said stationary member.

4. An image forming apparatus for writing a latent image on a rotatable image carrier with writing means, developing the latent image to thereby produce a toner image, and transferring the toner image to a recording medium, said image forming apparatus comprising:

a developing unit including a developing device for developing the latent image and a unit case accommodating said developing device; and a common mount member including a developing unit support portion for supporting said developing unit, and a writing means support portion for supporting the writing means;

wherein a positional relation between said developing unit and the writing means is set via said common mount member and said developing unit includes an intermediate support member to be positioned on said developing unit support portion.

5. An image forming apparatus configured to write a latent image on a rotatable image carrier with a writing device, develop the latent image to thereby produce a toner image, and transfer the toner image to a recording medium, said image forming apparatus comprising:

a shaft support portion configured to support a shaft included in the image carrier; and a writing device support portion configured to support the writing device;

wherein a positional relation between the image carrier and the writing device is set by a common mount member affixed to at least one stationary member, said common mount member comprises two independent members facing each other in an axial direction of the image carrier and each being affixed to said at least one stationary member, and one of said two independent members includes a drive member support portion configured to support a drive member which transfers a torque to the image carrier.

6. An apparatus as claimed in claim 5, wherein the image carrier forms a part of an image carrier unit including a charging device and a cleaning device.

7. An apparatus as claimed in claim 5, wherein said drive member comprises a worm shaft capable of meshing with a gear mounted on the image carrier.

8. An apparatus as claimed in claim 5, further comprising:

an intermediate transfer belt to which the toner image is transferred from the image carrier;

a transfer device configured to transfer the toner image from said intermediate transfer belt to the recording medium; and at least two image stations arranged along a same run of said intermediate transfer belt at a preselected distance from each other.

9. An apparatus as claimed in claim 5, wherein said common mount member configured to support a single image carrier and at least said writing device supported by said common mount member constitute a single image station and at least one image station n is arranged in said apparatus.

10. An apparatus as claimed in claim 9, wherein n is 1.

11. An apparatus as claimed in claim 9, wherein a main scanning direction adjusting mechanism is included in n−1 said image stations and positioned between said writing device and said writing device support portion and said writing device is fixed in place relative to said writing device support portion in the image station without said main scanning direction adjustment mechanism.

12. An apparatus as claimed in claim 9, further comprising:

a line adjusting mechanism, configured to adjust an inclination of a line to be written by the writing device on the image carrier relative to an axis of said image carrier, is included in all of the n image stations and positioned between said writing device and said writing device support portion.

13. An apparatus as claimed in claim 12, wherein said line adjusting mechanism is included in n−1 said image stations and positioned between said writing device and said writing device support portion.

14. An apparatus as claimed in claim 5, wherein the image carrier is removably mounted to said common mount member alone or in a form of a unit including the members around said image carrier.

15. An apparatus as claimed in claim 5, wherein the writing device is removably mounted to said common mount member.

16. An apparatus as claimed in claim 5, further comprising a space adjusting mechanism positioned between the writing device and said writing device support portion and configured to adjust a space between said writing device and the image carrier.

17. An apparatus as claimed in claim 5, wherein either one of said writing device support portion and the writing device includes a portion for absorbing a displacement ascribable to thermal expansion and contraction of said writing device.

18. An apparatus as claimed in claim 5, further comprising a main scanning line adjusting mechanism positioned between the writing device and said writing device support portion and configured to adjust a position of said writing device in a main scanning direction relative to the image carrier mounted to said common mount member.

19. An apparatus as claimed in claim 18, wherein said main scanning line adjusting mechanism and said line adjusting mechanism share a single eccentric pin.

20. An apparatus as claimed in claim 5, further comprising a line-inclination adjusting mechanism positioned between the writing device and said writing device support portion and configured to adjust an inclination of a line to be written by said writing device on the image carrier relative to an axis of rotation of said image carrier mounted to said common mount member.

21. An apparatus as claimed in claim 20, wherein said line-inclination adjusting mechanism causes one end of the writing device to move about an opposite end.

22. An apparatus as claimed in claim 5, further comprising:

a developing unit including a developing device configured to develop the latent image, and a unit case accommodating said developing device, wherein said developing device has at one end thereof a holding mechanism configured to position and removably hold a receiving portion which supports the image carrier and has at the other end a first locking portion engageable with said stationary member.

23. An apparatus as claimed in claim 22, wherein said holding mechanism comprises:

an opening;

a pressing mechanism configured to hold said receiving portion in a notch; and a detent mechanism configured to prevent said receiving portion from rotating relative to said developing unit, said first locking portion is configured such that said locking portion faces downward due to a weight thereof when engaged with a first engaging portion included in said stationary member.

24. An apparatus as claimed in claim 23, wherein said opening is so oriented as to limit a direction in which the image carrier is mounted and dismounted from said developing unit.

25. An apparatus as claimed in claim 24, wherein said pressing mechanism comprises a lever pivotally mounted to either one of said receiving portion and said developing unit and formed with a second locking portion engageable with said receiving portion at a free end and a second engaging portion included in either one of said receiving portion and said developing unit and engageable with said second locking portion.

26. An image carrier unit comprising:

an image carrier on which a writing device forms a latent image;

a charging device configured to charge the image carrier;

a cleaning device configured to remove toner from said image carier;

a receiving portion configured to support said image carrier; and a lever pivotally mounted to said receiving portion and having a locking portion which engages an engaging portion on a stationary member of an image-forming apparatus.

27. An image forming apparatus configured to write a latent image on a rotatable image carrier with a writing device, develop the latent image to thereby produce a toner image, and transfer the toner image to a recording medium, said image forming apparatus comprising:

a developing unit including a developing device configured to develop the latent image and a unit case accommodating said developing device; and a common mount member including a developing unit support portion configured to support said developing unit and a writing device support portion configured to support the writing device, wherein a positional relation between said developing unit and the writing device is set via said common mount member and said developing unit includes an intermediate support member to be positioned on said developing unit support portion.

28. An apparatus as claimed in claim 27, wherein said developing unit includes a plurality of developing devices each configured to store a developer of particular color.

29. An apparatus as claimed in claim 27, wherein said intermediate support member is engageable with a receiving portion configured to support the image carrier.

30. An apparatus as claimed in claim 29, wherein said intermediate support member comprises a convex engaging portion engageable with said developing unit support portion and a concave open engaging portion engageable with said receiving portion.

31. An apparatus as claimed in claim 30, wherein said receiving portion forms a part of an image carrier unit including charging device and cleaning device.

32. An apparatus as claimed in claim 30, wherein said developing unit includes a generally U-shaped groove having parallel side surfaces and an oval portion contiguous with said receiving portion has parallel flat portions thereof slidably received in said groove, said oval portion and said groove determining a positional relation between said developing unit and the image carrier.

33. An apparatus as claimed in claim 32, wherein said groove has a preselected orientation for limiting a direction in which said image carrier unit is mounted and dismounted from said developing unit.

34. An apparatus as claimed in claim 32, further comprising:

an affixing mechanism configured to selectively maintain and cancel engagement of said concave engaging portion of said intermediate support member and said receiving portion.

35. An apparatus as claimed in claim 34, wherein said affixing mechanism comprises:

a lever pivotally mounted to either one of said image carrier unit and said developing unit and including a locking portion at a free end; and an engaging portion included in the other of said image carrier unit and said developing unit configured to engage with said locking portion.

36. An apparatus as claimed in claim 34, wherein said lever pivotally mounted to said receiving portion of said image carrier includes a grip formed integrally with said receiving portion configured to remove said image carrier or said image carrier unit from said developing unit.

37. An apparatus as claimed in claim 34, wherein said affixing mechanism comprises recesses formed in said groove for locking said oval portion in accordance with a displacement of said oval portion.

38. An apparatus as claimed in claim 34, wherein said developing unit further comprising a locking portion engageable with said stationary member at a position different from a position where said intermediate support member is present.

39. An apparatus as claimed in claim 38, wherein, after said developing unit and said image carrier are combined to form a composite unit by said affixing mechanism, said composite unit is mounted to or dismounted from said stationary member by engagement or disengagement of said intermediate support member with or from said common mount member effected at one end of said developing unit and engagement or disengagement of said locking portion with or from said stationary member effected at the other end of said developing unit.

40. An apparatus as claimed in claim 39, further comprising:

a slide member movable toward and away from a position where said slide member faces said intermediate support member with the intermediary of said receiving portion of said image carrier, said slide member sandwiching said receiving portion between said slide member and said intermediate support member thereby to retain said composite unit on said common mount member.

41. An apparatus as claimed in claim 40, comprising:

a plurality of image carriers arranged in parallel; and a plurality of intermediate support members respectively associated with said plurality of image carriers, said sliding member having a size and a stroke great enough to selectively hold or release receiving portions of said plurality of image carriers at the same time in cooperation with said intermediate support members.

42. A method of assembling an image forming apparatus configured to write a latent image on a rotatable image carrier with a writing device, develop the latent image to thereby produce a toner image, and transfer the toner image to a recording medium, said method comprising the steps of:

mounting to a side wall of a body of said image forming apparatus a common mount member including a support portion configured to support a receiving portion receiving the image carrier and a support portion configured to support the writing device, said support portions being held in a preselected positional relation;

mounting the writing device to said common mount member;

mounting the image carrier to a developing unit including a developing device configured to develop the latent image to form thereby a composite unit or constructing said composite unit beforehand; and mounting said composite unit to said common mounting member.

43. A method as claimed in claim 42, wherein said step of mounting to a side wall of a body of said image forming apparatus a common mount member includes the steps of:

mounting to said side wall a common mount member including a drive member support portion for supporting a drive member which transfers a torque to the image carrier; and mounting said drive member after said common mount member including said drive member has been mounted to said side wall.

44. A method of assembling an image forming apparatus configured to write a latent image on a rotatable image carrier with a writing device, develop the latent image thereby to produce a toner image, and transfer the toner image to a recording medium, said method comprising the steps of:

mounting to a side wall of a body of said image forming apparatus a common mount member including a support portion configured to support a developing unit including a developing device configured to develop the latent image and a support configured to support the writing device, said support portions being held in a preselected positional relation;

mounting the writing device and said developing unit to said common mount member; and mounting the image carrier to said developing unit.

45. A method as claimed in claim 44, wherein said step of mounting to a side wall of a body of said image forming apparatus a common mount member includes the steps of:

mounting to said side wall a common mount member including a drive member support portion configured to support a drive member which transfers a torque to the image carrier; and mounting said drive member after said common mount member including said drive member has been mounted to said side wall.

46. A method of assembling an image forming apparatus configured to write a latent image on a rotatable image carrier with a writing device, develop the latent image to thereby produce a toner image, and transfer the toner image to a recording medium, said method comprising the steps of:

mounting to a side wall of a body of said image forming apparatus a common mount member including a shaft support portion configured to support a receiving portion which supports the image carrier and a writing device support portion configured to support the writing device, said shaft support portion and said writing device support portion being held in a preselected positional relation for image formation; and mounting the image carrier and the writing device to said shaft support portion and said writing device support portion, respectively, wherein said common mount member includes a drive member support portion configured to support a drive member which transfers a torque to the image carrier, and wherein said drive member is mounted after said common mount member has been mounted to said side wall.

* * * * *